US008296875B2

(12) United States Patent
Loberger et al.

(10) Patent No.: US 8,296,875 B2
(45) Date of Patent: Oct. 30, 2012

(54) LAVATORY SYSTEM

(75) Inventors: John M. Loberger, Germantown, WI (US); Jason M. Renner, Greenfield, WI (US); Jeffery S. Jaworski, Sussex, WI (US); Mark A. Thielke, Menomonee Falls, WI (US); Mark A. Meyer, Slinger, WI (US); Kevin M. Kohlwey, Port Washington, WI (US); Douglas Carpiaux, Milwaukee, WI (US); Daniel J. De Lay, Muskego, WI (US); Glenn T. Walters, Port Washington, WI (US); Richard Walters, Hugo, MN (US); Jon W. Hauser, II, Geneva, IL (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 967 days.

(21) Appl. No.: 12/233,466

(22) Filed: Sep. 18, 2008

(65) Prior Publication Data

US 2009/0077736 A1 Mar. 26, 2009

Related U.S. Application Data

(60) Provisional application No. 60/994,580, filed on Sep. 20, 2007, provisional application No. 61/028,852, filed on Feb. 14, 2008, provisional application No. 61/046,319, filed on Apr. 18, 2008.

(51) Int. Cl.
*E03C 1/05* (2006.01)

(52) U.S. Cl. ..... 4/623; 4/626

(58) Field of Classification Search ..... 4/619, 623–63, 4/26; 251/129.03, 129.04
See application file for complete search history.

(56) References Cited

U.S. PATENT DOCUMENTS 540,235 A 6/1895 Clifford et al.
D30,136 S 2/1899 Eckerson
(Continued)

FOREIGN PATENT DOCUMENTS

AT 141398 4/1935
(Continued)

OTHER PUBLICATIONS

International Search Report for International Application No. PCT/US2008/076875, dated Apr. 3, 2009, 4 pages.
(Continued)

*Primary Examiner* — Basil Katcheves
*Assistant Examiner* — Beth Stephan
(74) *Attorney, Agent, or Firm* — Boyle Fredrickson, S.C.

(57) ABSTRACT

A lavatory system is disclosed to include one or more integrated hand washing stations. Each hand washing station includes a basin, a faucet, a solenoid valve configured to control water flow to the faucet, and a electric hand dryer located adjacent the basin and the faucet so that the user of the washing station may use the faucet and the electric hand dryer without leaving the washing station. The electric hand dryer preferably includes an outlet to direct air across the associated basin so that any water that drips from the user's hands will fall within the basin. A control system may be provided to control activation of the fixtures such as the solenoid valve, the electric hand dryer, and/or soap dispenser. The control system may be configured, for example, to inhibit simultaneous activation of the solenoid valve and the hand dryer. A photovoltaic system may be provided to provide power to one or more of electrical fixtures.

32 Claims, 43 Drawing Sheets

U.S. PATENT DOCUMENTS

| | | | | | |
|---|---|---|---|---|---|
| D36,574 | S | | 10/1903 | Zipp | |
| D36,575 | S | | 10/1903 | Zipp | |
| D36,595 | S | | 10/1903 | Peet | |
| 937,509 | A | | 10/1909 | Carpenter | |
| 1,069,972 | A | | 8/1913 | Metzger | |
| 1,323,398 | A | | 12/1919 | Leland | |
| 1,616,313 | A | | 2/1927 | Farmer | |
| 1,659,851 | A | | 2/1928 | Brewington | |
| D81,754 | S | | 8/1930 | Mabee | |
| 2,008,183 | A | | 2/1934 | McCord | |
| 1,961,179 | A | | 6/1934 | Tinkham | |
| D100,310 | S | | 7/1936 | Blu | |
| 2,202,107 | A | | 5/1940 | Korn | |
| 2,438,762 | A | | 3/1948 | McLeckie | |
| 2,470,187 | A | | 5/1949 | Price | |
| 2,498,699 | A | | 2/1950 | Mullett et al. | |
| 2,504,740 | A | | 4/1950 | Siegel | |
| D170,204 | S | | 8/1953 | Long | |
| 2,761,222 | A | | 9/1956 | Bennett | |
| 2,859,535 | A | | 11/1958 | Carlson | |
| 2,908,019 | A | | 10/1959 | Lyon, Jr. | |
| 2,965,906 | A | | 12/1960 | Mullett et al. | |
| D201,493 | S | | 6/1965 | Sundberg et al. | |
| 3,305,938 | A | | 2/1967 | Arthur | |
| D210,131 | S | | 2/1968 | Rourke | |
| 3,409,995 | A | | 11/1968 | Greenwood et al. | |
| 3,502,384 | A | | 3/1970 | Gipson | |
| 3,556,158 | A | | 1/1971 | Schneider | |
| 3,575,583 | A | | 4/1971 | Brown | |
| 3,587,177 | A | | 6/1971 | Overly et al. | |
| 3,643,346 | A | | 2/1972 | Lester | |
| D238,075 | S | | 12/1975 | Harris | |
| 4,144,596 | A | * | 3/1979 | MacFarlane et al. | 4/626 |
| 4,145,769 | A | * | 3/1979 | MacFarlane et al. | 4/626 |
| D251,795 | S | | 5/1979 | McCann | |
| 4,193,209 | A | | 3/1980 | Lovison et al. | |
| 4,239,555 | A | | 12/1980 | Scharlack et al. | |
| 4,256,133 | A | | 3/1981 | Coward et al. | |
| D260,678 | S | | 9/1981 | Hiller | |
| 4,295,233 | A | * | 10/1981 | Hinkel et al. | 4/619 |
| 4,336,619 | A | | 6/1982 | Hinkel et al. | |
| 4,375,874 | A | | 3/1983 | Leotta et al. | |
| 4,398,310 | A | * | 8/1983 | Lienhard | 4/623 |
| D272,263 | S | | 1/1984 | Lienhard | |
| 4,497,999 | A | | 2/1985 | Postbeschild | |
| D279,404 | S | | 6/1985 | Hiller | |
| 4,541,563 | A | | 9/1985 | Uetsuhara | |
| 4,594,797 | A | | 6/1986 | Houck | |
| 4,606,085 | A | | 8/1986 | Davies | |
| 4,611,768 | A | | 9/1986 | Voss et al. | |
| 4,644,256 | A | | 2/1987 | Farias et al. | |
| 4,685,222 | A | | 8/1987 | Houck | |
| 4,707,933 | A | | 11/1987 | Keck et al. | |
| 4,742,583 | A | | 5/1988 | Yoshida et al. | |
| 4,744,515 | A | | 5/1988 | Watanabe | |
| 4,765,003 | A | | 8/1988 | Chang | |
| 4,769,863 | A | | 9/1988 | Tegg et al. | |
| 4,839,039 | A | | 6/1989 | Parsons et al. | |
| 4,852,802 | A | | 8/1989 | Iggulden et al. | |
| 4,857,705 | A | | 8/1989 | Blevins | |
| 4,876,435 | A | | 10/1989 | Hawkins | |
| 4,914,833 | A | | 4/1990 | Pilolla et al. | |
| 4,916,382 | A | | 4/1990 | Kent | |
| 4,959,603 | A | | 9/1990 | Yamamoto et al. | |
| 4,967,425 | A | | 11/1990 | Kawamura et al. | |
| 4,980,574 | A | | 12/1990 | Cirrito | |
| 5,008,963 | A | | 4/1991 | Stein | |
| 5,031,258 | A | | 7/1991 | Shaw | |
| 5,031,337 | A | | 7/1991 | Pilolla et al. | |
| 5,063,955 | A | | 11/1991 | Sakakibara | |
| 5,074,322 | A | | 12/1991 | Jaw | |
| 5,076,424 | A | * | 12/1991 | Nakamura | 206/205 |
| 5,099,587 | A | | 3/1992 | Jarosch | |
| D326,711 | S | | 6/1992 | Lotito et al. | |
| 5,123,515 | A | * | 6/1992 | Zeller | 193/2 R |
| 5,144,757 | A | | 9/1992 | Sasso | |
| 5,146,695 | A | | 9/1992 | Yang | |
| 5,158,114 | A | | 10/1992 | Botsolas | |
| 5,163,234 | A | | 11/1992 | Tsukamoto et al. | |
| D332,194 | S | | 1/1993 | Hines | |
| D332,195 | S | | 1/1993 | Hines | |
| D332,196 | S | | 1/1993 | Hines | |
| D332,365 | S | | 1/1993 | Hines | |
| D332,366 | S | | 1/1993 | Hines | |
| D332,369 | S | | 1/1993 | Hanna et al. | |
| D332,370 | S | | 1/1993 | Hanna et al. | |
| D332,542 | S | | 1/1993 | Hines | |
| D332,679 | S | | 1/1993 | Hines | |
| D332,849 | S | | 1/1993 | Hines | |
| 5,177,879 | A | | 1/1993 | Muta | |
| 5,181,328 | A | | 1/1993 | Bouverie | |
| D332,889 | S | | 2/1993 | Hines | |
| 5,186,360 | A | | 2/1993 | Mease et al. | |
| D334,266 | S | | 3/1993 | Hines | |
| 5,193,563 | A | | 3/1993 | Melech | |
| 5,199,118 | A | | 4/1993 | Cole et al. | |
| D336,572 | S | | 6/1993 | Gunderson et al. | |
| 5,224,685 | A | | 7/1993 | Chiang et al. | |
| 5,230,109 | A | | 7/1993 | Zaccai et al. | |
| D338,361 | S | | 8/1993 | Hines | |
| D340,374 | S | | 10/1993 | Hines | |
| D340,375 | S | | 10/1993 | Hines | |
| 5,251,872 | A | | 10/1993 | Kodaira | |
| 5,253,376 | A | | 10/1993 | Fait | |
| D341,724 | S | | 11/1993 | Hines | |
| 5,259,410 | A | | 11/1993 | Trueb et al. | |
| D342,175 | S | | 12/1993 | Hines | |
| D342,177 | S | | 12/1993 | Hanna et al. | |
| D342,992 | S | | 1/1994 | Robertson | |
| 5,280,679 | A | | 1/1994 | Edelman | |
| D344,830 | S | * | 3/1994 | Carter et al. | D34/1 |
| 5,363,517 | A | | 11/1994 | Botsolas | |
| 5,367,442 | A | | 11/1994 | Frost et al. | |
| 5,369,818 | A | | 12/1994 | Barnum et al. | |
| 5,377,427 | A | | 1/1995 | Mashata | |
| 5,412,818 | A | | 5/1995 | Chen | |
| D361,372 | S | | 8/1995 | Enthoven | |
| 5,438,763 | A | | 8/1995 | Yang | |
| 5,442,867 | A | | 8/1995 | Robinson | |
| D362,901 | S | | 10/1995 | Dannenberg et al. | |
| 5,459,944 | A | | 10/1995 | Tatsutani et al. | |
| D364,675 | S | | 11/1995 | Tebbe | |
| 5,497,135 | A | | 3/1996 | Wisskirchen et al. | |
| 5,514,346 | A | | 5/1996 | Fujita | |
| 5,522,411 | A | | 6/1996 | Johnson | |
| 5,561,871 | A | | 10/1996 | Laughton | |
| 5,588,636 | A | | 12/1996 | Eichholz et al. | |
| 5,610,591 | A | | 3/1997 | Gallagher | |
| 5,611,093 | A | | 3/1997 | Barnum et al. | |
| 5,625,908 | A | | 5/1997 | Shaw | |
| 5,651,384 | A | | 7/1997 | Rudrich | |
| D387,144 | S | | 12/1997 | Flaherty | |
| 5,701,929 | A | | 12/1997 | Helmsderfer | |
| 5,727,579 | A | | 3/1998 | Chardack | |
| D393,700 | S | | 4/1998 | Trueb et al. | |
| D394,495 | S | | 5/1998 | Hauser, II | |
| 5,781,942 | A | | 7/1998 | Allen et al. | |
| D398,969 | S | | 9/1998 | Barnum et al. | |
| 5,813,047 | A | | 9/1998 | Teichroeb | |
| 5,819,335 | A | | 10/1998 | Hennessy | |
| D402,358 | S | | 12/1998 | Bonnell | |
| 5,868,311 | A | | 2/1999 | Cretu-Petra | |
| 5,873,178 | A | | 2/1999 | Johnson | |
| 5,915,851 | A | | 6/1999 | Wattrick et al. | |
| D411,876 | S | | 7/1999 | Hafner et al. | |
| 5,924,148 | A | | 7/1999 | Flowers, Sr. | |
| 5,945,913 | A | | 8/1999 | Gallagher | |
| 5,954,069 | A | | 9/1999 | Foster | |
| 5,966,753 | A | | 10/1999 | Gauthier et al. | |
| 5,974,685 | A | | 11/1999 | Hironaka | |
| 5,992,430 | A | * | 11/1999 | Chardack et al. | 134/115 G |
| D420,727 | S | | 2/2000 | Hundley | |
| 6,018,885 | A | | 2/2000 | Hill | |
| 6,038,786 | A | | 3/2000 | Aisenberg et al. | |
| D422,346 | S | | 4/2000 | Svendsen | |
| D428,477 | S | | 7/2000 | O'Connell et al. | |
| D431,288 | S | | 9/2000 | Helmsderfer | |

6,119,285 A 9/2000 Kim
D433,109 S 10/2000 Wilke et al.
6,128,826 A 10/2000 Robinson
6,131,587 A 10/2000 Chardack et al.
6,161,227 A 12/2000 Bargenquast
D435,893 S 1/2001 Helmsderfer
6,185,838 B1 2/2001 Moore
6,189,230 B1 2/2001 Huen
6,212,707 B1 4/2001 Thompson et al.
6,250,601 B1 * 6/2001 Kolar et al. ..... 251/129.04
6,257,264 B1 7/2001 Sturman et al.
D446,664 S 8/2001 Petri
D447,224 S 8/2001 Barnum et al.
6,282,812 B1 9/2001 Wee et al.
6,286,153 B1 9/2001 Keller
6,295,410 B1 9/2001 Helms et al.
D448,585 S 10/2001 Petri
D453,882 S 2/2002 Petri
6,363,549 B2 4/2002 Humpert et al.
6,386,390 B1 5/2002 Tinker
6,393,634 B1 5/2002 Kodaira et al.
6,426,701 B1 7/2002 Levy et al.
6,431,189 B1 8/2002 Deibert
D462,195 S 9/2002 Wang
6,484,965 B1 * 11/2002 Reaves ..... 242/560
6,523,193 B2 2/2003 Saraya
6,572,207 B2 6/2003 Hase et al.
D477,060 S 7/2003 Loberger et al.
6,624,606 B2 9/2003 Kushida et al.
D481,826 S 11/2003 Martinuzzo et al.
6,643,865 B2 11/2003 Bork et al.
D483,152 S 12/2003 Martinuzzo et al.
D484,958 S 1/2004 Loberger et al.
6,766,589 B1 7/2004 Bory et al.
6,769,197 B1 8/2004 Tai
D496,450 S 9/2004 Loberger et al.
6,882,278 B2 4/2005 Winings et al.
D507,634 S 7/2005 Loberger et al.
6,912,864 B2 7/2005 Roche et al.
D508,117 S 8/2005 Loberger et al.
D509,577 S 9/2005 Loberger et al.
D511,205 S 11/2005 Loberger et al.
D511,821 S 11/2005 Loberger et al.
6,986,171 B1 1/2006 Perrin
7,007,318 B1 3/2006 Bork et al.
7,018,473 B2 * 3/2006 Shadrach, III ..... 118/315
7,025,227 B2 4/2006 Oliver et al.
7,039,301 B1 5/2006 Aisenberg et al.
7,039,963 B2 5/2006 Loberger et al.
7,079,037 B2 7/2006 Ross, Jr. et al.
D526,394 S 8/2006 Loberger et al.
D527,085 S 8/2006 Loberger et al.
D527,809 S 9/2006 Loberger et al.
D537,927 S 3/2007 Loberger et al.
D539,400 S 3/2007 Loberger et al.
D542,474 S 5/2007 Churchill et al.
7,228,984 B2 * 6/2007 Tack et al. ..... 220/259.1
7,296,765 B2 * 11/2007 Rodrian ..... 242/563.2
7,318,949 B2 * 1/2008 Shadrach, III ..... 427/424
D561,315 S 2/2008 Loberger et al.
7,364,053 B2 4/2008 Ophardt
7,406,722 B2 * 8/2008 Fukuizumi et al. ..... 4/623
7,437,833 B2 10/2008 Sato et al.
7,443,305 B2 10/2008 Verdiramo
D588,676 S 3/2009 Loberger et al.
D591,839 S 5/2009 Loberger et al.
7,555,209 B2 6/2009 Pradas Diez et al.
7,588,168 B2 9/2009 Bagwell et al.
7,596,883 B2 10/2009 Kameishi
7,607,442 B2 10/2009 Barnhill et al.
7,607,443 B2 10/2009 Barnhill et al.
7,614,096 B2 11/2009 Vincent
7,614,160 B2 11/2009 Kameishi et al.
7,617,830 B2 11/2009 Barnhill et al.
7,627,909 B2 12/2009 Esche
7,641,740 B2 1/2010 Barnhill et al.
D610,242 S 2/2010 Loberger et al.
7,657,162 B2 2/2010 Itoigawa et al.
7,659,824 B2 2/2010 Prodanovich et al.
7,682,464 B2 3/2010 Glenn et al.
D614,273 S 4/2010 Loberger et al.
7,690,395 B2 4/2010 Jonte et al.
7,698,770 B2 4/2010 Barnhill et al.
7,754,021 B2 7/2010 Barnhill et al.
7,754,022 B2 7/2010 Barnhill et al.
7,757,700 B2 7/2010 Barnhill et al.
7,758,701 B2 7/2010 Barnhill et al.
7,774,953 B1 8/2010 Duran
7,789,095 B2 9/2010 Barnhill et al.
D625,792 S 10/2010 Rundberg et al.
7,818,083 B2 10/2010 Glenn et al.
D628,280 S 11/2010 Loberger et al.
7,825,564 B2 11/2010 Croft et al.
RE42,005 E 12/2010 Jost et al.
D629,877 S 12/2010 Rundberg
7,856,736 B2 12/2010 Churchill et al.
D633,992 S 3/2011 Rundberg et al.
D637,350 S 5/2011 Kato et al.
7,944,116 B2 5/2011 Causier
7,946,055 B2 5/2011 Churchill et al.
7,971,368 B2 7/2011 Fukaya et al.
2001/0020619 A1 * 9/2001 Pfeifer et al. ..... 220/263
2002/0019709 A1 2/2002 Segal
2002/0157176 A1 10/2002 Wawrla et al.
2002/0171056 A1 11/2002 Paese et al.
2003/0172547 A1 9/2003 Shephard, II
2003/0188380 A1 10/2003 Loberger et al.
2004/0083547 A1 5/2004 Mercier
2004/0128755 A1 7/2004 Loberger et al.
2004/0149779 A1 8/2004 Boll et al.
2004/0251292 A1 * 12/2004 Grebonval et al. ..... 225/39
2005/0087557 A1 4/2005 Oliver et al.
2005/0139719 A1 * 6/2005 Grebonval et al. ..... 242/597.7
2005/0205818 A1 9/2005 Bayley et al.
2005/0211715 A1 * 9/2005 Parris et al. ..... 221/34
2006/0101575 A1 5/2006 Louis
2006/0102642 A1 * 5/2006 Muntzing et al. ..... 221/45
2006/0151513 A1 * 7/2006 Shadrach, III ..... 221/1
2006/0185074 A1 * 8/2006 Loberger et al. ..... 4/642
2006/0225200 A1 10/2006 Wierenga
2007/0023565 A1 2/2007 Babikian
2007/0079524 A1 4/2007 Sato et al.
2007/0144034 A1 6/2007 Kameishi
2007/0263994 A1 * 11/2007 Diez et al. ..... 392/380
2008/0005833 A1 1/2008 Bayley et al.
2008/0083786 A1 4/2008 Marin
2008/0098950 A1 5/2008 Gudjohnsen et al.
2008/0109956 A1 * 5/2008 Bayley et al. ..... 4/623
2008/0127410 A1 * 6/2008 Schmitt et al. ..... 4/623
2008/0185396 A1 8/2008 Yang et al.
2008/0185398 A1 8/2008 Yang et al.
2008/0185399 A1 8/2008 Yang et al.
2008/0209760 A1 9/2008 French et al.
2008/0216343 A1 9/2008 Churchill et al.
2008/0216344 A1 9/2008 Churchill et al.
2008/0222910 A1 9/2008 Churchill et al.
2008/0271527 A1 11/2008 Hewitt
2008/0285134 A1 11/2008 Closset et al.
2008/0289098 A1 11/2008 Kunkel
2008/0301970 A1 12/2008 Hackwell et al.
2008/0313918 A1 12/2008 Dyson et al.
2008/0313919 A1 12/2008 Churchill et al.
2008/0317448 A1 12/2008 Brown et al.
2009/0000024 A1 1/2009 Louis et al.
2009/0000142 A1 1/2009 Churchill et al.
2009/0034946 A1 2/2009 Caine et al.
2009/0058666 A1 3/2009 Clabaugh
2009/0077736 A1 3/2009 Loberger et al.
2009/0113746 A1 5/2009 Churchill et al.
2009/0113748 A1 5/2009 Dyson et al.
2009/0119942 A1 5/2009 Aisenberg et al.
2009/0126103 A1 5/2009 Dietrich et al.
2009/0236358 A1 * 9/2009 Rippl et al. ..... 221/1
2009/0243243 A1 * 10/2009 Watson ..... 280/47.35
2010/0132112 A1 6/2010 Bayley et al.
2010/0154239 A1 6/2010 Hutchinson
2010/0168926 A1 7/2010 Bayley et al.
2010/0192399 A1 8/2010 Sawabe et al.

| | | | | |
|---|---|---|---|---|
| 2010/0213208 | A1 | 8/2010 | Bem et al. | |
| 2010/0231392 | A1 | 9/2010 | Sherron | |
| 2010/0236092 | A1 | 9/2010 | Causier | |
| 2010/0269364 | A1 | 10/2010 | Liu | |
| 2010/0276529 | A1* | 11/2010 | Nguyen | 242/160.4 |
| 2010/0296799 | A1 | 11/2010 | Liu | |
| 2011/0006083 | A1 | 1/2011 | Walters et al. | |
| 2011/0171083 | A1 | 7/2011 | Swistak | |

FOREIGN PATENT DOCUMENTS

| | | | |
|---|---|---|---|
| AT | 141398 | | 8/1996 |
| AU | 2005203363 | A1 | 2/2006 |
| AU | 2006274708 | | 2/2007 |
| AU | 2006274715 | | 2/2007 |
| DE | 2304815 | | 8/1974 |
| DE | 4218658 | | 12/1992 |
| DE | 9304270 | | 9/1993 |
| DE | 9304160 | | 7/1994 |
| DE | 9304160 | | 9/1994 |
| DE | 19608157 | | 7/1997 |
| DE | 10210474 | | 9/2002 |
| DE | 69821140 | | 11/2004 |
| EP | 0 274 785 | A | 7/1988 |
| EP | 0274785 | | 7/1988 |
| EP | 1057942 | | 12/2000 |
| EP | 1241301 | | 9/2002 |
| EP | 1250878 | | 10/2002 |
| EP | 1 258 568 | B1 | 11/2002 |
| EP | 1057441 | | 9/2006 |
| EP | 1912549 | | 3/2010 |
| EP | 2177142 | | 4/2010 |
| EP | 2277424 | | 1/2011 |
| JP | 1256632 | | 10/1989 |
| JP | 9242155 | | 9/1997 |
| JP | 2000282528 | | 10/2000 |
| JP | 2010-046238 | | 4/2010 |
| JP | 2010-110450 | | 5/2010 |
| JP | 2011-055859 | | 3/2011 |
| KR | 10-0711544 | | 4/2007 |
| WO | WO 01/16436 | | 3/2001 |
| WO | WO 2007/011747 | A2 | 1/2007 |
| WO | WO 2007/015046 | | 2/2007 |
| WO | WO 2009/039290 | | 3/2009 |
| WO | WO 2006/055681 | | 5/2009 |
| WO | WO 2009/062546 | A1 | 5/2009 |
| WO | WO 2010/089927 | | 8/2010 |
| WO | WO 2010/095250 | | 8/2010 |
| WO | WO 2010/095251 | | 8/2010 |
| WO | WO 2010/119536 | | 10/2010 |
| WO | WO 2011/009156 | | 1/2011 |
| WO | WO 2011/077625 | | 6/2011 |

OTHER PUBLICATIONS

"Innovative Applications in Solid Surface," The Journal of the Solid Surface Industry, Jan./Feb. 2002, vol. 8, No. 1.3 pages.
Brueton advertisement for Undulatus bench, Home Design—The New York Times magazine, 2 pages.
Bradley Corporation, The Bradley Express Lavatory System: "A look, a feel, an idea as solid as granite," bearing a designation © 1996 Bradley Corporation, 4 pages.
U.S. Appl. No. 29/303,701, filed Aug. 26, 2008, Loberger.
U.S. Appl. No. 29/306,946, filed Oct. 2, 2008, Thielke et al.
Bradley Corporation. Terreon: "Shaping your designs, bearing a designation © 1998 Bradley Fixtures Corporation," 8 pages
Bradley Corporation, "Plumbing Fixtures," bearing a designation "2001," 11 pages.
International Search Report for International Application No. PCT/US2004/07675 including written opinion of the International Searching Authority, mail date Aug. 6, 2004, 7 pages.
International Search Report and Written Opinion for Application No. PCT/US2005/002194, date of mailing May 12, 2005, date received May 18, 2005, 9 pages.
Bradley Corporation, "School Solutions, A higher Dedication to your Design Needs," © 1999 Bradley Corporation, 6 pages.
Bradley Corporation, "Frequency Lavatory Systems," © Bradley Corp 2005, 4 pages.
Bradley Corporation, "Plumbing Fixtures," publicly available by Feb. 14, 2008, 10 pages.
Bradley Corporation, "The ndite™ story," publicly available by Feb. 14, 2008, 2 pages.
Bobrick Technical Data, "Contura™ Series Surface-Mounted Soap Dispenser B-4112." dated May 2006, 1 page.
Bradley Corporation, "Total Terreon Concept," © Bradley Corp 2004, 2 pages.
Bradley Corporation, "Terreon Lav Decks," © Bradley Corp 2004, 2 pages.
Bradley Corporation, "Express Lavatory Systems," © Bradley Corp 2004, 4 pages.
Bradley Corporation, "Frequency Lavatory Systems," © Bradley Corp 2004, 4 pages.
Bradley Corporation, "Terreon Washfountains," © Bradley Corp 2004, 2 pages.
Bradley Corporation, "Sentry Washfountains," © Bradley Corp 2004, 2 pages.
Bradley Corporation, "Classic Washfountains," ©Bradley Corp 2004, 2 pages.
Bradley Corporation, "Multi-Fount Washfountains," © Bradley Corp 2004, 2 pages.
Bradley Corporation, "Application Guide," © Bradley Corp 2004, 2 pages.
Bradley Corporation, Washroom Accessories, believed to be publicly available by Jul. 2007, 4 pages.
Bradley Corporation, Commercial Washroom Solutions, believed to be publicly available by Jan. 2006, 4 pages.
Bradley Corporation, Washroom Accessories, believed to be publicly available by Aug. 2003, 8 pages.
Bradley Corporation, Washroom Accessories, believed to be publicly available by Jan. 2006, 4 pages.
Bradley Corporation, Plumbing Fixtures, believed to be publicly available by Aug. 2002, 12 pages.
Bradley Corporation, Washroom Accessories, believed to be publicly available by Jan. 2008, 4 pages.
Bradley Corporation, "Installation Instructions 2483 Surface-Mounted Towel Dispenser," dated Sep. 4, 2003, 1 page.
Bradley Corporation, "Installation 270 Towel Dispenser/Waste Receptacle," dated Jun. 15, 2008, 2 pages.
Bradley Corporation, "Towel Dispenser/Waste Receptable Model 227." believed to be publicly available by Jun. 2002, 2 pages.
Bradley Corporation, "Towel Dispenser—Center Pull/Waste Receptacle Model 236," dated Feb. 11, 2005, 1 page.
Bradley Corporation, "Installation 236 Towel/Waste Unit with Center Pull," dated Mar. 9, 2005, 2 pages.
Bradley Corporation, "Towel Dispenser Model 2481," dated Dec. 21, 2004, 2 pages.
Bradley Corporation, "Towel Dispenser Model 2479-000000," dated Mar. 31, 2006, 1 page.
Bradley Corporation, "Towel Dispenser Model 2479-110000," dated Feb. 11, 2005, 1 page.
Bradley Corporation, Installation Instructions 2479 Recess-Mounted Towel Dispenser, dated Mar. 3, 2004, 1 page.
Bradley Corporation, "Installation Instructions 2479-11 Surface-Mounted Towel Dispenser," dated Feb. 27, 2004, 2 pages.
Bradley Corporation, "Towel Dispenser Model 2490," dated Nov. 21, 2005, 3 pages.
Bobrick Technical Data, "Contura™ Series Surface-Mounted Paper Towel Dispenser B-4262," dated Jun. 2006, 1 page.
Bobrick Technical Data, "Contura™ Series Surface-Mounted Multi-Roll Toilet Tissue Dispenser B-4288," dated May 2006, 1 page.
Bobrick Technical Data, "Contura™ Series Recessed Multi-Roll Toilet Tissue Dispenser B-4388," dated May 2006, 1 page.
Bobrick Technical Data, "Contura™ Series Recessed Paper Towel Dispenser B-4362," dated Nov. 2006, 1 page.
Bobrick Technical Data, "Contura™ Series Recessed Waste Receptacle B-43644," dated Nov. 2006, 1 page.
Bobrick Technical Data, "Contura™ Series Recessed Paper Towel Dispenser and Waste Receptacle B-43944," dated Nov. 2006, 2 pages.
Bobrick Technical Data, "Contura™ Series Surface-Mounted Sanitary Napkin Disposal B-270," dated May 2006, 1 page.

Bobrick Technical Data, "Contura™ Series Recessed Soap Dispenser B-4063," accessed on Mar. 28, 2007, 1 page.
International Search Report and Written Opinion for International Application No. PCT/US2008/076875, mail date Jul. 6, 2009, 21 pages.
Bradley Corporation, "Plumbing Fixtures," believed to be publicly available by Mar. 2006, 3 pages.
Bradley Corporation, "Bradpack Preassembled Wash Centers," dated Jan. 1986, 12 pages.
U.S. Appl. No. 61/198,293 of William M. Louis, Dispenser That Cantilevers Flexible Sheet Material for Horizontal Presentation, filing date unavailable, 16 pages.
U.S. Appl. No. 61/206,768 of William M. Louis, "Swingarm Loading Mechanism for Paper Towel Dispensing Systems," filing date unavailable, 13 pages.
Bradley Corporation, "All-In-One-Of-A-Kind" Advocate™ Sell Sheet Brochure. Accessed Apr. 2011at http://bradleycorp.com/advocate/Advocate_Sell_Sheet.pdf. 6 pages.
Bradley Corporation Advocate™ Lavatory System—LA90 Series Manual, document No. 1068. Accessed Apr. 2011at http://www.bradleycorp.com/products/fixtures/lavsystems/advocate/viewproduct.isp?pgid=1724, © Bradley Corp 2010, 8 pages.
Bradley Corporation Advocate™ Lavatory System—LA60 Series Manual, document No. 1066. Accessed Apr. 2011at http://www.bradleycorp.com/products/fixtures/lavsystems/advocate/viewproduct.isp?pgid=1724, © Bradley Corp 2010, 7 pages.
Bradley Corporation Advocate™ Lavatory System—LA30 Installation Manual, document No. 215-1657 Rev. A; ECM 09-08-0026. Accessed Apr. 2011at http://www.bradleycorp.com/products/fixtures/lavsystems/advocate/viewproduct.isp?pgid=1724, dated Oct. 7, 2009 © Bradley Corp 2009, 20 pages.
PCT/International Search Report and Written Opinion—(Application No. PCT/US2010/051647)—11 pages.

* cited by examiner

LAVATORY SYSTEM

CROSS-REFERENCE TO RELATED PATENT APPLICATIONS

This application claims the benefit of U.S. Provisional Application No. 60/994,580, filed Sep. 20, 2007, U.S. Provisional Application No. 61/028,852, filed Feb. 14, 2008, and U.S. Provisional Application No. 61/046,319, filed Apr. 18, 2008, all three of which are hereby incorporated herein by reference in their entireties.

BACKGROUND

The present invention relates to a lavatory system. More particularly, the present invention relates to a lavatory system with hand washing stations that can be positioned at a variety of heights relative to the floor.

It is known to install a plurality of fixtures in a public, commercial or industrial, residential or non-residential environment such as a restroom. Such known fixtures include a lavatory system, towel dispensers, waste receptacles, hand-dryers, and the like. Lavatory systems typically include one or more stations that provide lavatory services to one or more users. Such known lavatory systems also typically include a countertop, a backsplash, one or more wash basins (with drains), accommodating one or more faucets, and are adopted for plumbing to be coupled to the faucets (and drains). In such known systems, the countertop is typically mounted to comply with the applicable accessibility regulations, such as Americans with Disabilities Act (ADA) Accessibility Guidelines for Buildings and Facilities and Uniform Accessibility Standards for Lavatories, or other standards (e.g., Texas Accessibility Standards or TAS).

However, such known lavatory systems typically require multiple custom designed and manufactured components, such as multiple lavatory systems for placement at the various heights.

SUMMARY

The present invention relates to a control system for a lavatory system including one or more integrated hand washing stations. Each hand washing station includes a basin, a faucet, a solenoid valve configured to control water flow to the faucet, and a electric hand dryer located adjacent the basin and the faucet so that the user of the washing station may use the faucet and the electric hand dryer without leaving the washing station. The electric hand dryers include an outlet to direct air across the associated basin so that any water that drips from the user's hands will fall within the basin. The control system configured to control activation of the solenoid valve and the electric hand dryer, wherein the control system is configured to inhibit simultaneous activation of the solenoid valve and the hand dryer. For example, the control system may be configured to prevent activation of the electric hand dryer when the solenoid valve has been activated; prevent activation of a soap dispenser when the solenoid valve and/or the hand dryer has been activated. The activation of the various fixtures may be according to a predetermined timing and sequence (e.g., an algorithm that activates fixtures based on sensed conditions or other factors). The control system may be in communication with a single sensor dedicated (directed) to each wash station that is configured to sense the presence of the user's hands near the hand washing station. Alternatively, each wash station may include a sensor to detect the presence of a hand of the user proximate that station's faucet, another sensor to detect the user's hand proximate that station's soap dispenser, and/or another sensor to detect the presence of a hand of the user proximate that station's electric hand dryer, wherein the control system activates the solenoid valve and the hand dryer based on signals received from the first sensor and second sensor according to a predetermined timing and sequence.

Another embodiment of the present invention relates to a lavatory system powered by renewable energy to provide hand washing functionality to a plurality of users. The lavatory system includes a base configured to at least partially enclose plumbing and a panel configured to articulate coupled to the base and movable between a closed position and an opened position. The panel prevents access to the interior portion of the base in the closed position and permits access to the interior portion of the base in the opened position. The lavatory system further includes a photovoltaic system having an energy storage element and an array of photovoltaic cells coupled to the panel and coupled to the energy storage element. The lavatory system includes a first hand washing station. The first hand washing station includes a first basin positioned at a first height, a first faucet, a first solenoid valve configured to control water flow to the first faucet, and a first electric hand dryer located adjacent the first basin and the first faucet so that the user of the first washing station may use the first faucet and the first electric hand dryer without leaving the first washing station. The lavatory system also includes a second hand washing station. The second hand washing station includes a second basin positioned at a second height different from the first height of the first basin, a second faucet, a second solenoid valve configured to control water flow to the second faucet, and a second electric hand dryer located adjacent the second basin and the second faucet so that the user of the second hand washing station may use the second faucet the second electric hand dryer without leaving the second washing station. The photovoltaic system provides power to the first valve and the second valve.

Another embodiment of the present invention relates to a lavatory system capable of providing simultaneous hand washing functionality to a plurality of users. The lavatory system includes a base at least partially enclosing plumbing and configured to be coupled to a wall when installed. The lavatory system also includes a first integrated hand washing station coupled to the base. The first integrated hand washing station includes a first basin having a front top edge located at a first height above the floor, a first faucet configured to direct water into the first basin, a first soap dispenser, and a first electric hand dryer. The first faucet, the first soap dispenser, and the first electric hand dryer are located adjacent the first basin so that a user of the first washing station may use the first faucet, the first soap dispenser, and/or the first electric hand dryer without leaving the first washing station. The lavatory system also includes a second integrated hand washing station coupled to the base and spaced apart from the first integrated hand washing station. The second integrated hand washing station includes a second basin having a front top edge located at a second height above the floor, the second height of the second basin being different from the first height of the first basin, a second faucet configured to direct water into the second basin, a second soap dispenser, and a second electric hand dryer. The second faucet, the second soap dispenser, and the second electric hand dryer are located adjacent the second basin so that a user of the second washing station may use the second faucet, the second soap dispenser, and/or the second electric hand dryer without leaving the second washing station.

Another embodiment of the present invention relates to a modular lavatory system configured to be coupled to a wall. The lavatory system includes a first hand washing station, a second hand washing station, and a mounting system configured to couple the first hand washing station and the second hand washing station to the wall. The mounting system includes a first track mountable to the wall, a first mounting frame coupled to the first hand washing station and configured to engage the first track to mount the first hand washing station at a first height, and a second mounting frame coupled to the second hand washing station and configured to engage the first track to mount the second hand washing station at a second height different than the first height.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the invention described herein.

DETAILED DESCRIPTION OF PREFERRED AND EXEMPLARY EMBODIMENTS

FIGS. 1 through 12 show a lavatory system 10 according to another exemplary embodiment. The embodiments illustrated in FIGS. 1 through 12 may be configured to be supported by an adjacent wall 11 (as shown) or may be a free-standing structure configured to be supported by a base (e.g., legs, pedestal, vanity, etc.).

Figure 1:
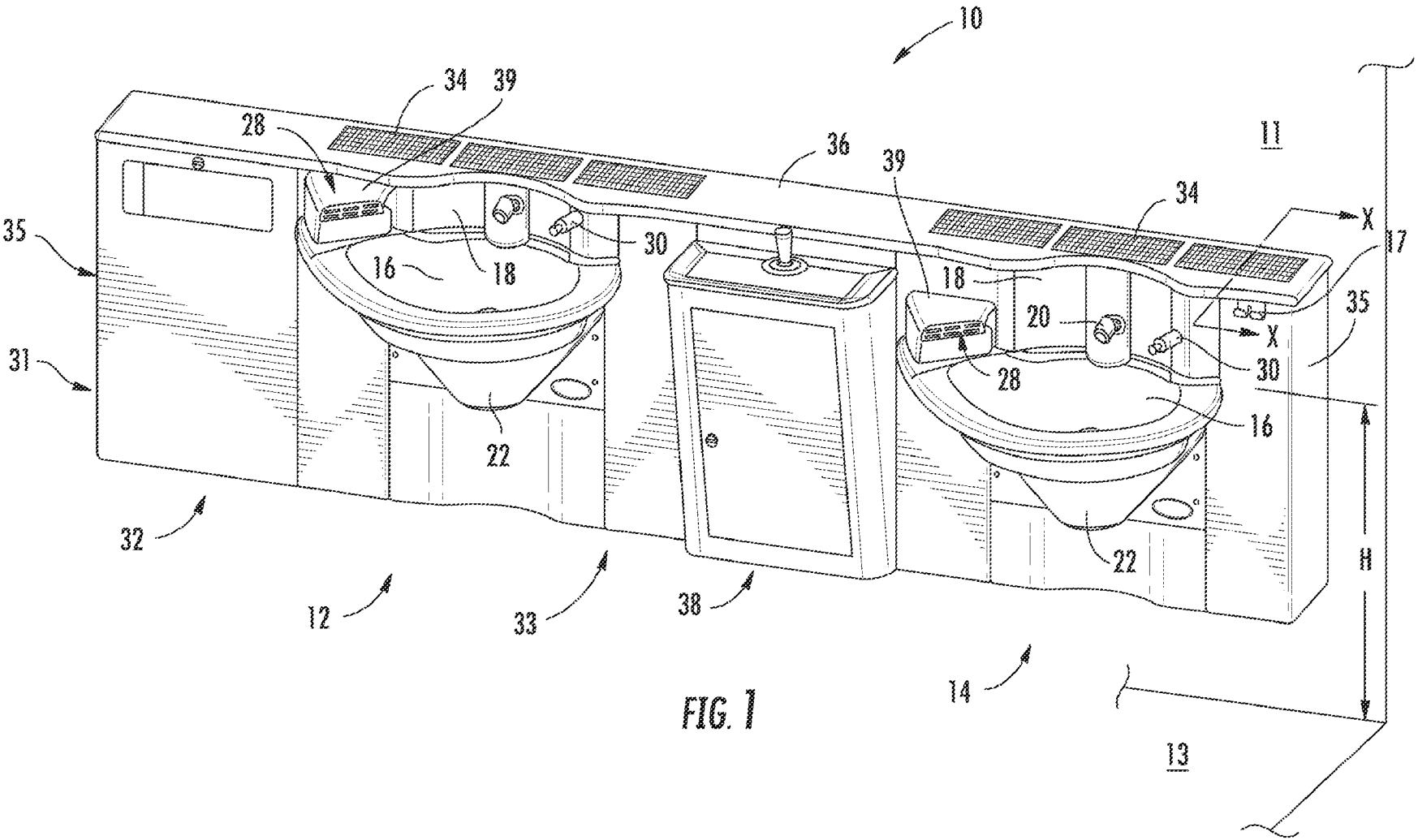
FIG. 1 is a front perspective view of a lavatory system according to an exemplary embodiment.
Figure 9:
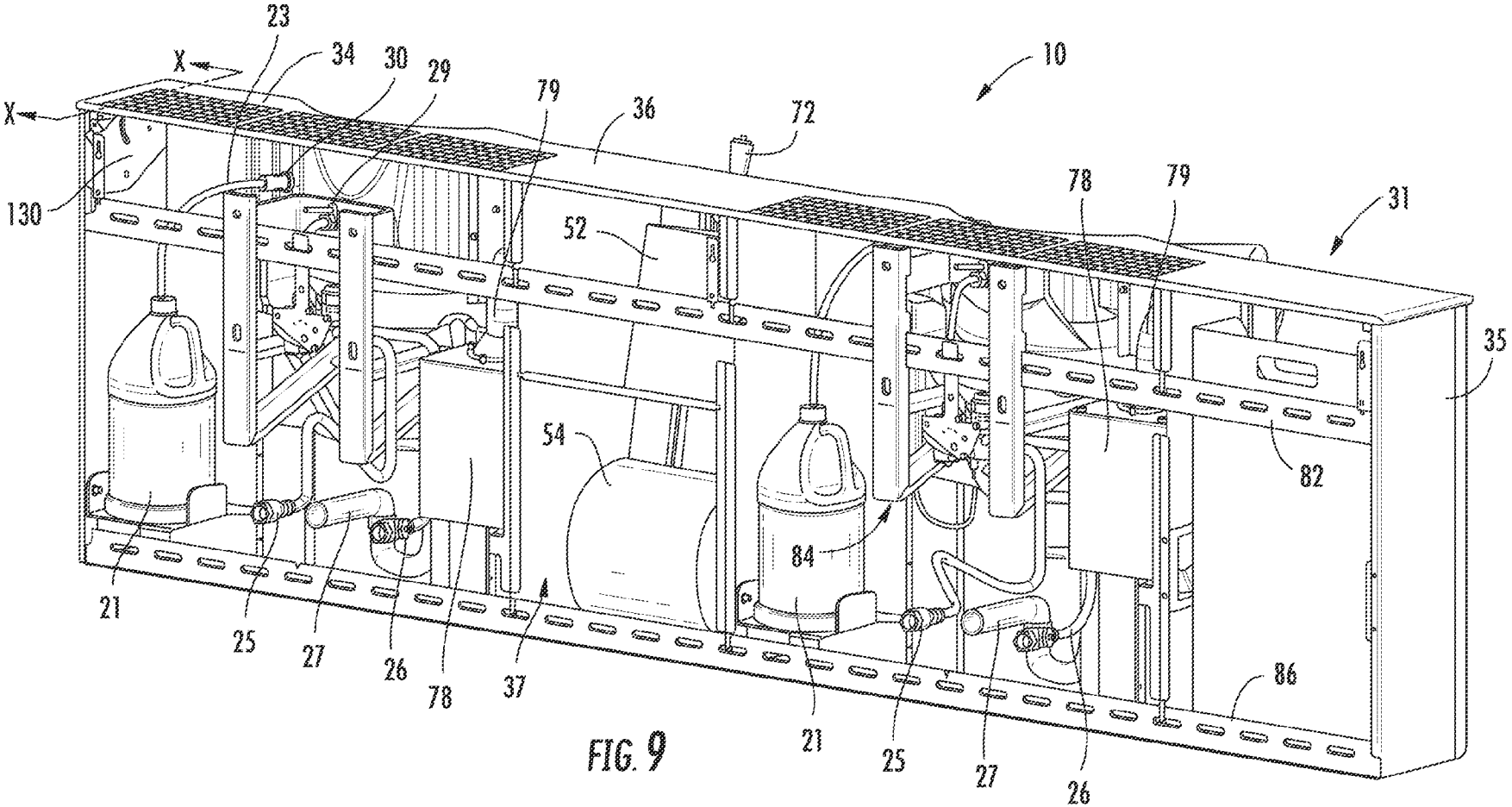
FIG. 9 is a a is a rear perspective view of the lavatory system of FIG. 1 according to an exemplary embodiment.
Figure 39:
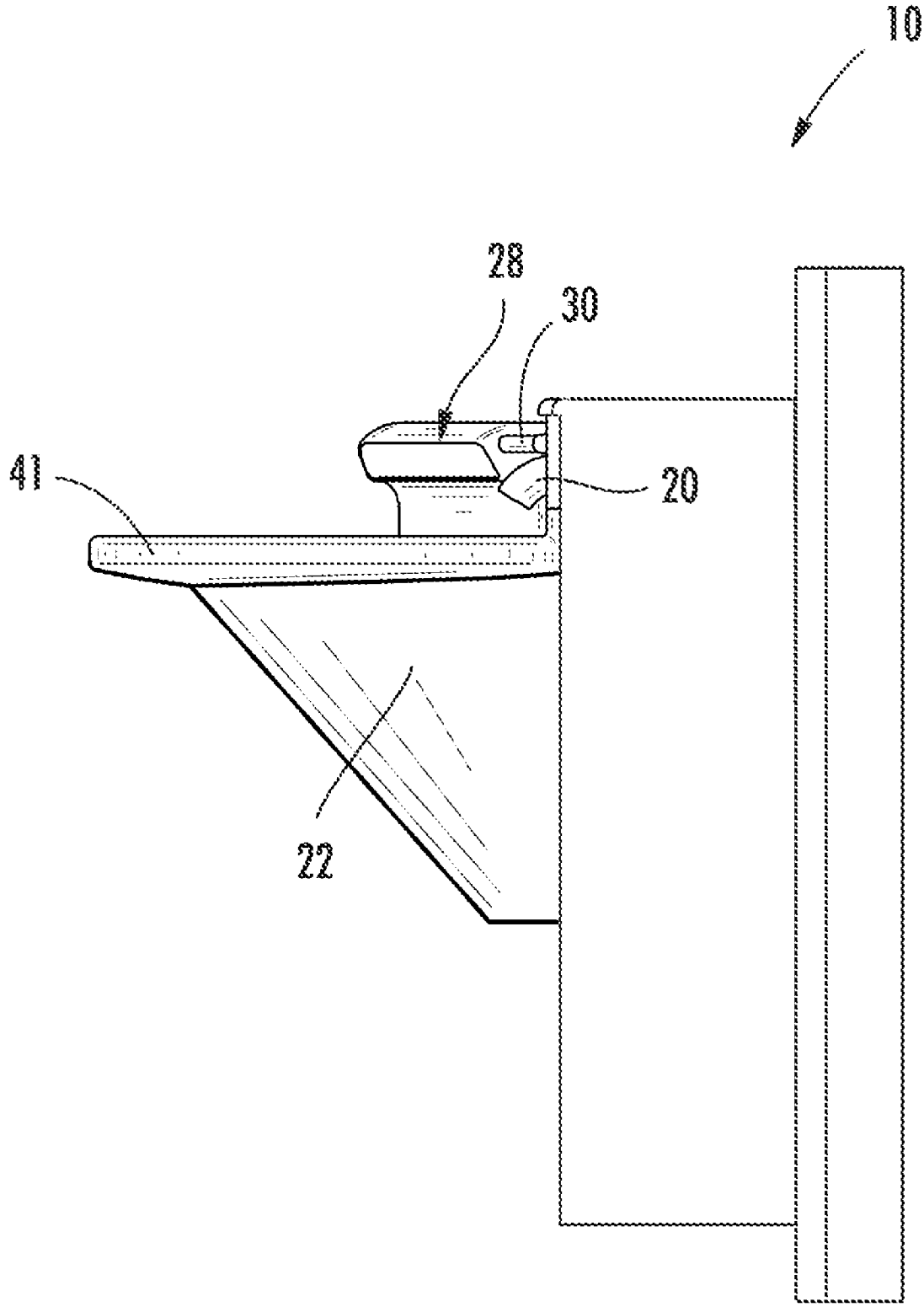
FIG. 39 is a right side view of the lavatory system of FIG. 36.
Figure 40:
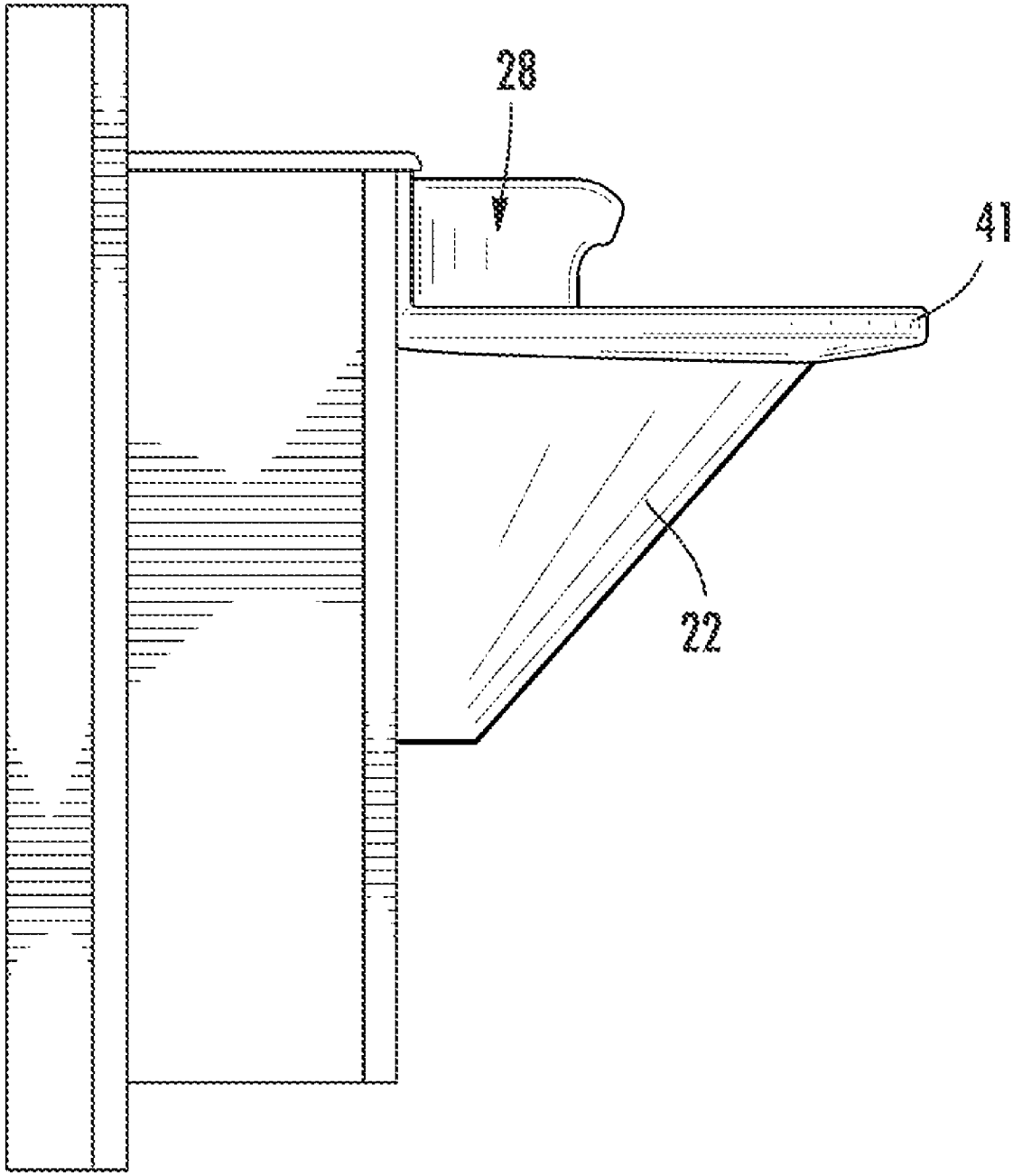
FIG. 40 is a left side view of the lavatory system of FIG. 36.
Figure 41:
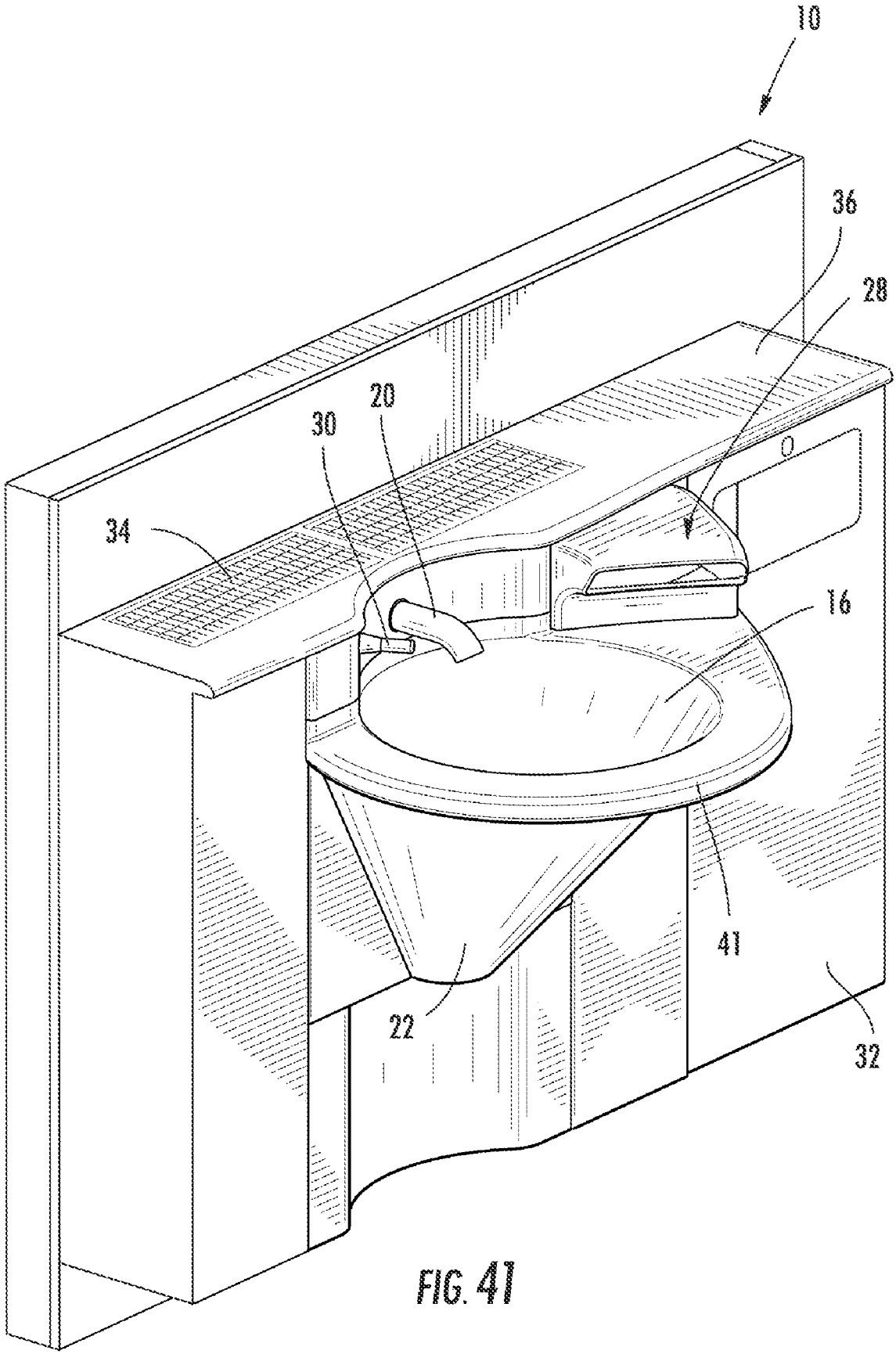
FIG. 41 is a front perspective view of a lavatory system according to an exemplary embodiment.
Figure 42:
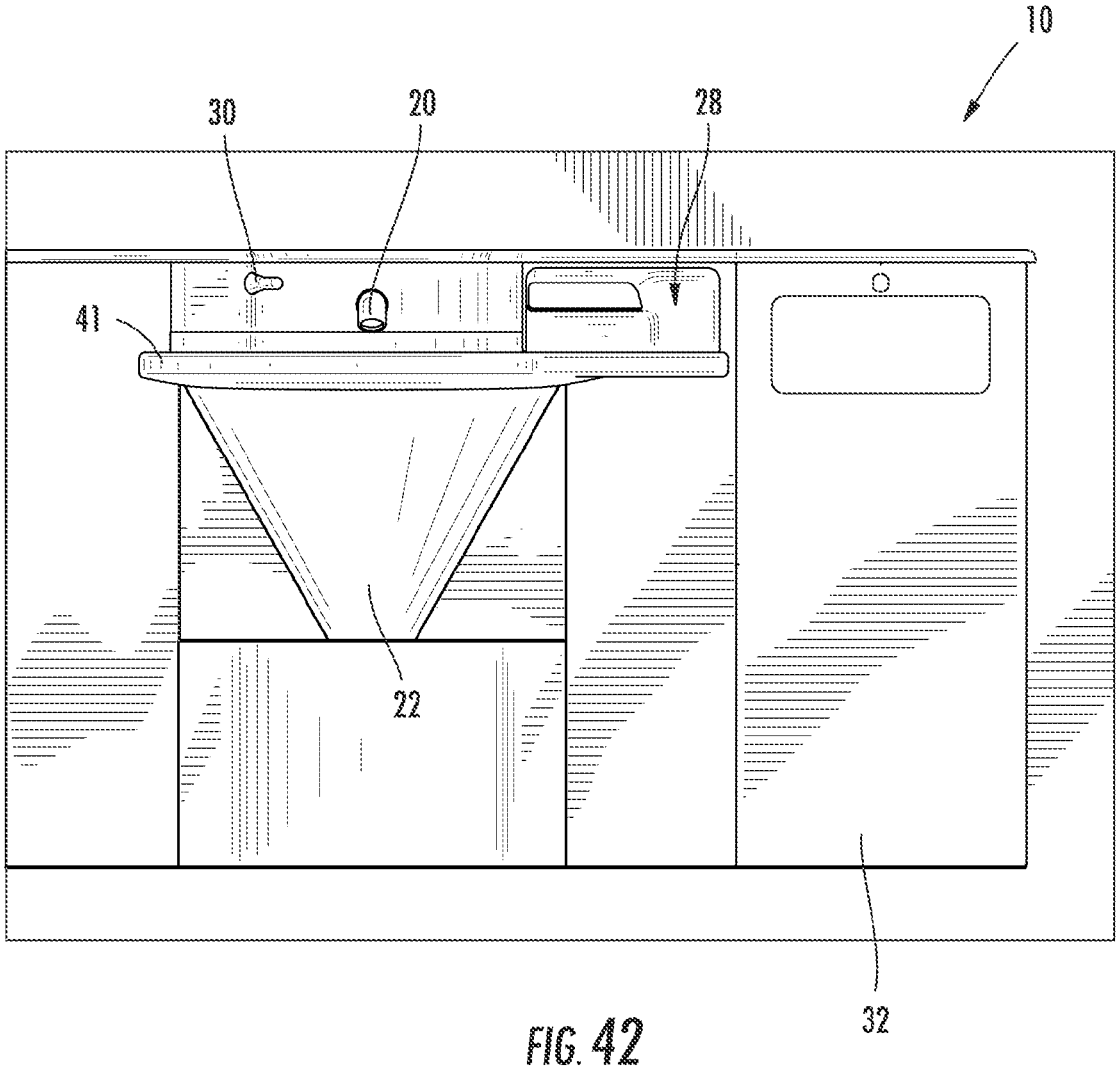
FIG. 42 is a front side view of the lavatory system of FIG. 41.
Figure 43:
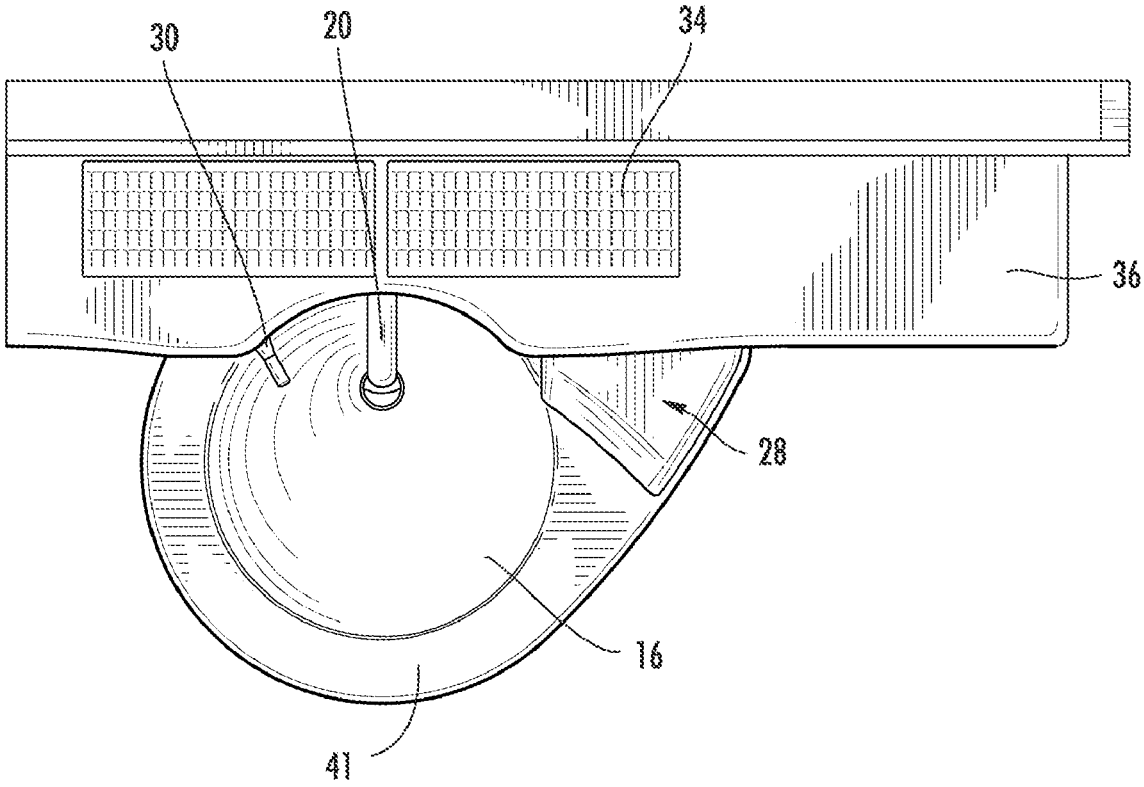
FIG. 43 is a top view of the lavatory system of FIG. 41.
Figure 44:
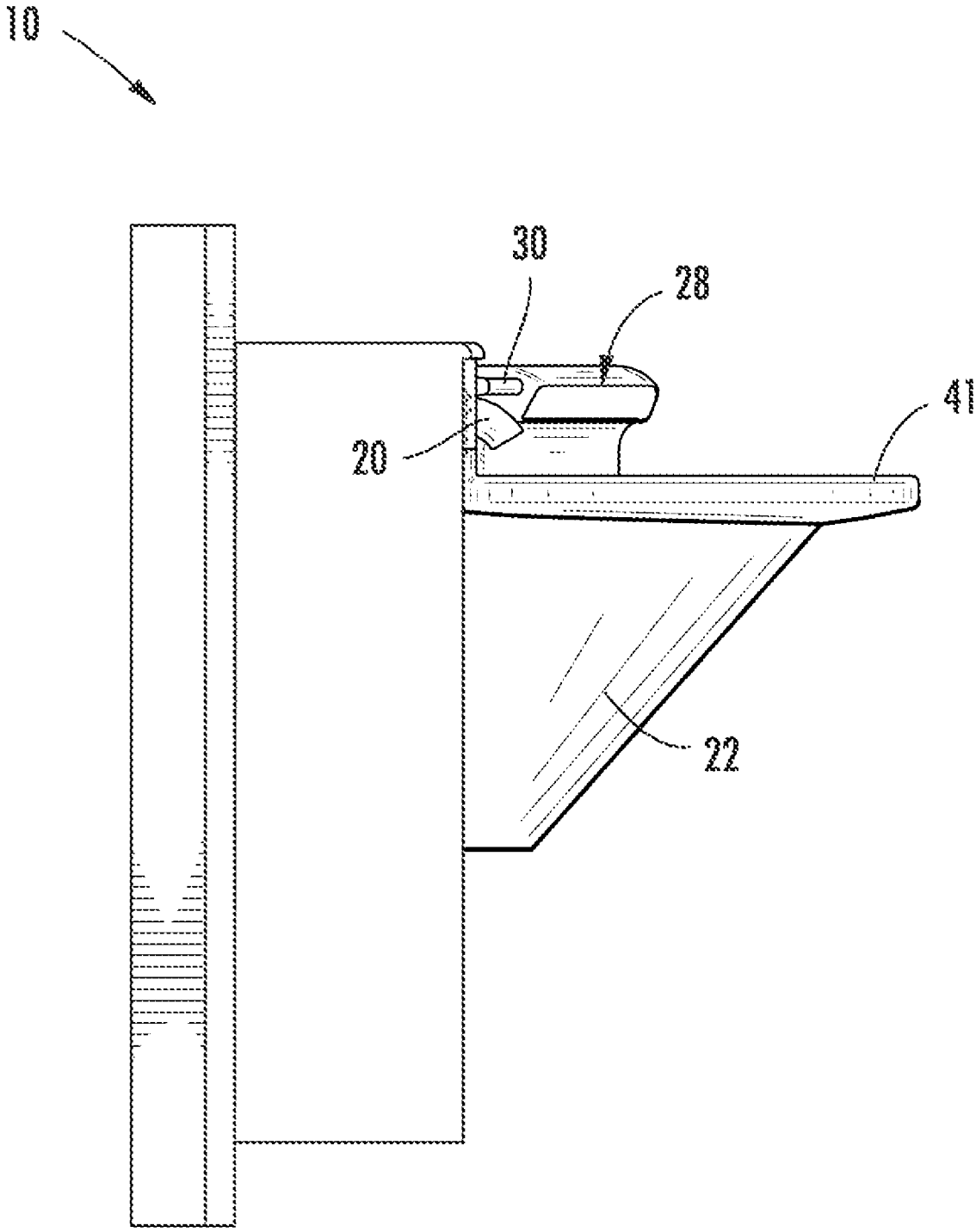
FIG. 44 is a left side view of the lavatory system of FIG. 41.
Figure 45:
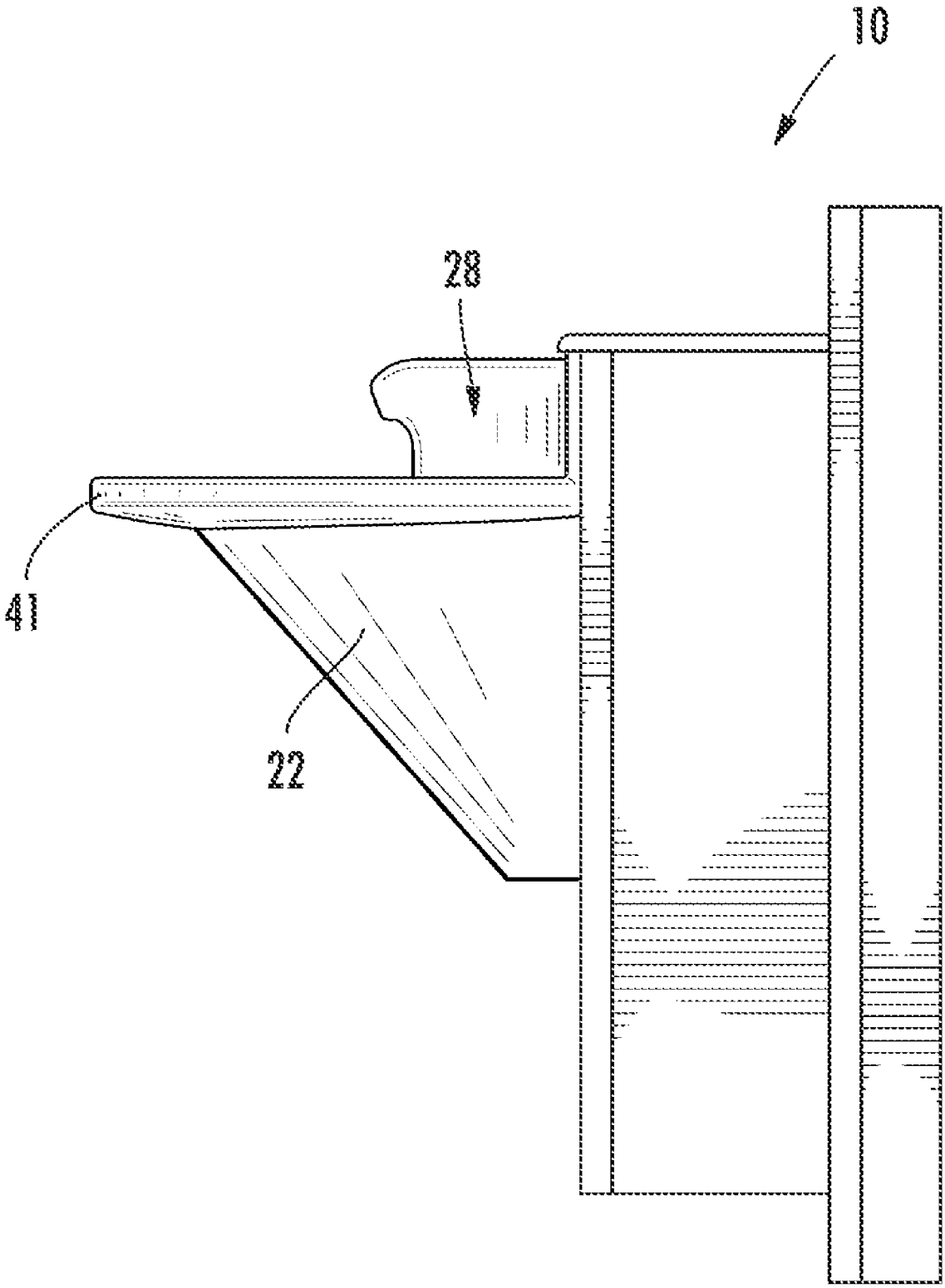
FIG. 45 is a right side view of the lavatory system of FIG. 41.
Figure 46:
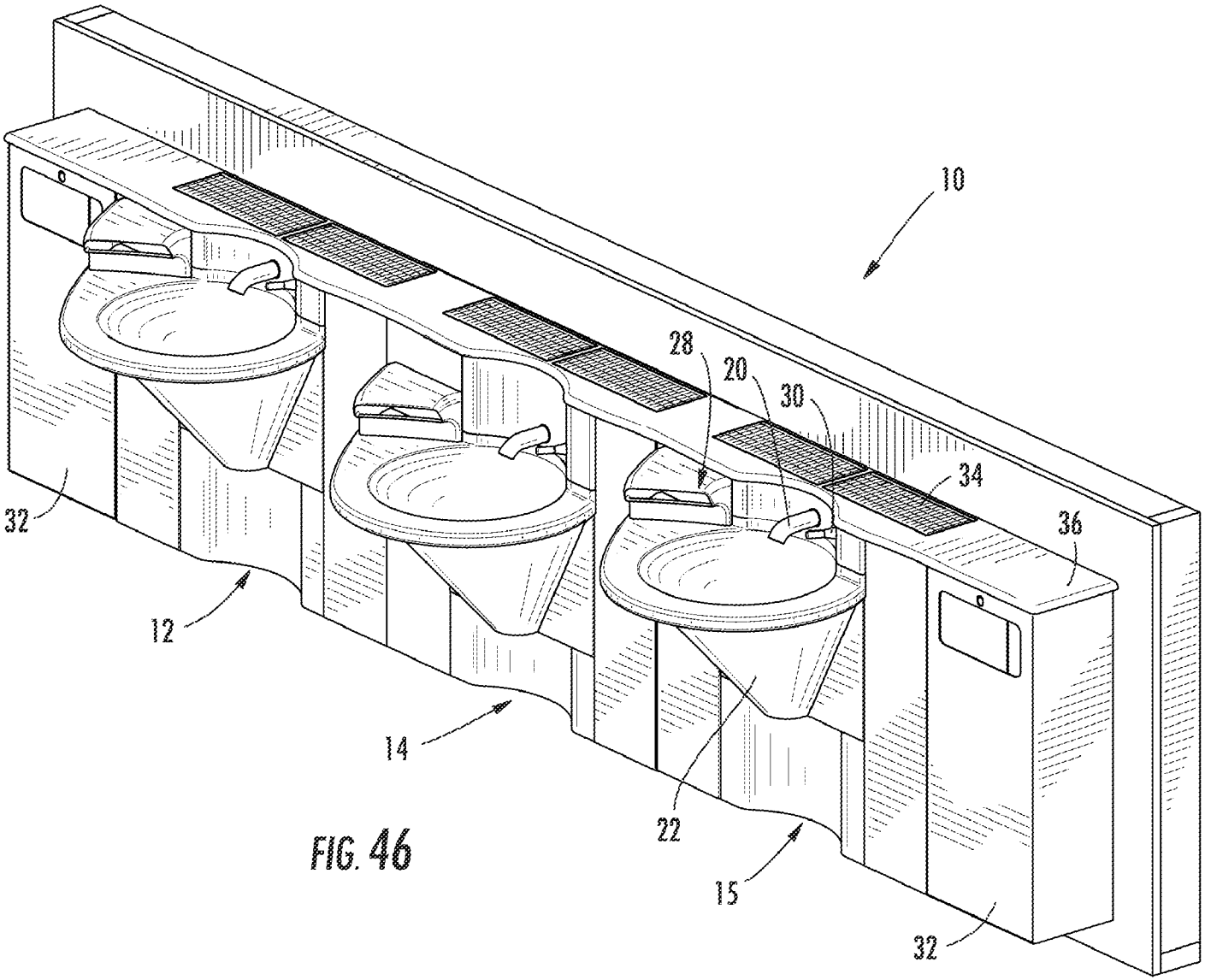
FIG. 46 is a front perspective view of a lavatory system according to an exemplary embodiment.
Figure 47:
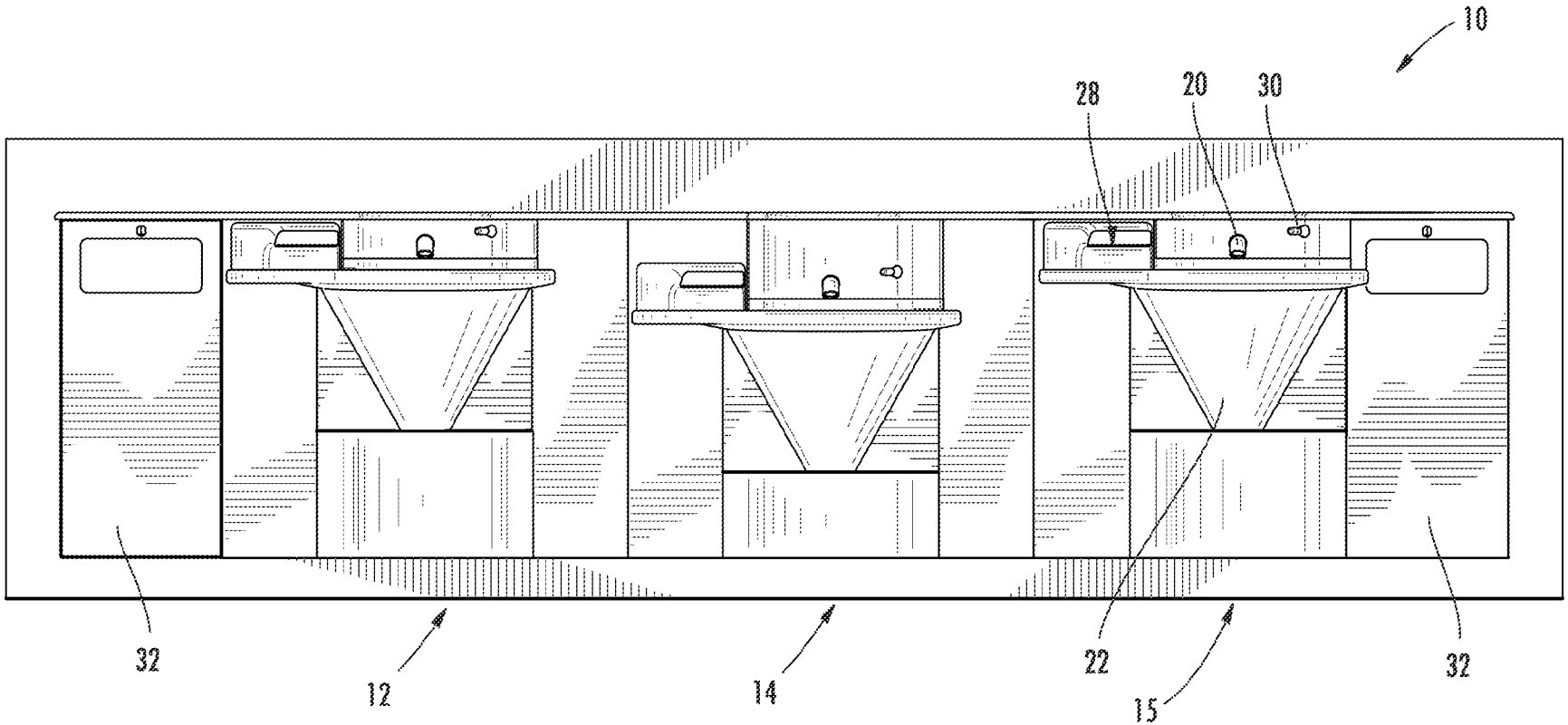
FIG. 47 is a front side view of the lavatory system of FIG. 46.
Figure 48:
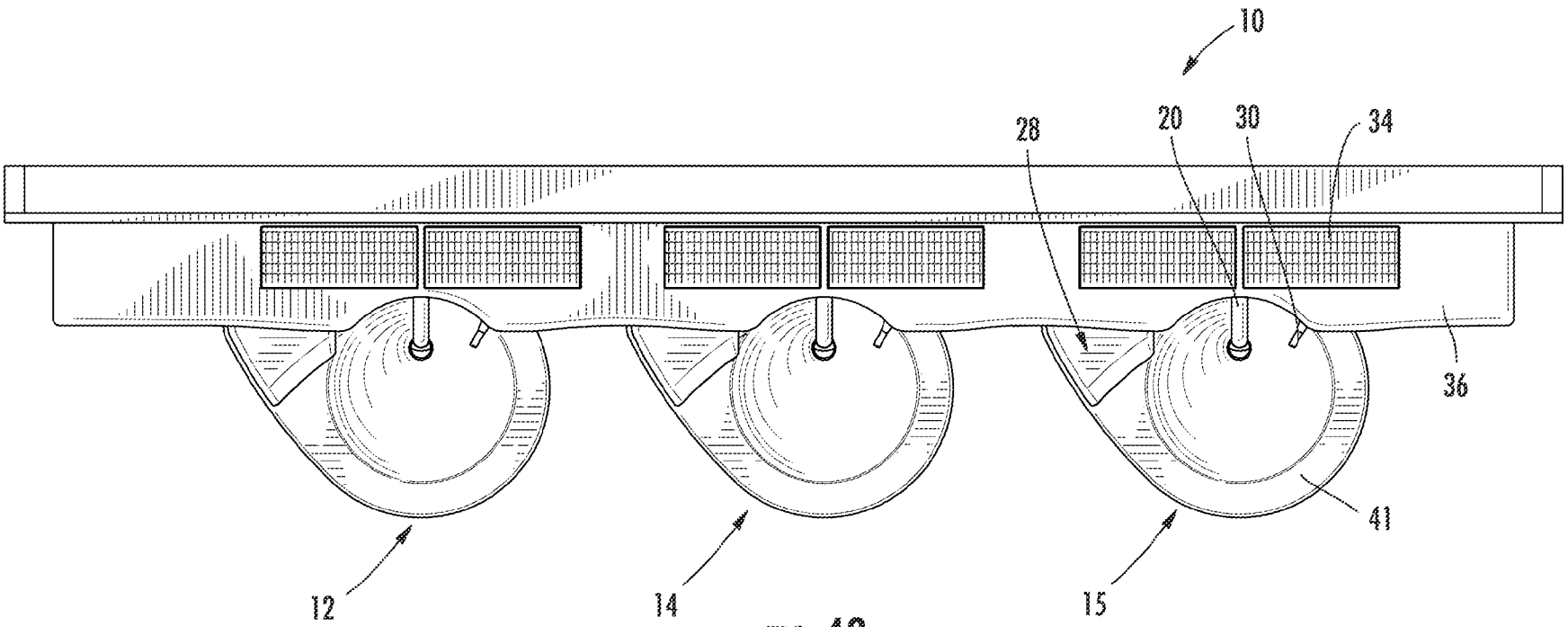
FIG. 48 is a top view of the lavatory system of FIG. 46.
Figure 49:
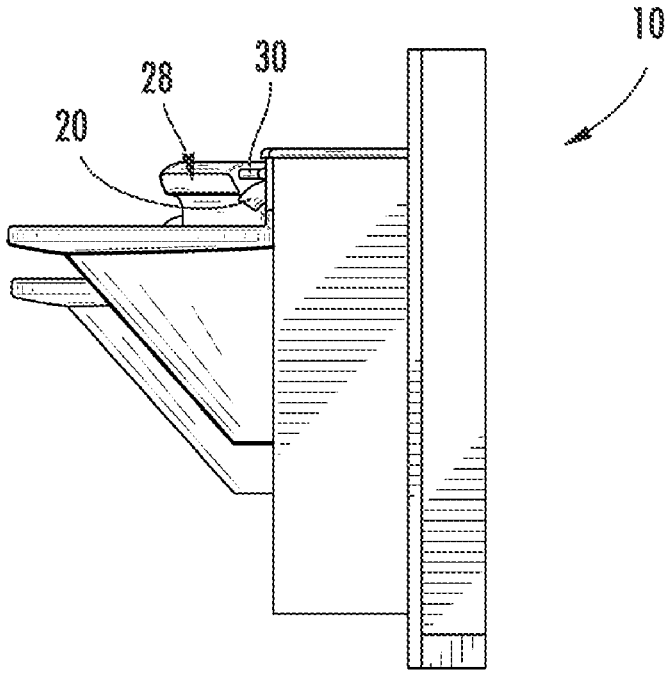
FIG. 49 is a right side view of the lavatory system of FIG. 46.
Figure 50:
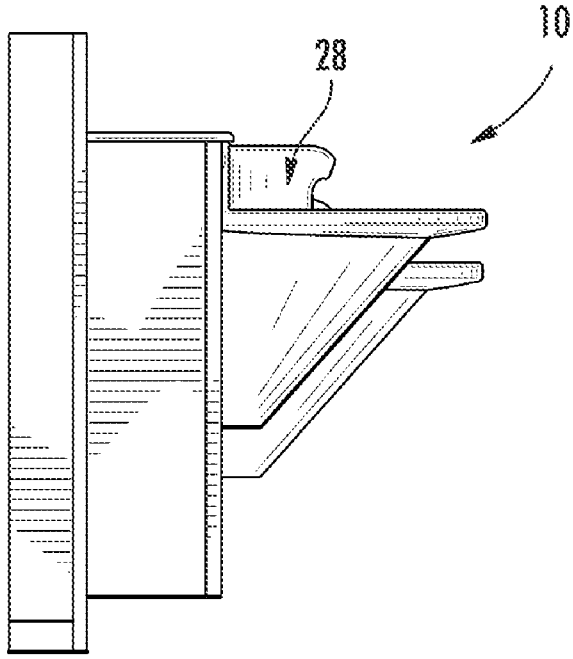
FIG. 50 is a left side view of the lavatory system of FIG. 46.

According to the embodiment illustrated, lavatory system 10 includes two washing stations (e.g., hand washing stations), shown as a first or upper station 12 and a second or lower station 14, mounted to a base (e.g., housing, cabinet, etc.). Alternatively, the lavatory system may include any number of washing stations (e.g., one, three, four, or more) arranged in any of a variety of configurations (e.g., all upper stations, all lower stations, mixed upper/lower stations, etc. set at a variety of upper/lower patterns, heights ("H" in FIG. 39), or sequences). Each hand washing station generally includes a sink 16 (e.g., bowl, basin, receptacle, etc.), a backsplash 18 at least partially surrounding each sink 16, hand washing fixtures 20 (e.g., faucet, soap dispenser, etc.) associated with each sink 16, a trap cover 22 supported under the sink for at least partially concealing plumbing (e.g., water supply, drain, etc. as shown in FIG. 9) associated with the station, a hand drying fixture (e.g., electric hand dryer, towel dispenser, etc.), shown as hand dryer 28, and a liquid soap dispenser 30. As shown in FIG. 1, hand dryer 28 includes a nozzle or air outlet 39 to direct air onto a user's hands to aid in drying. Lavatory system 10 may also include a hook 17 to allow the user of the lavatory system to hang a personal item (e.g., purse, coat, hat, backpack, etc.) so that the user's hands are free for hand washing, drying, etc.

Upper station 12 and lower station 14 may be configured to have different heights to accommodate persons having varying abilities or characteristics for using a lavatory system (e.g., disabled, tall, short, etc.). In one embodiment, upper station 12 has a height (e.g., the distance from the floor to the upper surface of the counter surrounding the basin) that is greater than 34 inches (e.g., about 36 inches) and lower station 14 has a height that is about 34 inches to accommodate an adult user in a wheelchair. In another embodiment, lower station 14 has a height that is about 31 inches to accommodate a juvenile user in a wheelchair. In another embodiment, lower station 14 has a height that is less than 31 inches (e.g., about 28 inches). In another embodiment, upper station 12 has a height that is about 34 inches, and lower station 14 has a height that is about 31 inches. In other embodiments, lavatory system 10 may include any number of hand washing stations (e.g., 3, 4, 5, etc.), each hand washing station located at one of the heights discussed above.

The embodiment illustrated further includes a housing 31. Housing 31 includes a shelf or platform (shown as a panel 36) located above the other components of the washing stations, a front portion 33, and side portions 35. Housing 31 generally defines an interior portion 37 of lavatory system 10 (shown in FIGS. 4 and 9). Lavatory system 10 further includes a waste receptacle 32 adjacent to upper station 12, a plurality of photovoltaic cells 34 mounted on panel 36, a power management system, and a towel dispenser 38.

Preferably, the one or more of the fixtures are "touchless", meaning that a user can operate the fixtures without physically contacting the fixtures and/or an interface coupled to the fixtures (i.e., "hands-free" operation). In this manner, the lavatory system is intended to overcome sanitation and/or accessibility limitations often associated with many conventional fixtures. The control system monitors a defined sensing region (an area adequately proximate to the fixtures in which a user of the fixture is likely to be positioned) for the presence of an object (e.g., a user, the user's hand, etc.) and controls the operation of the fixtures accordingly. The control system includes a power supply system, a detection system, and a fixture actuation system. In one embodiment, each washing station includes one or more sensors 29 (rear portion of one sensor 29 is shown in FIG. 9) that allows the user to activate one or more fixture (e.g., hand washing fixture 20, hand dryer 28, and/or soap dispenser 30) without touching any part of lavatory system 10 (i.e., sensor 29 provides for "hands free" operation of various portions of lavatory system 10). In one embodiment, each hand washing station includes a single sensor 29 configured to allow the user to operate all of the fixtures located at a single hand washing station. In another embodiment, each hand washing station includes a dedicated sensor 29 for each fixture associated with the sensor (e.g., a first sensor for hand washing fixture 20, a second sensor for hand dryer 28, and a third sensor for soap dispenser 30). Sensor 29 may be any device that allows for hand free operation of one or more fixtures. For example, sensors 29 may be infrared sensors, capacitive sensors, proximity sensors, or the like.

According to an exemplary embodiment, the lavatory system 10 is configured to inhibit or prevent inadvertent activation of one or more fixtures (e.g., faucets 20, soap dispensers 30, hand dryers 28, etc.). According to an exemplary embodiment, lavatory system 10 includes a control system to control the operation and activation of the various fixtures (e.g., faucets 20, soap dispensers 30, hand dryers 28, etc.) via user interaction with sensors 29. Since the fixtures are integrated and located around basin 16 at each wash station, it is preferred that the fixtures are not inadvertently activated during use of other fixtures. The control system includes one or more sensors 29, as discussed above, in communication with a control circuit (e.g., controller, processor, etc.), which is in communication with the fixtures. The control circuit may be configured (e.g., hardwired, programmed, etc.) to allow activation of only one fixture at a time, allow activation of certain two fixtures at a time (e.g., faucet and soap dispenser), or sequence the fixture activation at predetermined or calculated times and intervals. In addition, the control circuit may be configured to turn off one or more of the fixtures (e.g., the faucet and/or the soap dispenser) when another of the fixtures is activated (e.g., the hand dryer). For example, a flow sensor that detects the flow of water through faucet 20 can be used to disconnect the power from hand dryer 28. Alternatively, the sensor 29 associated with hand dryer 28 communicates with the faucet sensor using signals through optoisolators to activate and deactivate hand dryer 28. This communication may allow the control circuit to prevent the activation of faucet 20 and/or soap dispenser 30 when hand dryer 28 has been activated. Alternatively, there is no control interaction among the fixtures (i.e., independent operation). The sensors may be directed to provide a sensed area or zone that does not overlap with the sensed zones for other fixtures.

Figure 51B:
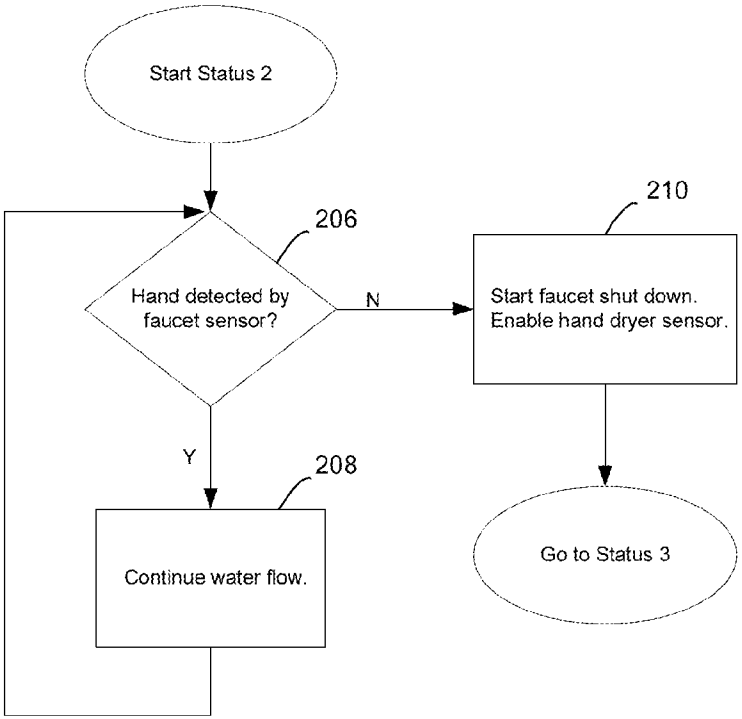
FIGS. 51A-51C are flow diagrams for a process of controlling a lavatory system according to an exemplary embodiment.
Figure 51A:
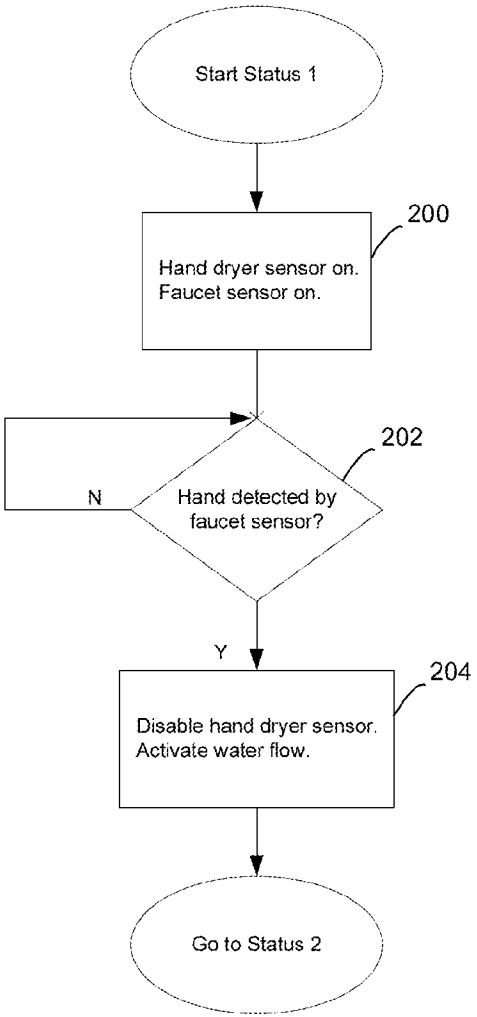
Figure 51C:
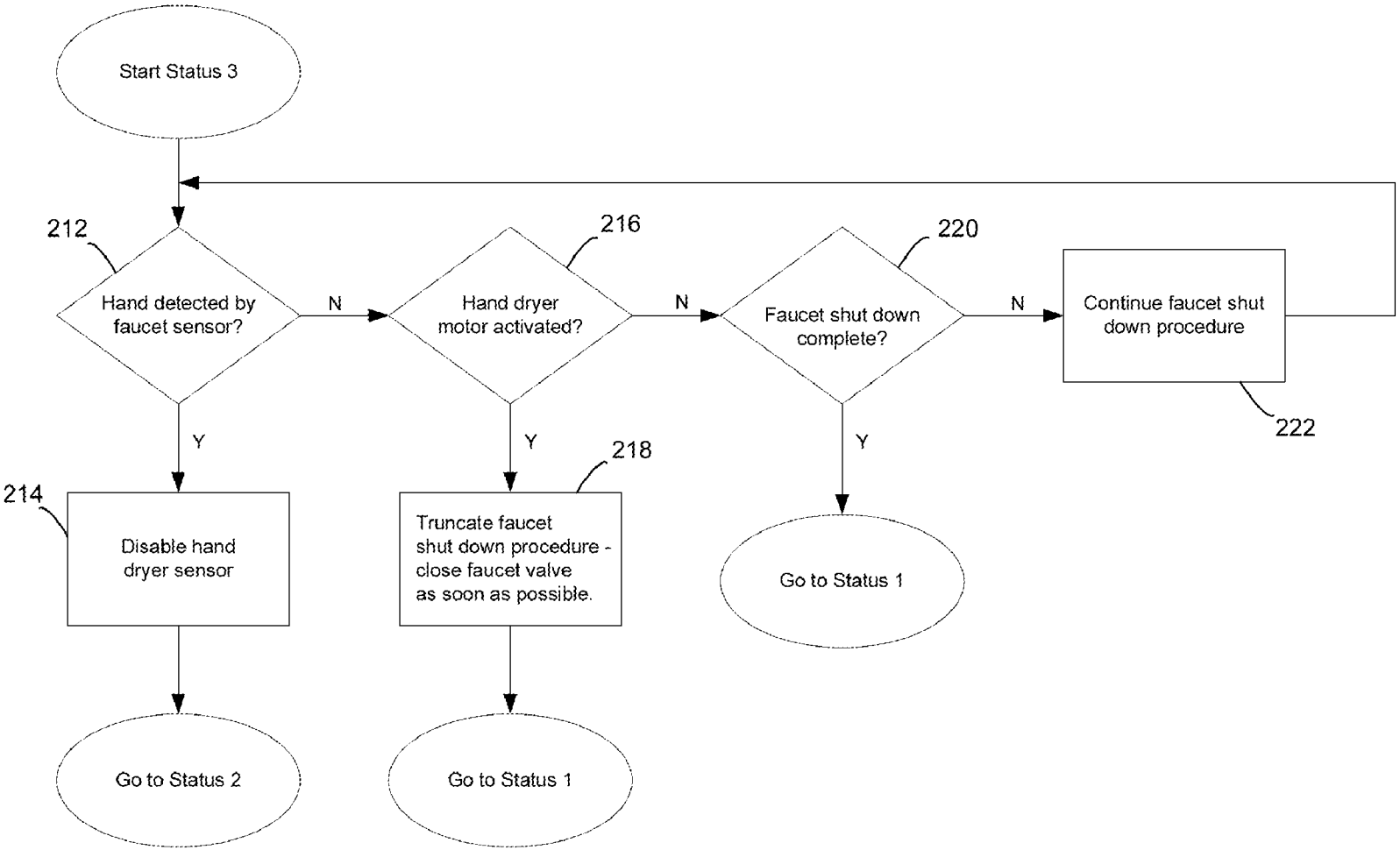

FIGS. 51A-51C are flow charts showing the control of a faucet 20 and a hand dryer 28 by a control system according to an exemplary embodiment. Referring to FIG. 51A, at step 200 a sensor 29 associated with hand dryer 28 is turned on and a sensor 29 associated with faucet 20 (i.e., a faucet sensor) is turned on. At step 202, the control system receives an input signal from the faucet sensor to detect the presence of a user's hand near faucet 20. If the signal received from the faucet sensor indicates that a user's hand is not near faucet 20, step 202 repeats until the signal received from the faucet sensor indicates that a user's hand is present near faucet 20. In one embodiment, during step 202 the control system tests for the presence of a user's hand every 0.25 seconds. At step 204, the control system disables the sensor 29 associated with hand dryer 28 and activates the flow of water through faucet 20 when the signal received from the faucet sensor indicates that a user's hand is present near faucet 20.

Referring to FIG. 51B, after step 204 is performed, the control system proceeds to perform step 206. At step 206, the control system continues to receive a signal from the faucet sensor. If the signal from the faucet sensor continues to indicate the presence of a user's hands near faucet 20, the control system continues to allow water to flow from faucet 20 during step 208. If the signal from the faucet sensor indicates the user's hands are no longer near faucet 20, the control system begins a shutdown (e.g., a timeout) procedure at step 210 to stop water from flowing through faucet 20 by the end of the shutdown procedure. Also during step 210, the control system enables (e.g., turns on) the sensor 29 associated with hand dryer 28. In one embodiment, the control system performs step 210 if the faucet sensor fails to detect the presence of a user's hands for more than 0.5 seconds FIG. 51C is a flow chart showing operation of the control system during the faucet shutdown procedure initiated at step 210. At step 212, the control system receives a signal from the faucet sensor to detect the presence of a user's hand near faucet 20. If the signal received from the faucet sensor indicates that a user's hand is present near faucet 20, at step 214 the control system disables the sensor 29 associated with hand dryer 28 and returns to step 206 shown in FIG. 51B. This allows the control system to end the shutdown procedure that was initiated during step 210 to allow water to continue to flow from faucet 20. If during step 212, the signal received from the faucet sensor indicates that a user's hand is not near faucet 20, step 216 is performed.

At step 216, the control system determines if the motor of hand dryer 28 is active. In one embodiment, the motor of hand dryer 28 may be activated by the sensor 29 associated with hand dryer 28 detecting the presence of a user's hand near hand dryer 28. In another embodiment, the motor of hand dryer 28 may be activated by other means such as by manual activation by a user via a switch or button. If, during step 216, the control system determines that the motor of hand dryer 28 is active, the control system proceeds to step 218. During step 218, the control system closes the valve associated with faucet 20 to stop water from flowing through faucet 20 as quickly as possible. Thus, during step 218, the faucet shutdown procedure initiated during step 210 is truncated or shortened when the user of lavatory system 10 switches from using faucet 20 to using hand dryer 28. However, if during step 216, the control system determines that the motor of hand dryer 28 is not active, the control system proceeds to step 220. At step 220, the control system detects whether the faucet shutdown procedure is complete. If the faucet shutdown procedure is complete, the control system returns to step 200. If the faucet shutdown procedure is not complete, at step 222 the faucet shutdown procedure is continued by returning to step 212. Steps 212 through 222 are repeated until faucet shutdown is complete.

According to an exemplary embodiment, the lavatory system includes one or more integrated hand washing stations. Each hand washing station includes a basin, a faucet, a solenoid valve configured to control water flow to the faucet, and a electric hand dryer located adjacent the basin and the faucet so that the user of the washing station may use the faucet and the electric hand dryer without leaving the washing station. The electric hand dryers include an outlet to direct air across the associated basin so that any water that drips from the user's hands will fall within the basin. The system further includes a control system configured to control activation of the solenoid valve and the electric hand dryer, wherein the control system is configured to inhibit simultaneous activation of the solenoid valve and the hand dryer. For example, the control system may be configured to prevent activation of the electric hand dryer when the solenoid valve has been activated; prevent activation of a soap dispenser when the solenoid valve and/or the hand dryer has been activated. The activation of the various fixtures may be according to a predetermined timing and sequence (e.g., an algorithm that activates fixtures based on sensed conditions or other factors). The control system may be in communication with a single sensor dedicated (directed) to each wash station that is configured to sense the presence of the user's hands near the hand washing station. Alternatively, each wash station may include a sensor to detect the presence of a hand of the user proximate that station's faucet, another sensor to detect the user's hand proximate that station's soap dispenser, and/or another sensor to detect the presence of a hand of the user proximate that station's electric hand dryer, wherein the control system activates the solenoid valve and the hand dryer based on signals received from the first sensor and second sensor according to a predetermined timing and sequence.

Referring further to FIGS. 1-4, tower dispenser 38 is shown mounted between two hand washing stations 12, 14. Towel dispenser 38 includes a housing 40, an access panel 42 (e.g., door), an upper surface or shelf 44, and a lower surface or shelf 46.

Housing 40 has generally vertical sides 48, an angled front panel or front side 50 and is configured to contain a paper towel roll 52 being dispensed as well as additional storage for extra paper towel rolls 54 or other supplies. Angled front side 50 has a top portion that extends further from wall 11 than the bottom portion of front side 50. Angled front side 50 is intended to provide an aesthetic appearance consistent with other design aspects of lavatory system 10 as well as additional clearance for users in wheelchairs or having other needs. Access panel 42 allows access (visual and/or physical) to the interior of towel dispenser 38, and is coupled to the housing by a hinge 56 and a lock 58.

Figure 4:
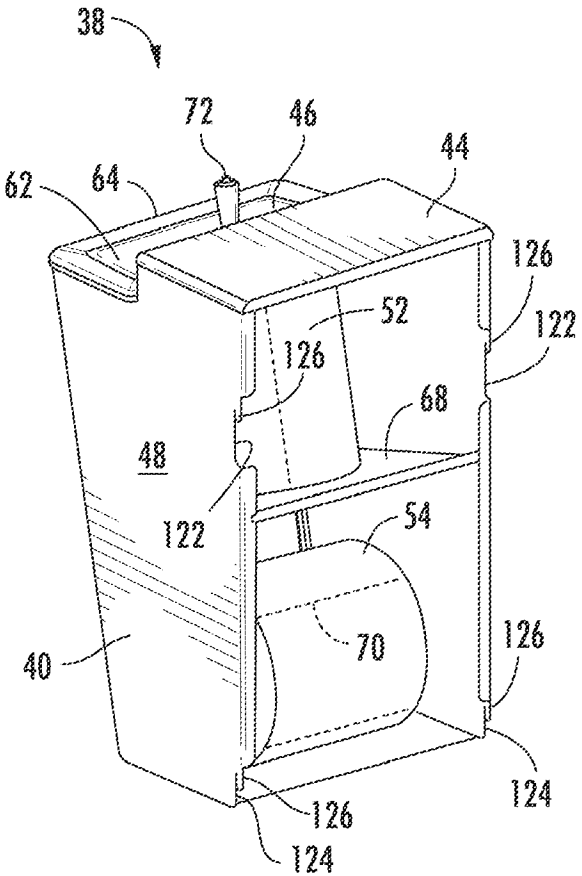
FIG. 4 is a rear perspective view of the towel dispenser of the lavatory system of FIG. 1.
Figure 3:
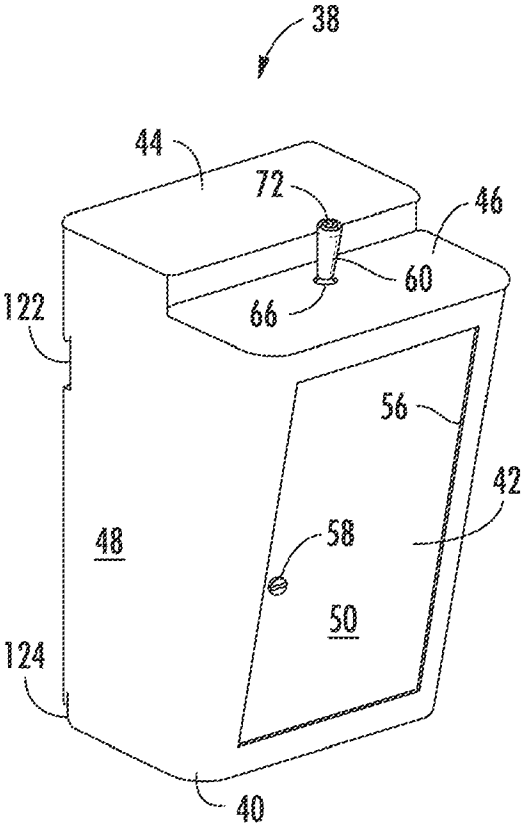
FIG. 3 is a front perspective view of a towel dispenser according to another embodiment.
Figure 2:
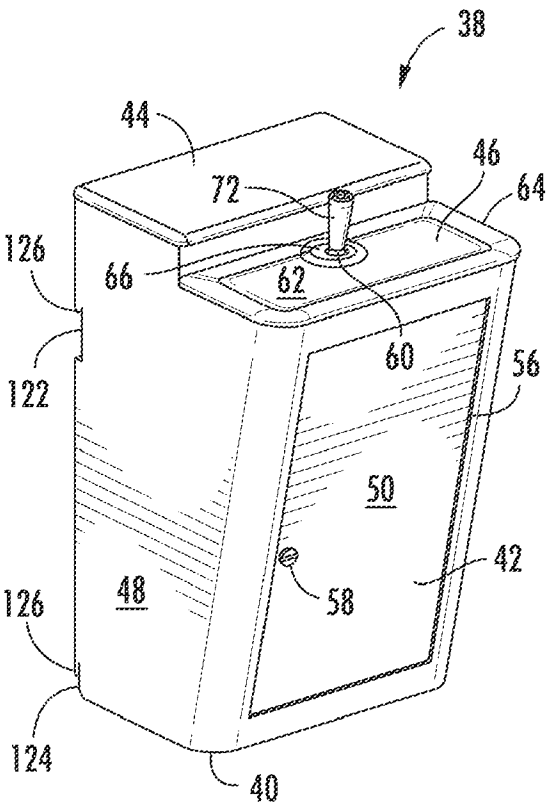
FIG. 2 is a front perspective view of the towel dispenser of the lavatory system of FIG. 1.
Figure 5:
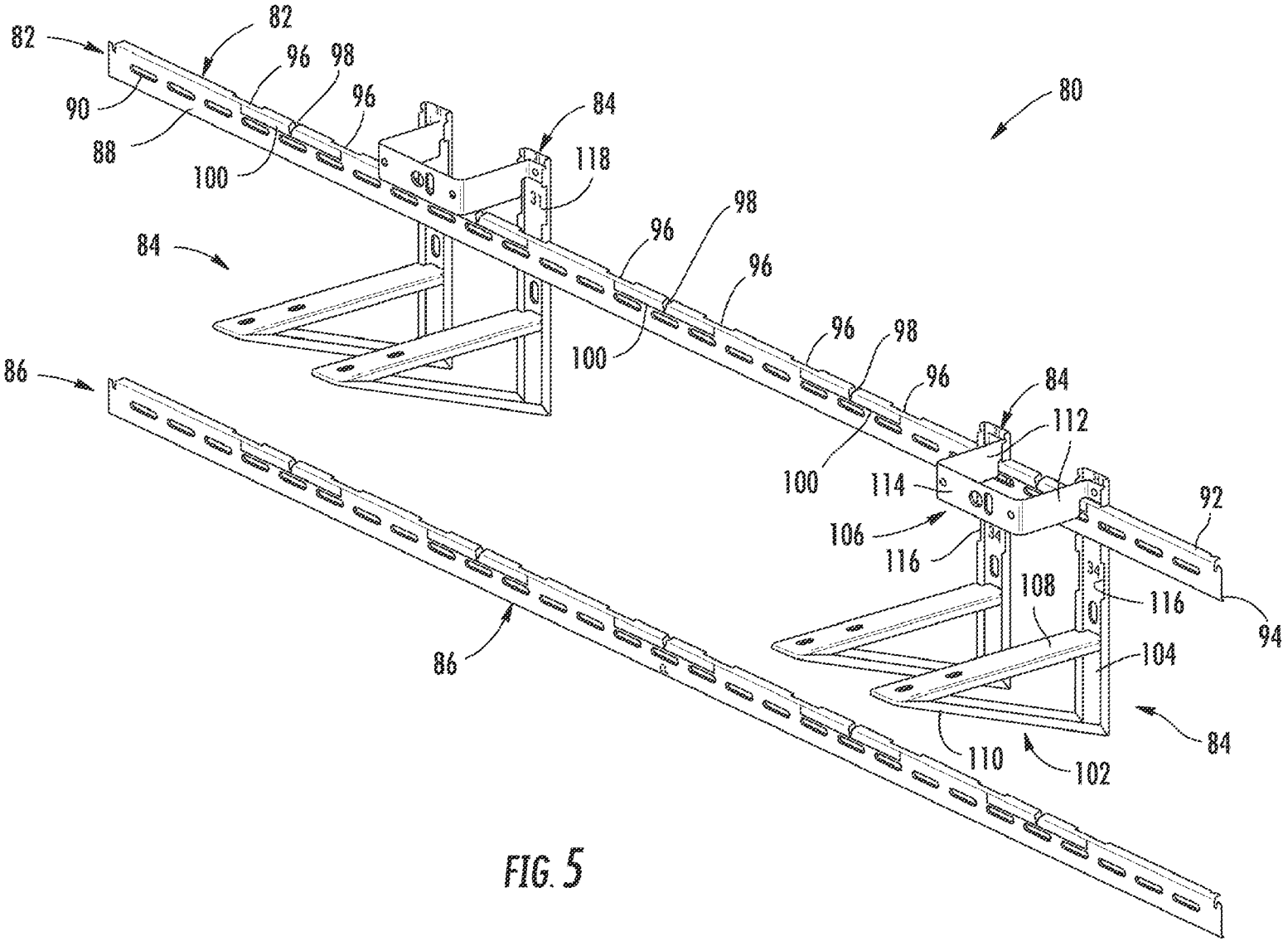
FIG. 5 is a front perspective view of a mounting system for use with the lavatory system of FIG. 1 according to an exemplary embodiment.
Figure 6:
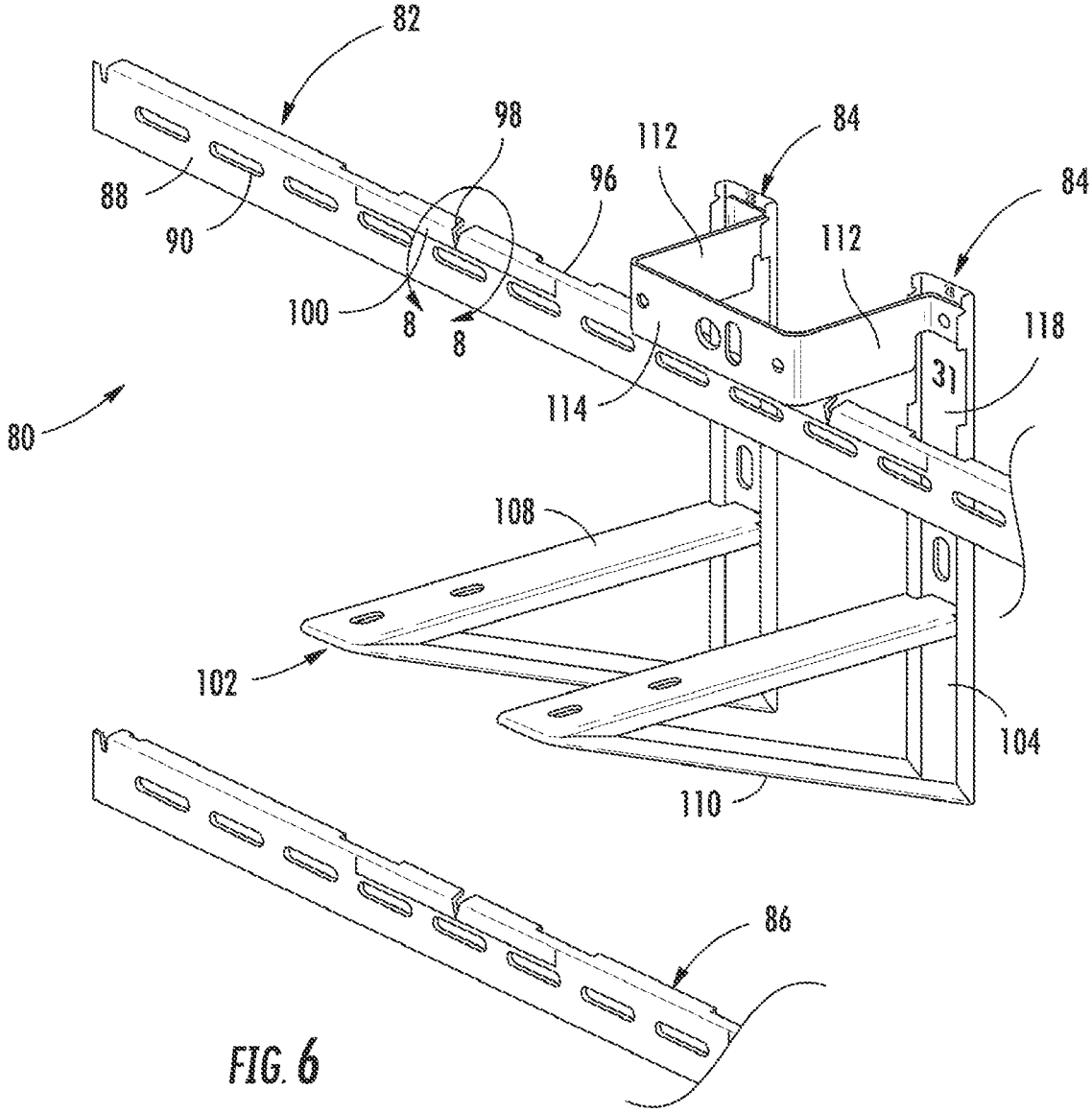
FIG. 6 is a close up front perspective view of a portion of the mounting system shown in FIG. 5.

Upper shelf 44 may be a generally horizontal panel facing in a generally upward direction, as shown in FIGS. 2 through 4, generally extending the entire width of towel dispenser 38 if the dispenser is used individually/separately from the lavatory system 10. Alternatively, upper shelf 44 may be provided by a generally horizontal shelf or platform that extends across multiple fixtures (e.g., waist receptacle, one or more hand washing stations, and the towel dispenser).

Lower shelf 46 may be a generally horizontal panel facing in a generally upward direction. Lower shelf 46 includes an opening 60 through which paper towel is dispensed to be accessed by the user of lavatory system 10. According to an exemplary embodiment, lower shelf 46 is formed with a recess 62 where outer peripheral edge 64 is vertically above the bottom surface of recess 62. Opening 60 for the paper towel is defined by a flange or rim 66 that extends upward from and above the bottom surface of recess 62. Water that drips off a user's hands is then retained in recess 62 and allowed to evaporated to prevent water from accumulating on floor 13 or from wetting the unused paper towels.

Roll of paper towel 52 is supported on a panel or shelf 68 located within housing 40. Roll of paper towels 52, 54 may be comprised of a plurality of sheets or sections separated by perforations 70 or other means to demark separate sheets. An end 72 of paper towel roll 52 (i.e., the next sheet to be used) extends or projects upwardly through opening 60 (e.g., aperture, hole, etc.) in lower shelf 46 and is presented to the user. Roll of paper towel 52 dispenses in a generally vertical direction. The user grasps end portion 72 extending from dispenser 38, pulls in a vertical direction and/or a non-vertical direction (e.g., horizontally, diagonally, etc.). The sheet being grasped by the user separates at perforation 70, leaving another end portion extending from dispenser 38 as before.

Referring to FIGS. 5 through 8, a mounting system 80 for lavatory system 10 is shown. Mounting system 80 is intended to provide easy and accurate installations of the lavatory system (i.e., hand washing stations 12, 14, waste receptacle 32 (if used), and towel dispenser 38 (if used), and other components). Mounting system 80 includes an upper (mounting) track 82, one or more mounting frames 84 (basin frame), and a lower (mounting) track 86. Upper track 82 is configured to engage mounting frame 84 a plurality of different positions allowing the basins or other fixtures to be mounted at a plurality of different heights.

Upper track 82 is an elongated U-shaped member (e.g., channel). Middle portion 88 of the U-shaped member includes a plurality of spaced-apart slots 90. The plurality of slots 90 are configured to provide a variety of locations to mount lavatory system 10 to wall 11 (i.e., fasteners able to engage building structure such as "studs" without limiting the relative position of the overall lavatory system relative to the studs). Upper leg 92 and lower leg 94 of the U-shaped member includes a plurality of notches or recesses 96 grouped together in pairs located along the longitudinal axis of upper track 82. Located within each pair of recesses 96 is a V-shaped centerline notch 98 located mid-way between the associated recesses 96. Preferably, there is an indicia 100 identifying the associated pair of recess 96 (e.g., location marker for the basin frame). Such indicia may be a groove on the outer surface (e.g., etched, lasered, machined, etc.).

Mounting frame 84 couples to upper track 82 and is configured to support one or more hand washing stations (e.g., sink, trap cover, backsplash, etc.), waste receptacles, towel dispensers, top shelf, cabinets, outer housings (e.g., "skin", shell, etc.), or other fixtures or modules provided with lavatory system 10. Mounting frame 84 includes a pair of basin supports 102 (e.g., members, brackets, etc.), a pair of vertical members 104 (e.g., tracks, channels, members, etc.), and a backsplash support member 106 connecting vertical members 104. Basin support 102 includes a horizontal member 108 extending from one of the vertical members 104, and an angled member 110 extending from a lower portion of the vertical member 104 and coupled to the horizontal member 108 (i.e., to form a right triangle). Backsplash support 106 is generally a horizontally-orientated U-shaped bracket with outer legs 112 coupled to the respective vertical members (e.g., with fasteners, welding, etc.). Middle portion 114 of the U-shaped bracket includes one or more apertures to receive fasteners for coupling to backsplash 18. Vertical members 104 include a plurality of spaced apart recesses 116 configured to engage (e.g., mate, fit, register, etc.) with recesses 96 on upper track 82. Vertical members 104 have indicia 118 indicating which recesses 96 to use for the desired height H of the basin (e.g., 28 inches, 31 inches, or 34 inches) associated with the ADA regulatory requirements.

Lower track 86 is an elongated U-shaped member (e.g., channel). The middle portion of the U-shaped member includes a plurality of spaced-apart slots. According to a preferred embodiment, the lower track is identical to the upper track. To minimize individual parts/components.

Figure 8:
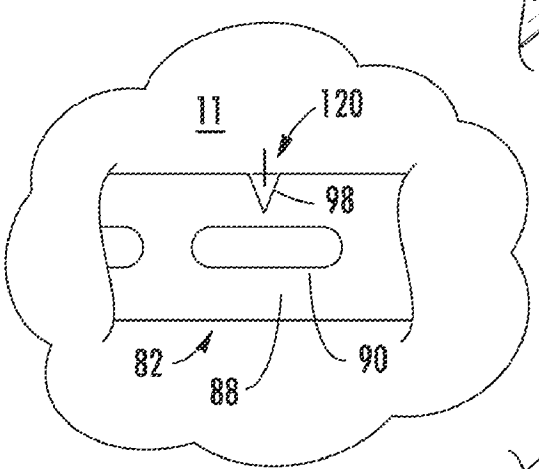
FIG. 8 is a close up front view of a portion of the upper track of the mounting system of FIG. 5.
Figure 52:
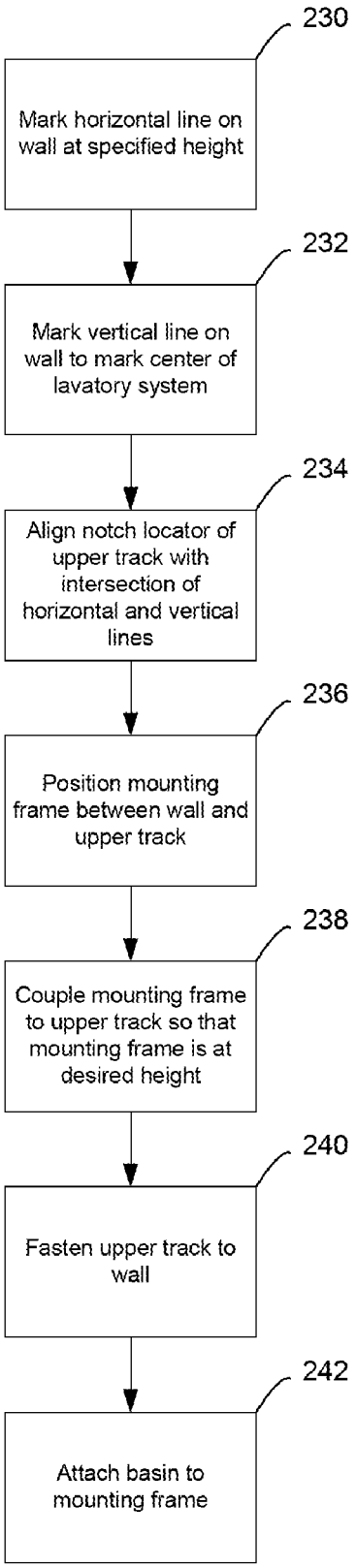
FIG. 52 is a flow diagram for a process of assembling and mounting a lavatory system according to an exemplary embodiment.

FIG. 52 is a flow diagram of a process of assembling and mounting a lavatory system according to an exemplary embodiment. At step 230, the installer marks a horizontal line on wall 11 at a specified height above floor 13 (e.g., 33 inches), and at step 232, the installer marks a vertical line on wall 11 representative of the desired centerline of lavatory system 10. At step 234, upper track 82 is placed on wall 11 so that intersection 120 of the horizontal line and the vertical line are located within the V-shaped centerline notch 98 locator on upper track 82. The alignment of intersection 120 within the V-shaped centerline notch 98 locator on upper track 82 is shown in FIG. 8. In one embodiment, fasteners (e.g., screws, bolts, nails, pins, etc.) are inserted through the slots in upper track 82 to engage building structure (e.g., "studs"). Before tightening the fasteners, at step 236, mounting frames 84 are slid between the upper track 82 and the wall 11, and at step 238, mounting frames 84 are coupled to upper track 82 by engaging recesses 116 on vertical members 104 with the recesses 96 on upper track 82 to fix mounting frames 84 at a plurality of different position (e.g., first position, second position, etc.) each resulting in a different height H of basin 16. At step 240, the fasteners are further tightened to "lock" mounting frames 84 to upper track 82 and to fasten both to wall 11. At step 242, basins 16 are coupled or attached to mounting frames 84.

Other fixtures, accessories, modules, and the like may also be attached to the upper track and lower track. For example, towel dispenser 38 shown in FIGS. 1-4 includes upper and lower recesses 122, 124 and hooks 126 that engage upper track 82 and lower track 86.

Figure 7:
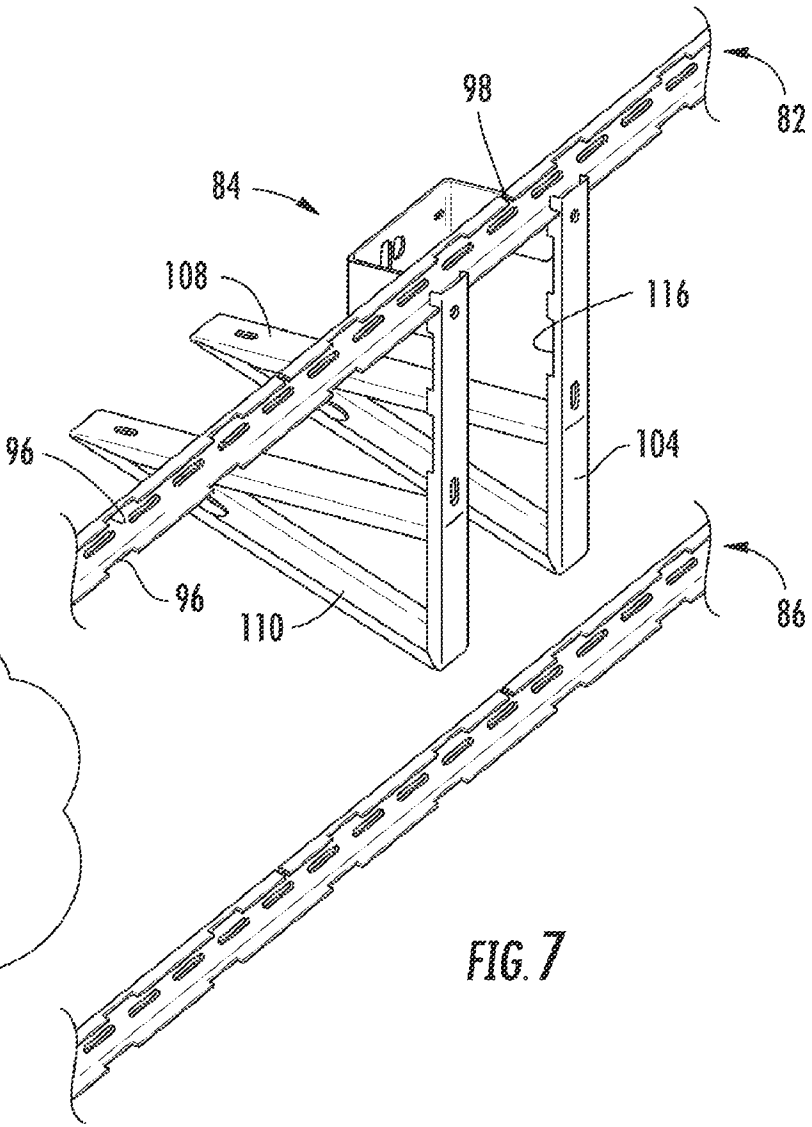
FIG. 7 is a rear perspective view of the portion of the mounting system shown in FIG. 6.

Because upper track 82 is attached to wall 11 or to other support structures at a predetermined height above floor 13, mounting frames 84 may then be coupled to upper track 82 at any of a variety of prescribed locations or positions depending on the heights H desired for basins 16. As shown in FIG. 7, when mounting sink 16 at the lower most position (e.g., 28 inches), the top end of vertical members 104 engage lower leg 94 of the U-shaped member.

FIG. 9 shows a rear perspective view of lavatory system 10 (without the wall obscuring the internal components) to further illustrate the mounting, coupling, and arrangement of internal components within interior portion 37 of lavatory system 10. Various items (e.g., liquid soap containers, paper towels, wiring, plumbing, etc.) may be located within interior portion 37. As shown in FIG. 9, two liquid soap containers 21 are located within interior portion 37 of lavatory system 10. A tube 23 is coupled between each liquid soap container 21 and each soap dispenser 30 to allow soap to flow from liquid soap containers 21 to the output portion of each soap dispenser 30 to provide soap to the user of each wash station. Each faucet 20 is in fluid communication with a cold water pipe 25 and a hot water pipe 26. In one embodiment, water from cold water pipe 25 and hot water pipe 26 are mixed by a device or valve (e.g., a solenoid valve) prior delivering water through faucet 20 to the user of the wash station. Each basin 16 of each wash station may be in fluid communication with a drain pipe 27 to allow water collected in each basin 16 during use of the wash station to drain away. As shown in FIG. 9, hand dryer 28 includes a heating and air circulation device, shown as motor 78, and a duct or conduit 79. Conduit 79 is coupled between motor 78 and nozzle 39. Motor 78 may include a fan or other suitable device to move air through conduit 79 and out of nozzle 39 to allow the moving air to dry the hands of the user of the hand washing station. Hand dryer 28 may also include one or more heating element to heat the air moved by motor 78.

Outer housing 31 generally prevents access to interior portion 37 of lavatory system 10 and to the various portions of lavatory system 10 located within interior portion 37. However, certain components of lavatory system 10 may be configured to allow access to various portions of interior portion 37. For example, as discussed above, towel dispenser 38 includes a hinged access panel 42 to allow access to the portion of interior portion 37 defined by the housing of towel dispenser 38. Panel 36 is configured to articulate between opened and closed positions. As shown in FIG. 9, panel 36 may be coupled to a hinge member 130 configured to allow panel 36 to move from a closed position (shown in FIG. 9) to an open position (shown in FIG. 10B).

Figure 10A:
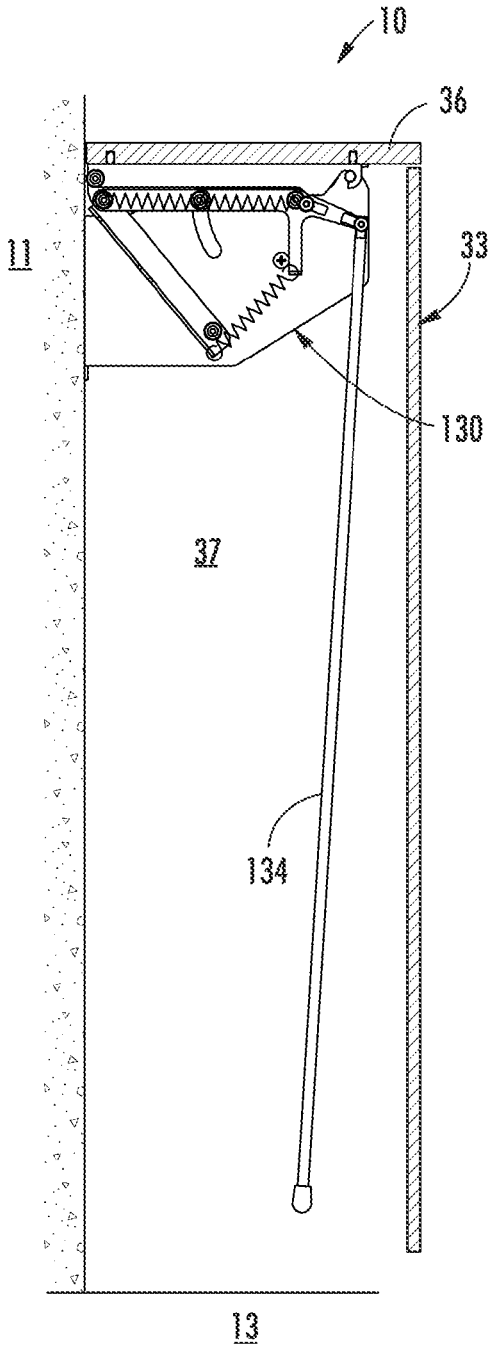
FIG. 10A is a sectional view of the lavatory system of FIG. 1 showing the shelf in a closed position.

FIGS. 10A-12 show cross-sectional views of lavatory system 10 taken along line X-X in FIGS. 1 and 9. As shown, lavatory system 10 includes a hinge member 130. As shown, panel 36 is coupled to hinge member 130. Hinge member 130 is also coupled to bracket 132. Bracket 132 provides support for panel 36 and for hinge member 130. As shown in FIGS. 10A and 10B, bracket 132 may be attached to wall 11. However, in other embodiments, bracket 132 is attached to and supported by one or more elements of lavatory system 10 (e.g., housing 31, internal support structures, etc.). Hinge member 130 is also coupled to a release mechanism, shown as rod 134, which extends downward toward floor 13 adjacent the inner side of housing front portion 33. As shown best in FIGS. 10A and 10B, front portion 33 does not extend completely to floor 13. The space between the lower edge of front portion 33 and floor 13 provides access to rod 134 from outside lavatory system 10 by reaching underneath front portion 33.

Figure 12:
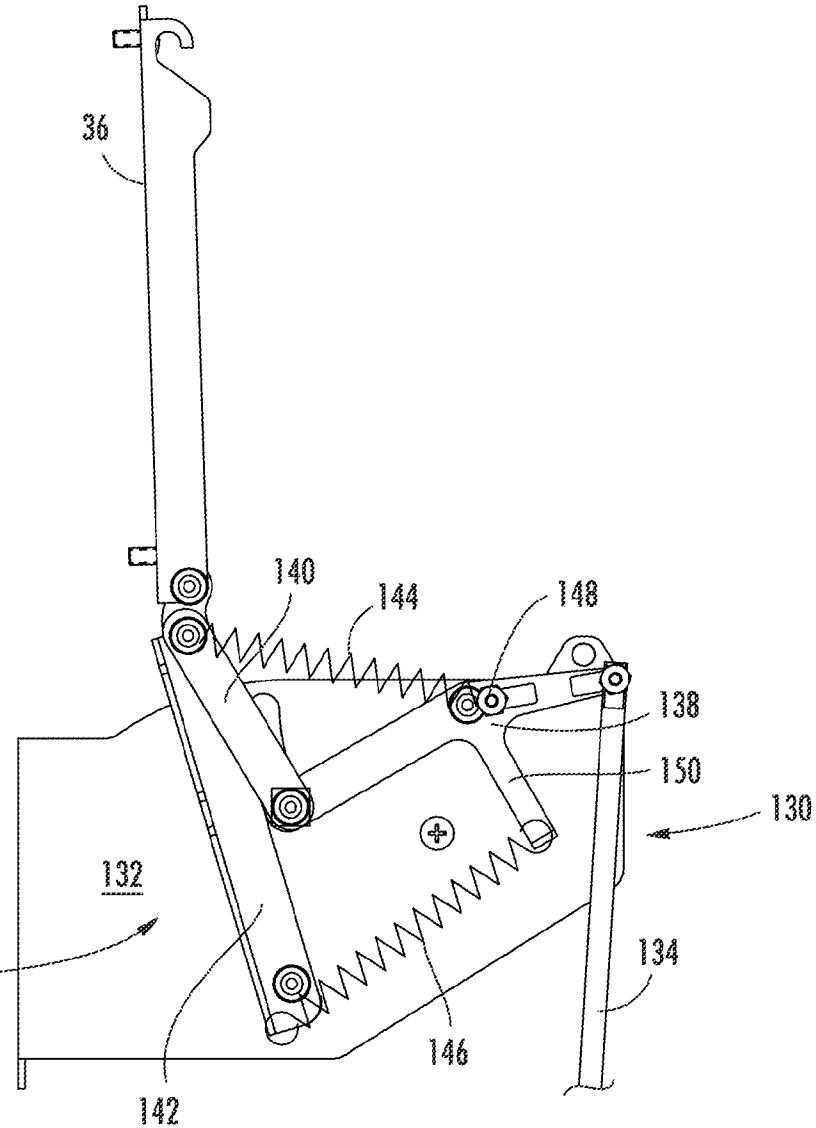
FIG. 12 is a close up sectional view of the shelf shown in FIG. 10B.
Figure 11:
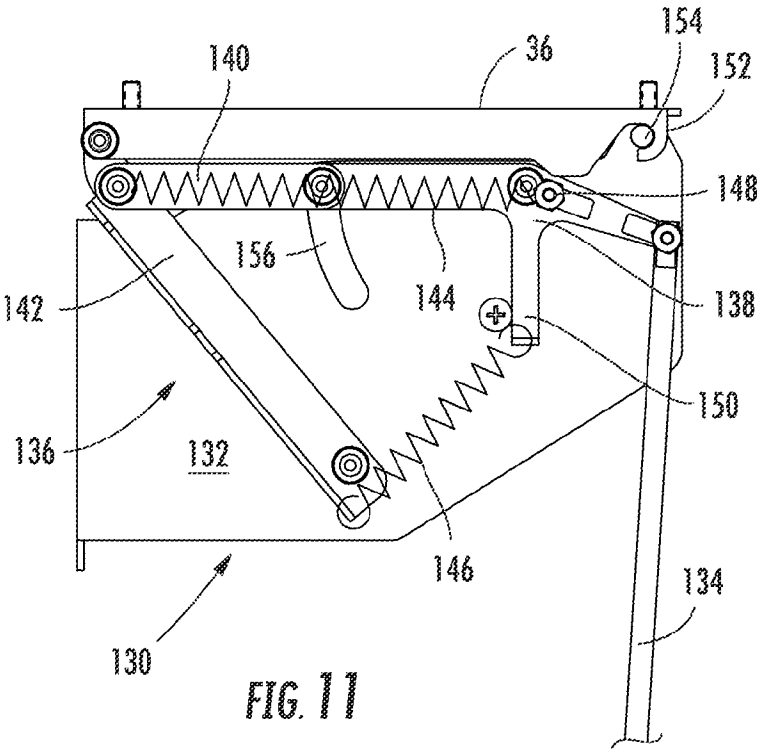
FIG. 11 is a close up sectional view of the shelf shown in FIG. 10A.

FIG. 11 and FIG. 12 show a close up view of hinge member 130 according to an exemplary embodiment. Rod 134 is connected at its upper end to linkage 136. Linkage 136 includes a first link 138, a second link 140, and a third link 142. First link 138 has a first end coupled to the upper end of rod 134. First link 138 has a second end coupled to a first end of second link 140. Second link 140 has a second end coupled to third link 142. Third link 142 has a first end coupled to panel 36. Each of the connections between elements of linkage 136 and between linkage 136 and panel 36 and rod 134 are pin joints that allow for rotation about an axis perpendicular to the pin joint. Linkage 136 also includes an arm 150 extending below and generally perpendicular to first link member 138.

Hinge member 130 includes a first spring 144 and a second spring 146. First spring 144 is connected between the pin joint joining second link 140 to third link 142 and a connection point 148. Second spring 146 is connected between the second end of third link 142 and the lower end of arm 150.

Referring to FIG. 11, panel 36 is shown in a first or closed position. In the closed position, a hook 152 extending from the lower side of panel 36 engages a cylindrical projection 154 extending from bracket 132. In the closed position, first spring 144 is biased such that it exerts an inwardly directed force, and second spring 146 is biased such that it exerts an outwardly directed force. Further, as shown in FIG. 10A, in the closed position, the front edge of panel 36 is substantially aligned with housing front portion 33, and the rear edge of panel 36 abuts wall 11. Thus, in the closed position, panel 36 prevents access to interior portion 37 of lavatory system 10 via the upper end of housing 31.

Figure 10B:
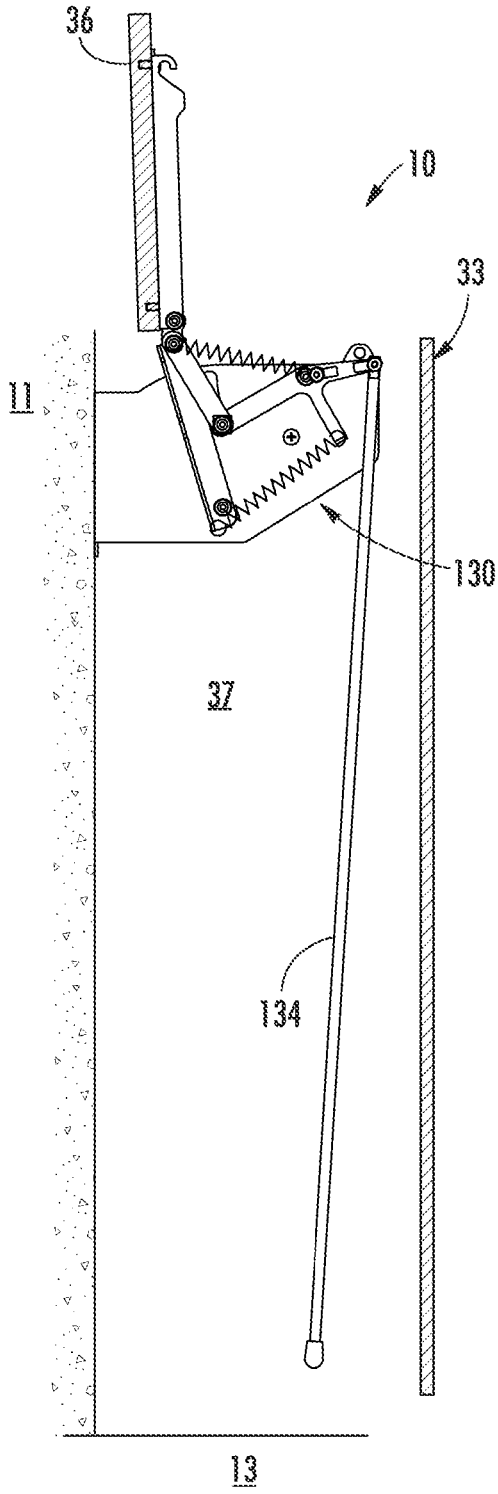
FIG. 10B is a sectional view of the lavatory system of FIG. 1 showing the shelf in an open position.

As shown in FIGS. 10A and 10B, rod 134 is accessible by the user from below a bottom portion of the housing or base. To move panel 36 from the closed position to the open position, an upwardly directed force is applied to rod 134 by reaching underneath housing front portion 33. The application of force to rod 134 cause the first end of first link 138 to move upward and the second end of first link 138 to move downward. Bracket 132 includes a slot 156 that allows the pin joint between first link 138 and second link 140 to move downward. As the second end of first link 138 to moves downward, second link 140 moves from the horizontal position shown in FIG. 11 to the angled position shown in FIG. 12.

In the closed position, first link 138 and second link 140 are in substantial axially alignment allowing first link 138 and second link 140 to resist the forces exerted by first spring 144 and second spring 146. The application of an upward force to rod 134 causes first link 138 and second link 140 to come out of axial alignment. This allows first spring 144 to contract and second spring 146 to expand. The contraction of first spring 144 and the expansion of second spring 146 cause hook member 152 to disengage cylindrical projection 154 and also moves panel 36 away from wall 11. With panel 36 moved away from wall 11 and with hook 152 disengaged from cylindrical projection 154, panel 36 may be rotated to the open position of FIG. 12.

With panel 36 in the open position, access to interior portion 37 is permitted via the upper end of housing 31. Access to interior portion 37 may be desirable for a variety of purposes, such as to repair wiring and plumbing, to replace or refill soap, paper towels, etc. To move panel 36 to the closed position, the process is reversed. In this embodiment, rod 134 is hidden from view from outside of lavatory system 10. Thus, only people who know the position of rod 134 will be likely to obtain access to interior portion 37. In addition, this limited access is achieved without the need for locks, keys, etc.

According to an exemplary embodiment, the faucets (e.g., valve, sensor, etc.) and soap dispensers (e.g., valve, sensor, etc.) are powered by a photovoltaic cell and a power management system such as disclosed in U.S. patent application Ser. No. 11/041,882 titled "Lavatory System" filed Jan. 21, 2005 is hereby incorporated herein by reference in its entirety. The hand dryers are powered by an AC power line. The electric hand dryers may be powered by the photovoltaic system as well (e.g., battery or other energy storage element that is charged by the photovoltaic cell array).

The photovoltaic system is capable of converting light energy to electrical energy, and can be used to power one or more of the fixtures and/or the control system providing for the "hands-free" operation of fixtures. The photovoltaic system may include one or more photovoltaic cells (such as an array of cells) coupled to a support structure (e.g., the panel, shelf, etc.) on the base of the lavatory system. The photovoltaic cells may be supported by, mounted to, contained within, and/or integrally formed with a portion of support structure (e.g., the panel, countertop, basins, etc.) or other surrounding structures (e.g., a mirror, etc.). Preferably, photovoltaic cells are provided at the shelf of upper portion of support structure in an effort to maximize the exposure of the photovoltaic cells to the ambient light. Preferably, the addition of photovoltaic cells to the shelf does not significantly limit the functionality of the shelf as a usable surface for a user. The photovoltaic cells are electrically coupled to the fixtures and/or a control system providing for the operation of the fixtures.

The power management system is intended to provide for an efficient use of the electrical energy generated by the photovoltaic cells. The power management system generally includes an energy storage element configured to receive and store electrical energy generated by the photovoltaic cells, a detector (shown as a voltage detector) for monitoring the level of ambient light surrounding the lavatory system (e.g., by monitoring the energy stored in an energy storage element, etc.) to recognize periods of time when it is unlikely that the lavatory system will be used (e.g., when the ambient light is turn off or otherwise reduced), a switch capable of electrically disconnecting energy storage element from the control system when the voltage detector sends an output signal indicating that given the level of ambient light surrounding the lavatory system it is unlikely that the lavatory system will be used, and a voltage regulator for adjusting the voltage being sent to the control system. According to various alternative embodiments, power management system may be used without photovoltaic cells to electrically disconnect an energy storage element (such as a battery) from the control system.

FIGS. 13-50 show multi-height lavatory systems according to exemplary embodiments. Each lavatory system is configured to accommodate persons having varying abilities or characteristics for using a lavatory system (e.g., disabled, tall, short, etc.). In addition to the ease of manufacturing and installation, the lavatory system incorporates a unitary lavatory subassembly that has a minimum number of components, and provides an independent hand-washing station for users having varying physical attributes or abilities to attend to their washing needs. Also, this provides each user with an adequate sense of privacy while washing at a spaced distance from the next person using the lavatory system.

Each lavatory system includes a deck, a mounting arrangement configured to attach the lavatory system to an adjacent wall, a drain system disposed below deck, and a cover configured to enclose plumbing system. The lavatory system may be configured for attachment to a surface (such as the wall of a restroom or other area where it may be desirable to provide a lavatory services) with a plurality of connection points. Alternatively, the lavatory system may be configured as a free-standing structure. Adjacent wall 11 may be provided with the plumbing source (including both (or either) a hot and cold water supply, preferably combined with a thermostatic mixing valve, or a tempered water supply, a drain, etc.) and an optional source such as an electrical outlet (preferably providing 110 volts GFCI).

According to an exemplary embodiment, the deck includes a countertop with a backsplash extending upwardly from the countertop, and a front apron extending downwardly from countertop. According to another exemplary embodiment, the countertop may be configured in any of a variety of constructions intended to promote the drainage of spilled or splashed water to the drain from the countertop. The countertop may include an upper surface of a lower station and an upper surface of an upper station. According to an exemplary embodiment, the countertop includes a curved surface configured to prevent water from collecting (or "ponding"), to allow excess, splashed (or spilled fluids) to drain toward a bowl or drain, and to facilitate clean-up. According to exemplary embodiments, the countertop deck may have a radiused surface, a sloped surface, a pitched surface, or the like, and/or arranged at a variety of heights.

The lower station and the upper station are configured to provide lavatory service and to accommodate persons having varying abilities for using the lavatory system (e.g., disabled, tall, short, etc.). According to any preferred embodiment, one or more stations of the lavatory system are mounted at a standard height that is designed to comply with applicable accessibility standards, such as the Americans with Disabilities Act (ADA) Accessibility Guidelines for Buildings and Facilities and Uniform Accessibility Standards for Lavatories, or other standards (e.g., Texas Accessibility Standards or TAS). According to a particularly preferred embodiment, the height of the upper surface of the deck is approximately 34 inches (865 millimeters), provides a lower clearance (i.e., from the floor to the bottom of the apron) of at least 29 inches (735 millimeters) or less above the floor, and is equipped with a set of ADA or other accessibility regulation compliant faucet assemblies. According to any preferred embodiment, the lavatory system is mounted with a counter surface no higher than thirty-one inches.

FIGS. 13-50 show lavatory systems according to exemplary embodiments. The lavatory systems are configured to accommodate (e.g., to provide hand washing access to) persons having varying abilities or physical attributes or characteristics (e.g., adult, juvenile, children, persons with disabilities, tall, short, etc.) and/or be in compliance with accessibility guidelines. The lavatory systems are also configured to provide for improved manufacturing, inventory control, assembly, installation and maintenance by incorporating common or universal components (at least in the manufacturing stage) that are configurable or reconfigurable for a variety of lavatory system designs and/or configurations (e.g., one-station, two-station, three-station, etc.). The multi-station lavatory systems (i.e., two or more stations) are configured to provide hand washing access to multiple users at the same time. The lavatory systems are further configured to use space more efficiently (e.g., fit and design of deck, sink, cover, and/or walls) to provide improved access to and usability of the lavatory system for users having varying physical attributes or abilities to attend to their washing needs.

The lavatory systems of U.S. patent application Ser. No. 10/116,335 titled "Lavatory System" filed Apr. 4, 2002, now U.S. Pat. No. 7,039,963, and U.S. patent application Ser. No. 10/637,801 titled "Lavatory System" filed Aug. 8, 2003, are hereby incorporated herein by reference in their entireties.

Figure 13A:
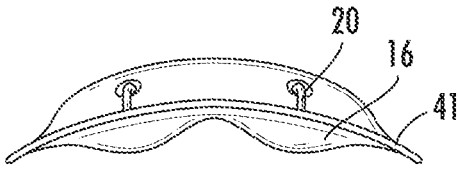
FIGS. 13A-13D show a front view of a modular lavatory system according to an exemplary embodiment having a generally convex countertop that may be mounted at different angular positions.
Figure 13C:
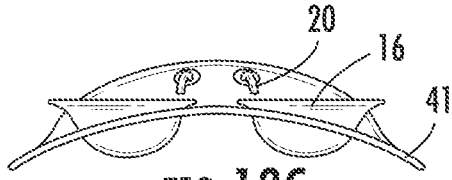
Figure 13B:
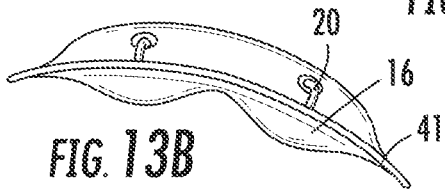
Figure 13D:
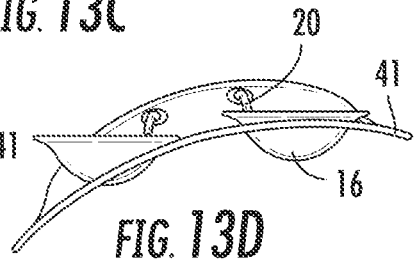

FIGS. 13A-13D illustrates a modular lavatory system having a deck or countertop 41. As shown in FIGS. 13A-13D, countertop 41 is a generally convex countertop. The convex countertop has one or more openings (two are shown) to receive basins 16. Depending on the desired orientation and height of basins 16, countertop 41 may be mounted in a variety of tipped or rotated orientations. For example, if it is desired to have the wash stations (and basins) at the same height or level, the countertop is mounted as shown in FIG. 13A and FIG. 13D. If it is desired to have one of basins 16 to be lower (e.g., to meet certain ADA requirements), countertop 41 is rotated or tipped clockwise in the amount that brings the station to the desired height (e.g., relative to the floor). Hand washing fixtures 20 (e.g., faucets, soap dispensers, towel dispensers, hand dryers, etc.) are then mounted according to the orientation of the countertop. Taken together, FIGS. 13A-13D also illustrate a method of installing a lavatory system having a first hand washing station and a second hand washing station to provide hand washing functionality to one or more users. The method comprises a step of providing an elongated countertop having a left lateral edge, a right lateral edge, and a front edge extending between the left lateral edge and the right lateral edge, a first basin, a second basin, a first faucet, and a second faucet. When mounting the countertop to a wall, the countertop may be mounted in its generally horizontal (neutral) position wherein the left and right lateral edges are about the same distance from the floor (FIGS. 13A and 13C). The countertop may also mounted to a wall at an angle so that one hand washing station is lower (or higher) than the other (FIGS. 13B and 13D). The basins or sinks may be integrally formed with countertop (FIGS. 13A and 13B). Alternatively, the basins or sinks may be separate components that are coupled to the countertop (e.g., to provide a greater horizontal appearance such as shown in FIGS. 13D and 13D).

Figure 14:
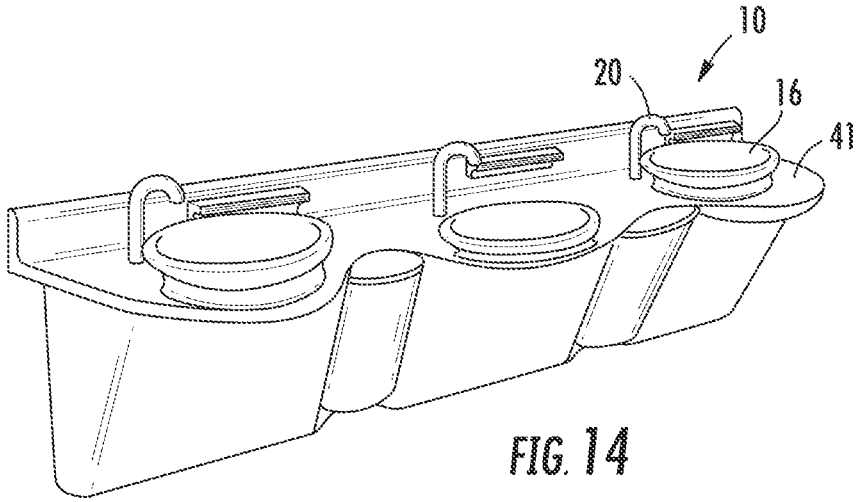
FIG. 14 is a front perspective view of a modular lavatory system according to an exemplary embodiment.

FIG. 14 illustrates another embodiment of a modular lavatory system 10 having a generally planer countertop 41. Countertop 41 has one or more openings (holes, apertures, etc., which may be circular, oval, rectangular, or other shapes) to receive one of a variety of basins 16. Basins 16 are configured to provide a variety of heights and comprise a mounting portion and a receptacle (bowl) portion. The mounting portion engages countertop 41 at one of the openings. The height presented by the washing station is defined by the size or amount of the bowl portion extending from the mounting portion. A single countertop may therefore be used to provide a lavatory system 10 having a variety of configurations. For example, if it is desired to provide three wash stations at three different user access heights, three different basin configurations are coupled to openings in countertop 41, such as shown in the embodiment of FIG. 14.

Figure 15:
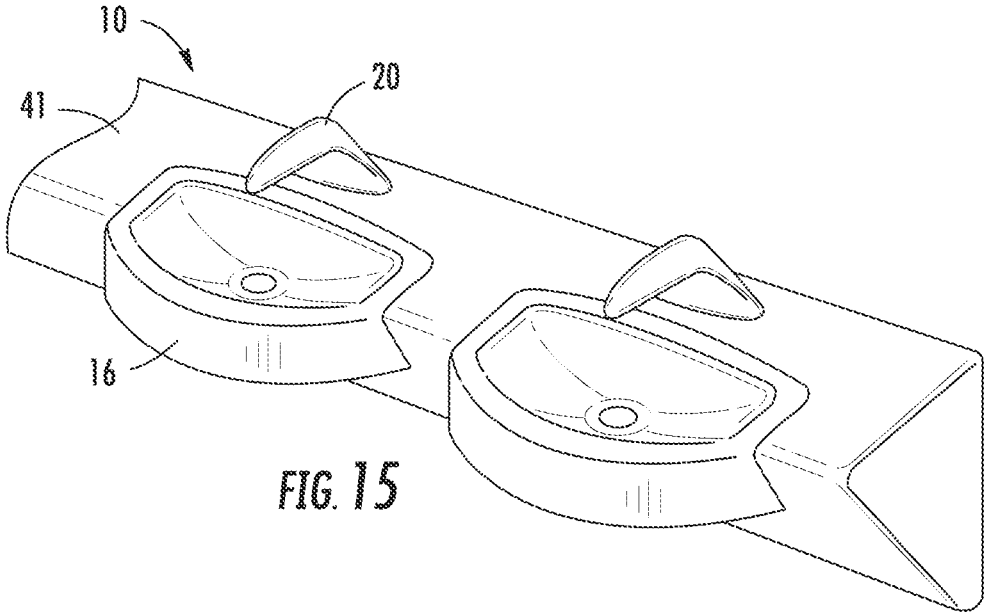
FIG. 15 is a front perspective view of a modular lavatory system according to an exemplary embodiment.

FIG. 15 illustrates a modular lavatory system 10 having a generally planer countertop 41. Countertop 41 has one or more slots into which the basin slides in for mounting. Basins 16 may have any of a variety of relative heights of the bowl portion to provide a variety of wash station heights. The example illustrated in FIG. 15 shows two identical basins mounted to the countertop to provide the same wash station heights.

Figure 16:
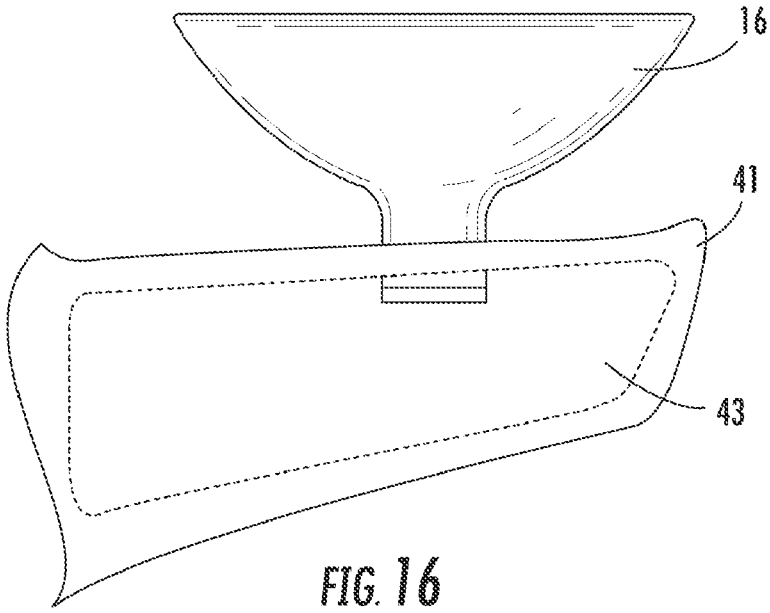
FIG. 16 is a side view of a modular lavatory system according to an exemplary embodiment.

FIG. 16 illustrates a modular lavatory system 10 having a countertop 41. The countertop has a hollow area providing a common drain table or channel 43, and defined by an inclined top surface with one or more overflow openings and one or more basin openings configured to receive a mounting portion of a raised basin. The mounting portion also provides a drain/outlet 51 so water in the receptacle drains into the common drain table 43. The draining water is therefore obscured from the user or users of the lavatory system.

Figure 17:
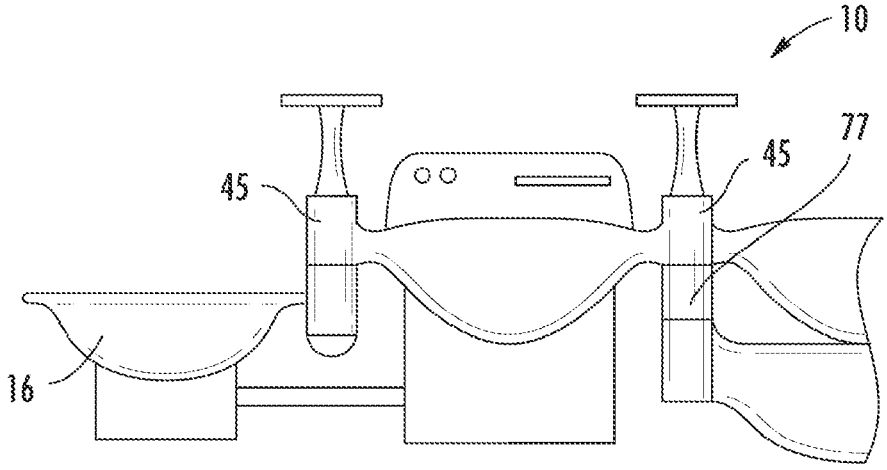
FIG. 17 is a front side view of a modular lavatory system according to an exemplary embodiment.

FIG. 17 illustrates a modular lavatory system 10 having a plurality of countertops 41 and basins 16. The countertops have a pair of mounting arms 45 extending outwardly. Mounting arms 45 include a bore with a vertical axis that is coupled to a base (e.g., post, tube, etc.). A variety of wash station heights is provided by the location that the mounting portions engage (e.g., coupled, fastened, etc.) to the base. As shown, a spacer 77 may be used to further separate adjacent countertops. As such, the same countertop/basin assembly is used and mounted at the desired height.

Figure 18:
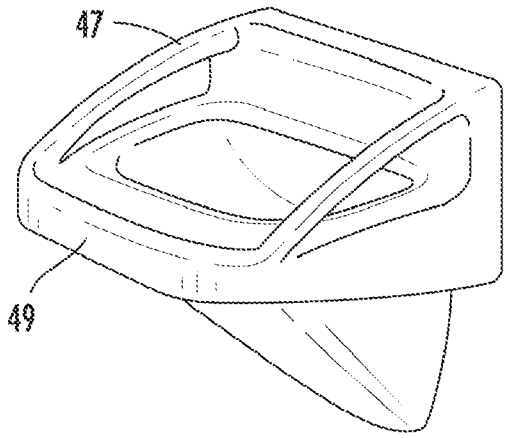
FIG. 18 is a front perspective view of a wash station with grab bars according to an exemplary embodiment.

FIG. 18 illustrates a wash station with grab bars 47 and a grab lip 49 to assist users with using the lavatory system (e.g., pulling a wheelchair in close and alignment).

Figure 19:
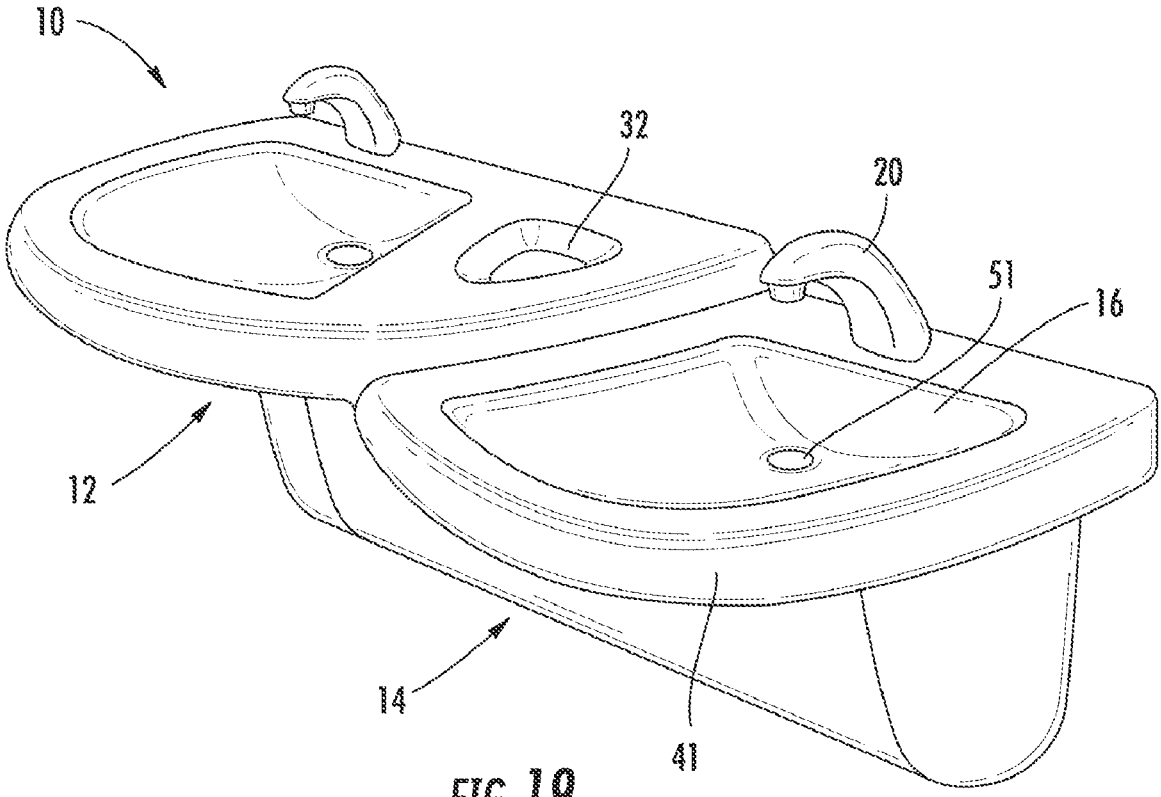
FIG. 19 is a front perspective view of a lavatory system including two hand washing stations according to an exemplary embodiment.

FIG. 19 illustrates a lavatory system 10 including a countertop 41 providing two hand washing stations 12, 14 located at different heights. Countertop 41 has an integrated waste receptacle 32. Waste receptacle 32 is intended to improve water containment and reduce the amount of water dripped on the floor by a user that would otherwise have to walk across the washroom from the hand washing area to the hand drying station (e.g., towel or electric dryer). Instead, hand drying is done with towels dispensed from a towel dispenser (not shown, but located, for example, above the countertop) and thrown away without having to leave the hand washing station. Preferably, the opening to the receptacle 32 is angled to assist guiding waste into the receptacle.

Figure 20:
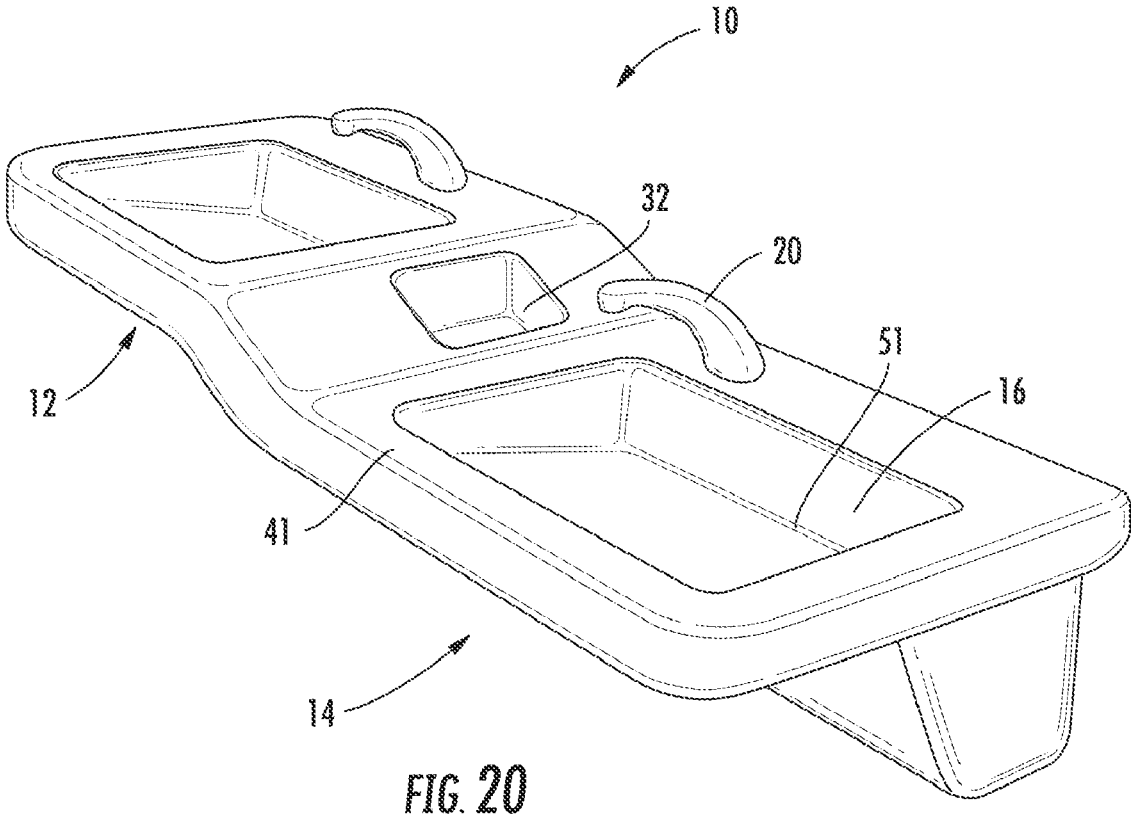
FIG. 20 is a front perspective view of a lavatory system including two hand washing stations according to an exemplary embodiment.

FIG. 20 illustrates a lavatory system 10 including a countertop 41 providing two hand washing stations 12, 14 located at different heights. Each hand washing station is generally planer between its lateral sides, and is angled downwardly from front to back for water containment. Countertop 41 also has an integrated waste receptacle 32 to also improve water containment as discussed with regard to FIG. 19. Each basin 16 includes a concealed or obscured drain 51 provided by a slit extending at least partially across the rear portion of the basin.

Figure 21:
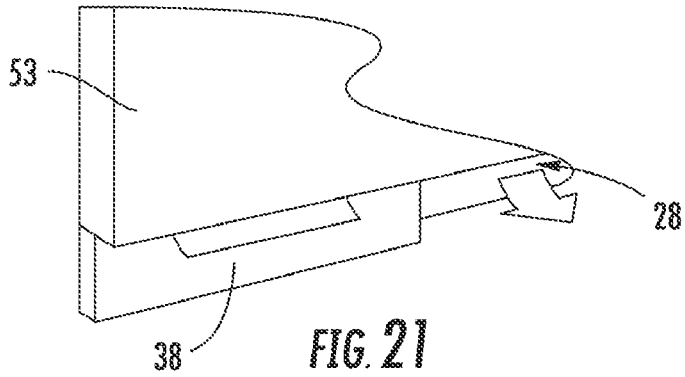
FIG. 21 shows a hand drying station integrated with a mirror.

FIG. 21 illustrates a hand drying fixture or station configured to be integrated (e.g., coupled to, mounted adjacent to, etc.) with the lavatory systems as disclosed herein. The hand drying station comprises both a paper towel dispenser 38 and an electric hand dryer 28. The hand drying station is also integrated with another standard washroom fixture, such as a mirror 53, to provide additional functionality as well as help obscure the station.

Figure 22:
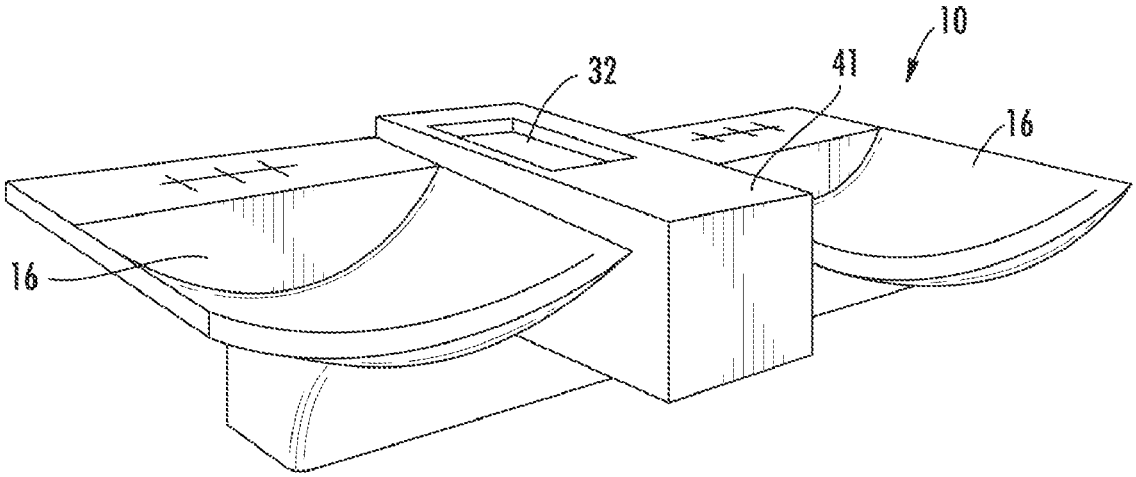
FIG. 22 is a front perspective view of a modular lavatory system according to an exemplary embodiment.

FIG. 22 illustrates a modular lavatory system 10 having a countertop 41 and a plurality of modular basins 16. Countertop 41 is located at a predetermined height between adjacent basins 16. Basins 16 are mounted at desired heights. Countertop 41 has a waste receptacle 32 to assist in water containment as discussed above.

Figure 23:
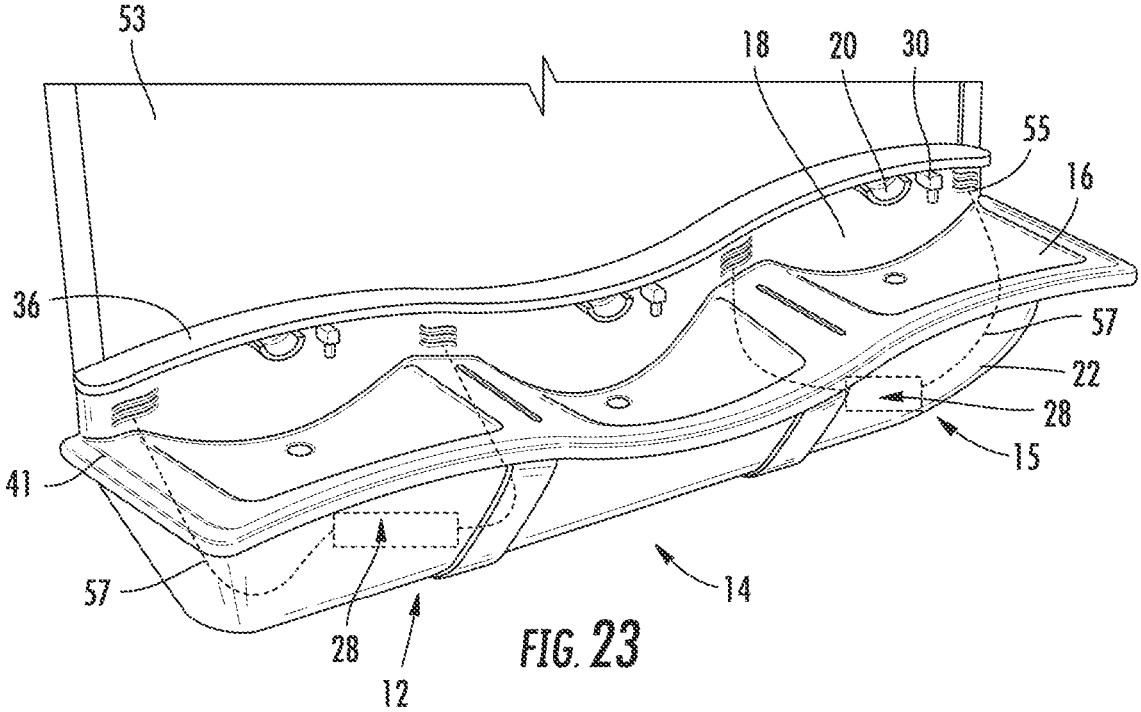
FIG. 23 is a front perspective view of a lavatory system including three hand washing stations according to an exemplary embodiment.

FIG. 23 illustrates a lavatory station 10 with three hand washing stations 12, 14, and 15 located at different heights. Each wash station includes a basin 16, a faucet 20, and a soap dispenser 30. One or more electric hand dryers 28 (shown schematically as broken line rectangles) for one or more hand drying stations are located inside of trap enclosure or trap cover 22. Hand dryers 28 are coupled to vents or outlets 55 (shown as a series of curved slots) that are integrated with backsplash 18. According to an exemplary embodiment, two hand dryers 28 are used to provide heated air to, for example, four outlets. Air ducts 57 (e.g., conduit) split the heated output air as shown schematically by the broken lines connecting the dryers and the outlets. Photovoltaic cells may be mounted above the mirror 53 and/or in the light fixture above the mirror. Mirror 53 may be, for example, integrated with the lavatory fixture such as shown in FIG. 23.

Figure 24:
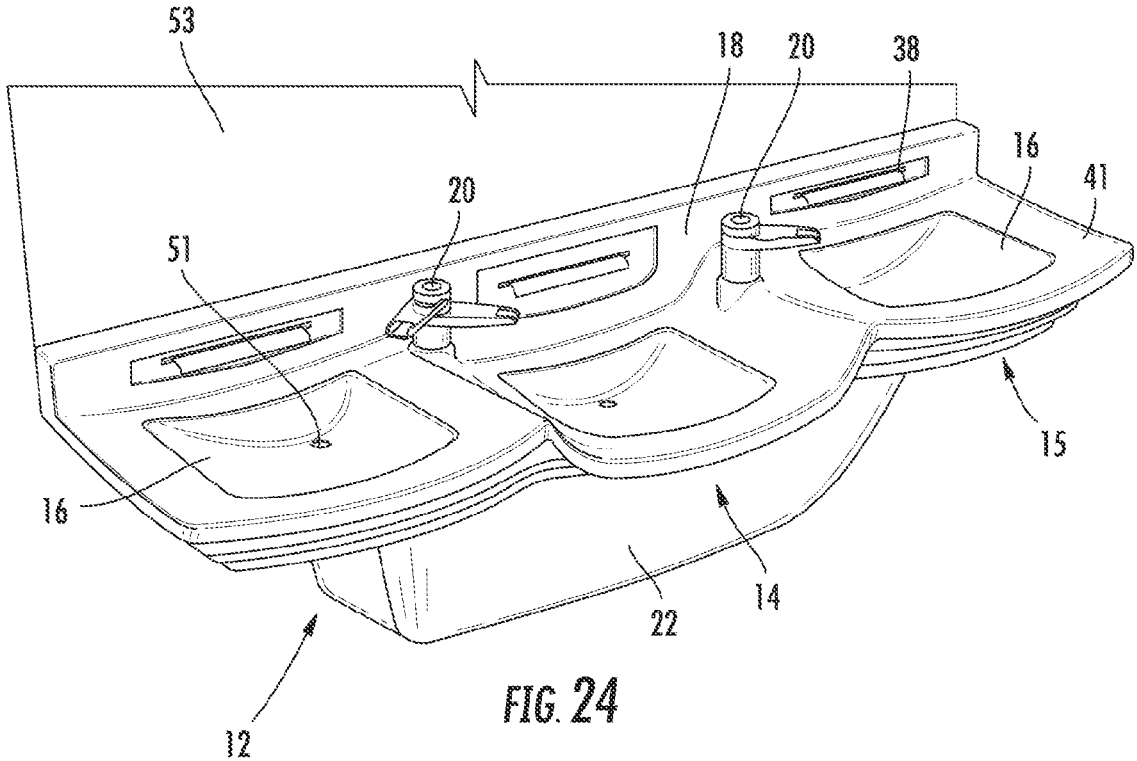
FIG. 24 is a front perspective view of a lavatory system including three hand washing stations according to an exemplary embodiment.

FIG. 24 illustrates a lavatory system 10 having three wash stations 12, 14, 15. Lateral edges of countertop 41 of each wash station extend (e.g., curve) upwardly at the interface between adjacent wash stations for water containment and ornamental appearance. Hand drying stations, shown as towel dispensers 38 (but could be an electric hand dryers), are integrated with backsplash 18. Drains 51 in each basin 16 are located towards the middle of the lavatory system—the drain in station 12 is on the right side of the basin, the drain in station 14 is in the middle of the basin, and the drain in station 15 is on the left side of the basin. As such, the width of trap cover 22 (the enclosure used to cover the plumbing and electrical components) is reduced or minimized to open up space below countertop 41. According to an exemplary embodiment, faucets 20 (e.g., valve, sensor, etc.) and soap dispensers (e.g., valve, sensor, etc.) are powered by a photovoltaic cell and power management system such as disclosed in U.S. patent application Ser. No. 11/041,882 titled "Lavatory System" filed Jan. 21, 2005 is hereby incorporated herein by reference in its entirety. One or more of faucets 20 may comprise a double-decker configuration, comprising a (vertical) single conduit provides water to outlet spouts and sensors servicing two different wash stations (e.g., to minimize the "rough-in" for fixtures, electrical wiring, and the like).

Figure 25:
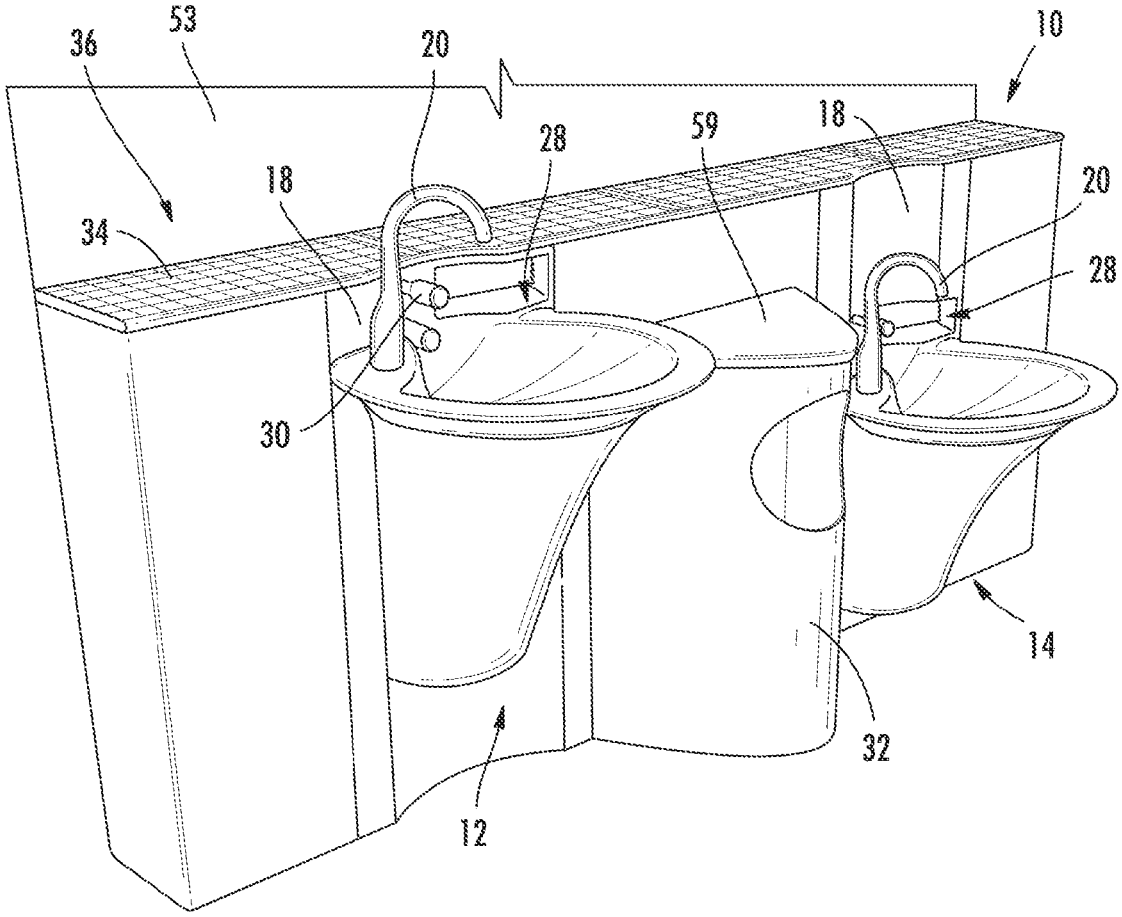
FIG. 25 is a front perspective view of a lavatory system including two hand washing stations according to an exemplary embodiment.

FIG. 25 illustrates a lavatory system 10 having two wash stations 12, 14. A hand drying station, shown as electric hand dryer 28 (but could be a towel dispenser) is integrated with the backsplash 18. According to an exemplary embodiment, faucet 20 (e.g., valve, sensor, etc.) and soap dispenser 30 (e.g., valve, sensor, etc.) are powered by a photovoltaic cell and power management system such as disclosed in U.S. patent application Ser. No. 11/041,882 titled "Lavatory System" filed Jan. 21, 2005 is hereby incorporated herein by reference in its entirety. Photovoltaic cells 34 are mounted on panel 36 located above the backsplash 18. Panel 36 may provide, for example, a place for personal items of the user(s). Each wash station 12, 14 includes a faucet 20, a soap dispenser 30, and a hand dryer 28 with air outlet and/or towel dispenser (not shown). A waste receptacle 32 is mounted between wash stations 12, 14 and also includes a surface 59 for personal items, or another location for additional photovoltaic cells 34.

Figure 26:
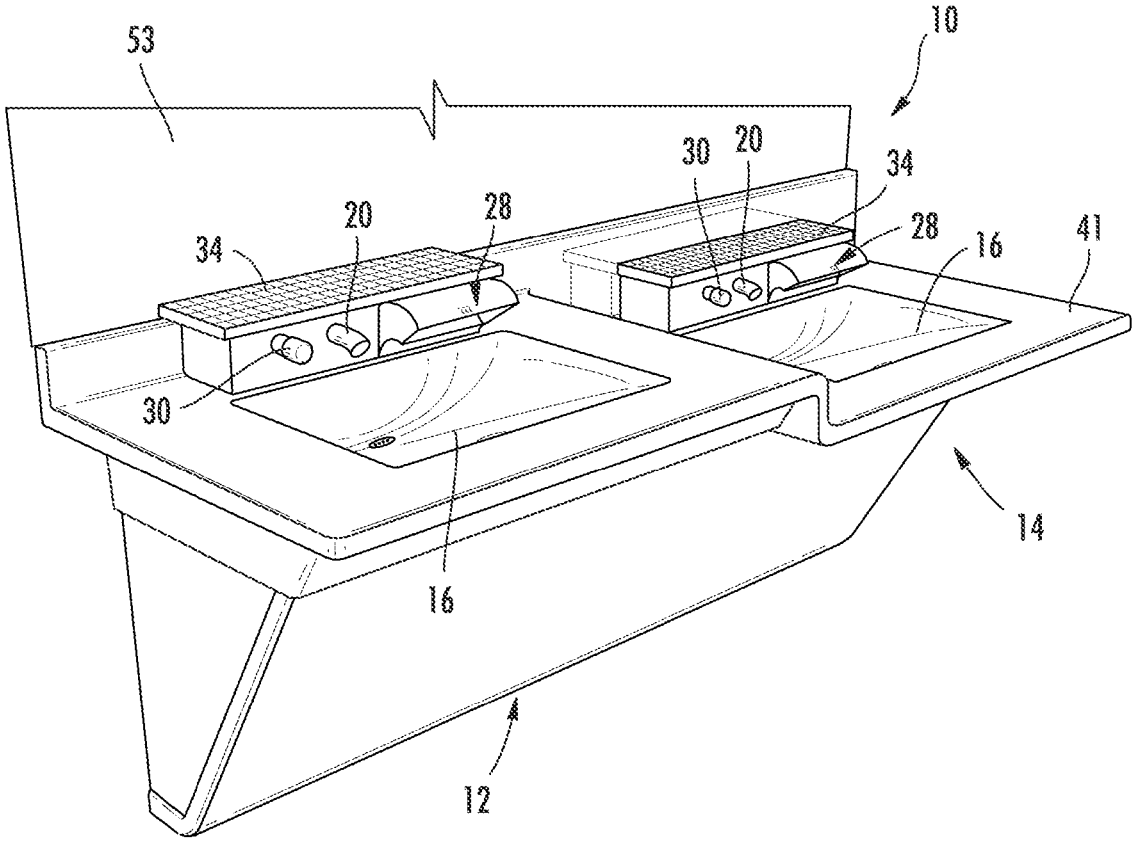
FIG. 26 is a front perspective view of a lavatory system including two hand washing stations according to an exemplary embodiment.
Figure 27:
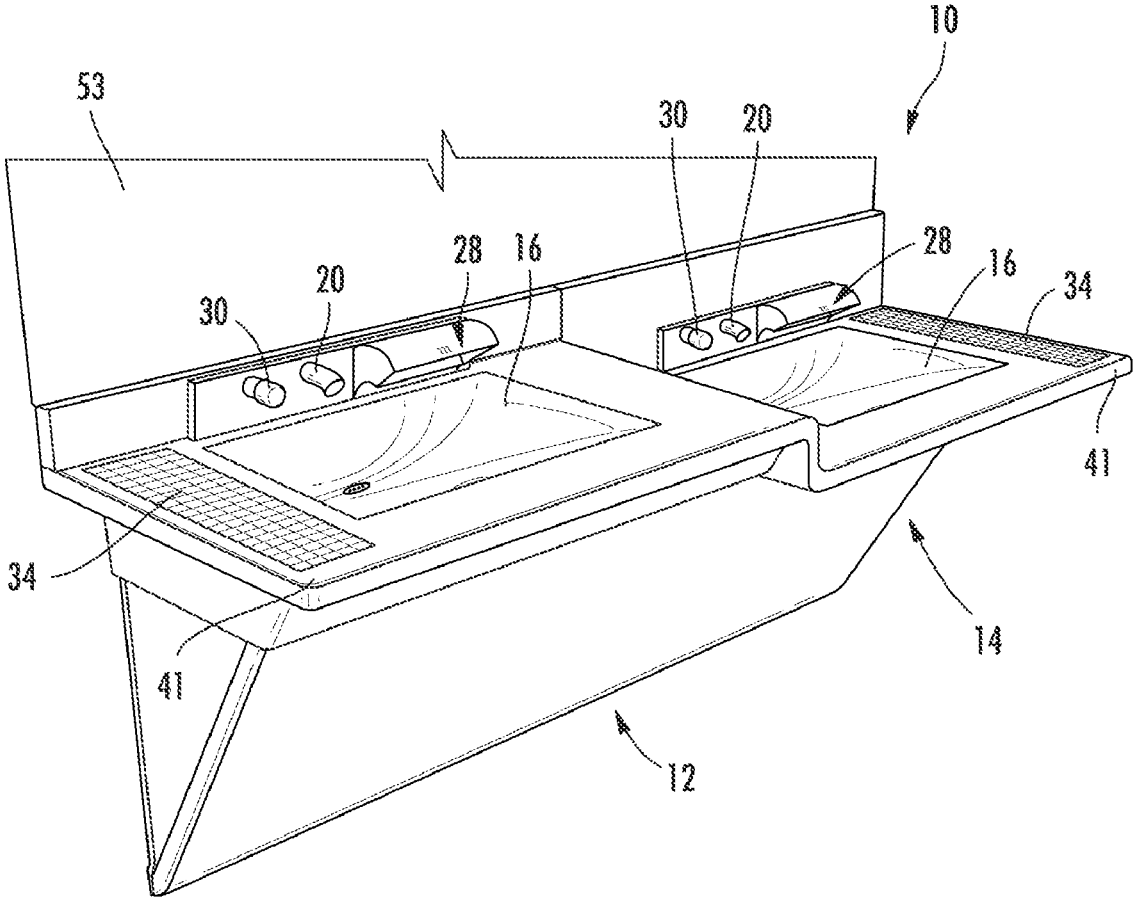
FIG. 27 is a front perspective view of a lavatory system including two hand washing stations according to an exemplary embodiment.
Figure 28:
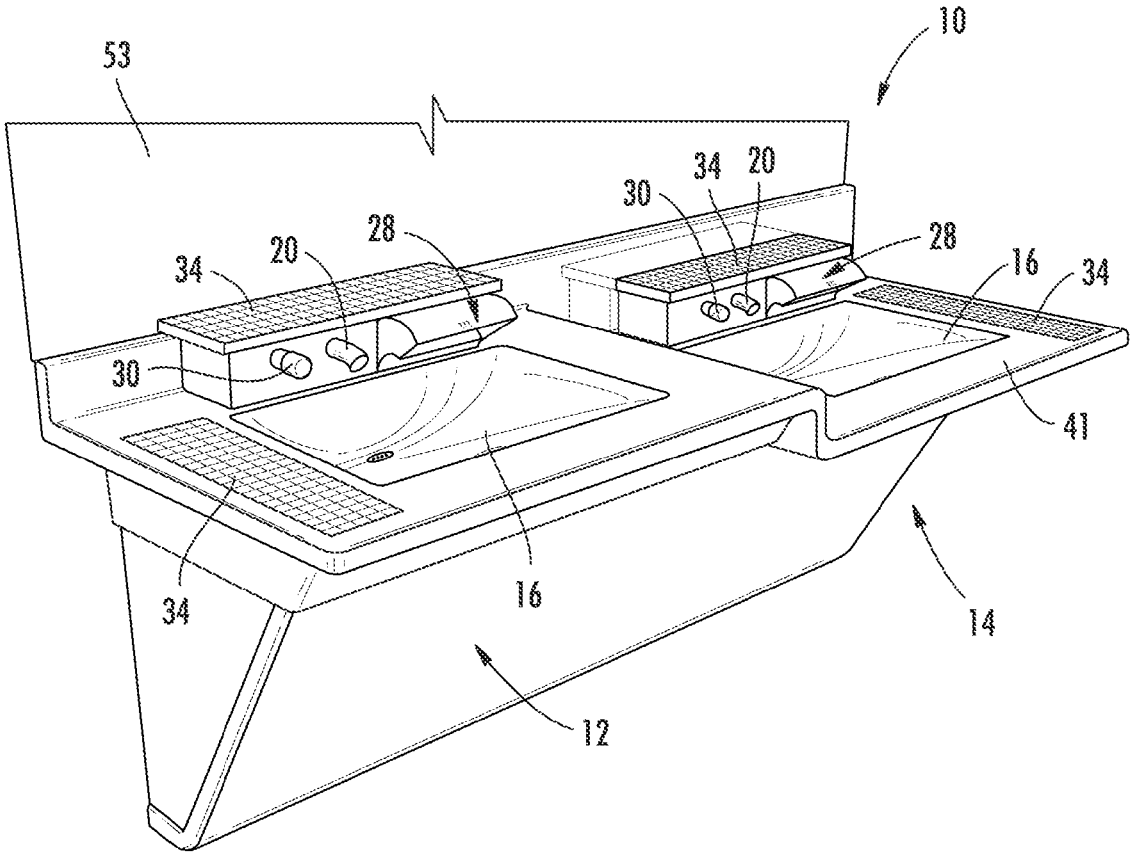
FIG. 28 is a front perspective view of a lavatory system including two hand washing stations according to an exemplary embodiment.

FIGS. 26-28 show similar embodiments of lavatory systems 10. Each includes two wash stations 12, 14 offset vertically at different heights. Each station 12, 14 includes a faucet 20, a soap dispenser 30, and an electric hand dryer 28. At least the faucet (e.g., valve, sensor, etc.) and soap dispenser (e.g., valve, sensor, etc.) are powered by a photovoltaic cell and power management system such as disclosed in U.S. patent application Ser. No. 11/041,882 titled "Lavatory System" filed Jan. 21, 2005 is hereby incorporated herein by reference in its entirety. FIG. 26 shows the fixtures (e.g., faucet 20, a soap dispenser 30, and an electric hand dryer 28) mounted in a pedestal having a top surface of photovoltaic cells 34. FIG. 27 shows the fixtures recessed in the wall and photovoltaic cells 34 mounted in countertop 41. FIG. 28 shows the photovoltaic cells 34 mounted in both the top of the pedestal and countertop 41.

Figure 29:
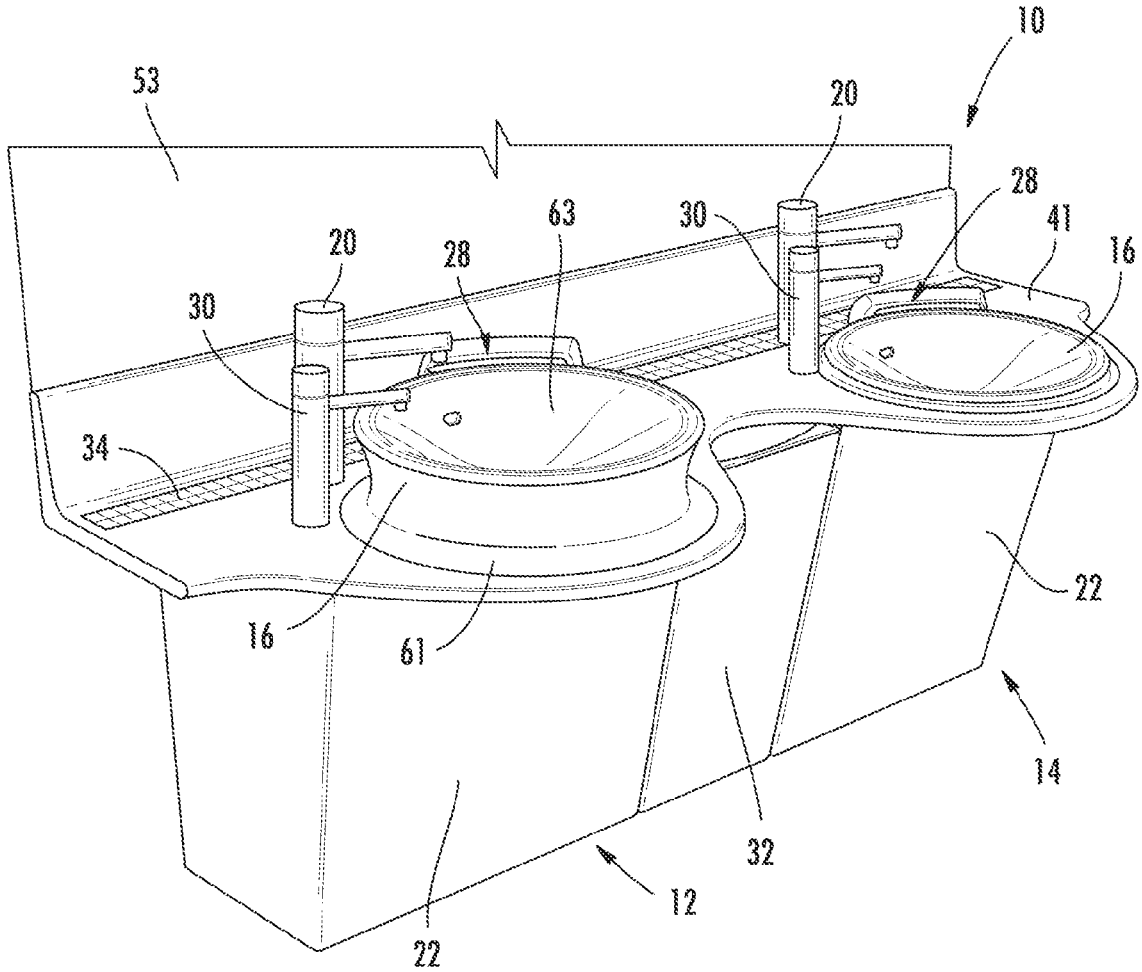
FIG. 29 is a front perspective view of a lavatory system including two hand washing stations according to an exemplary embodiment.
Figure 30:
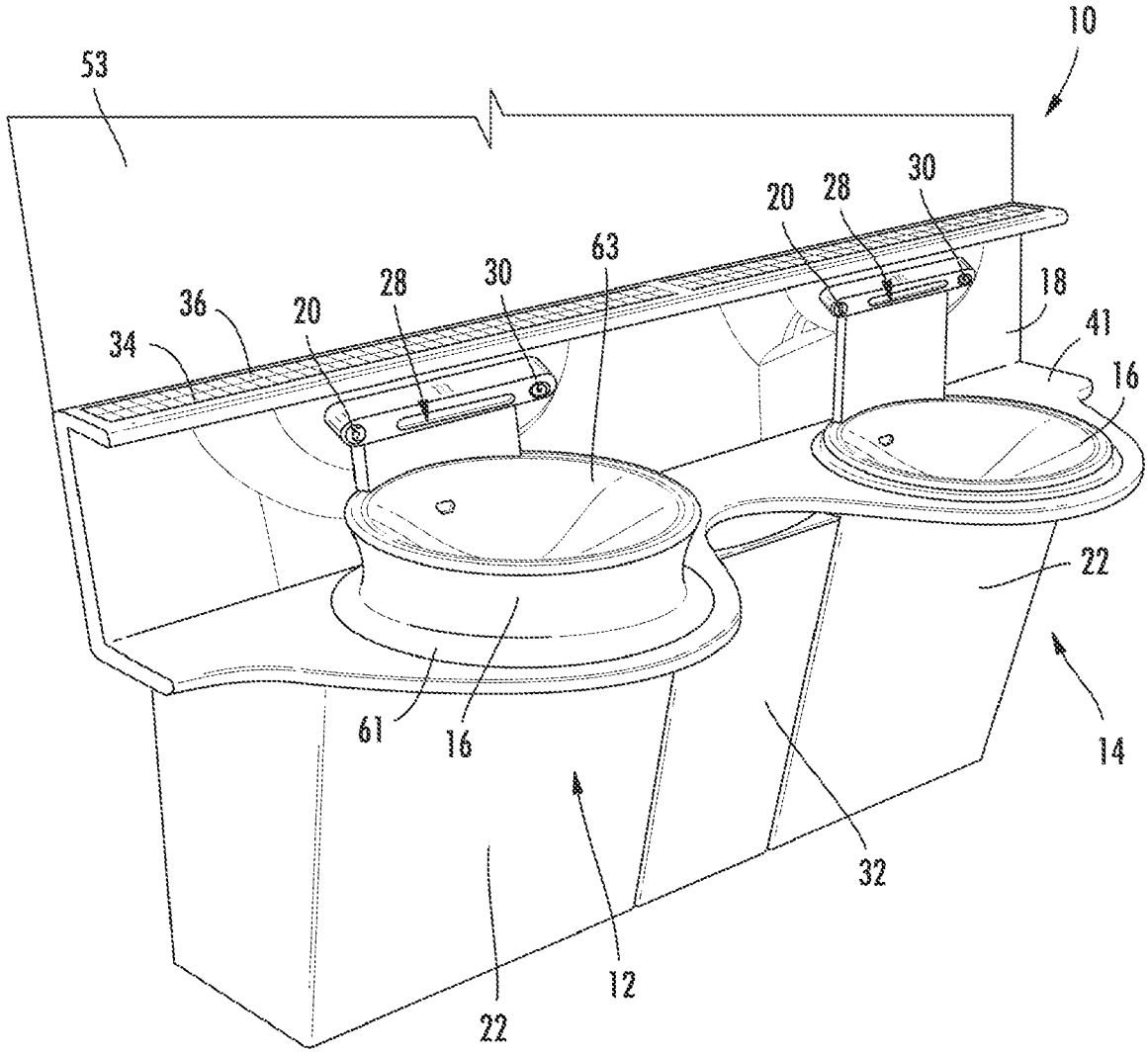
FIG. 30 is a front perspective view of a lavatory system including two hand washing stations according to an exemplary embodiment.
Figure 31:
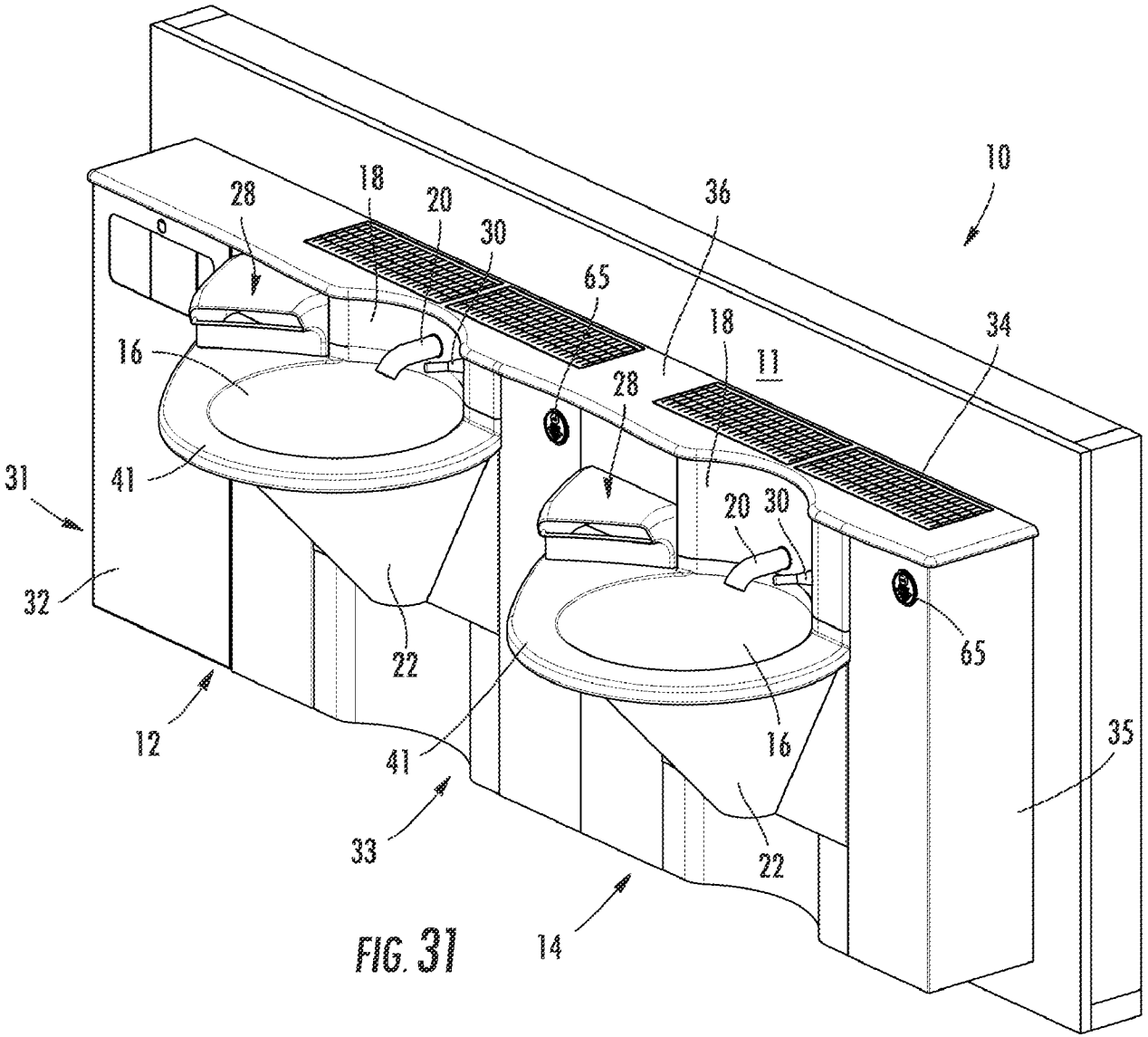
FIG. 31 is a front perspective view of a lavatory system including two hand washing stations according to an exemplary embodiment.
Figure 32:
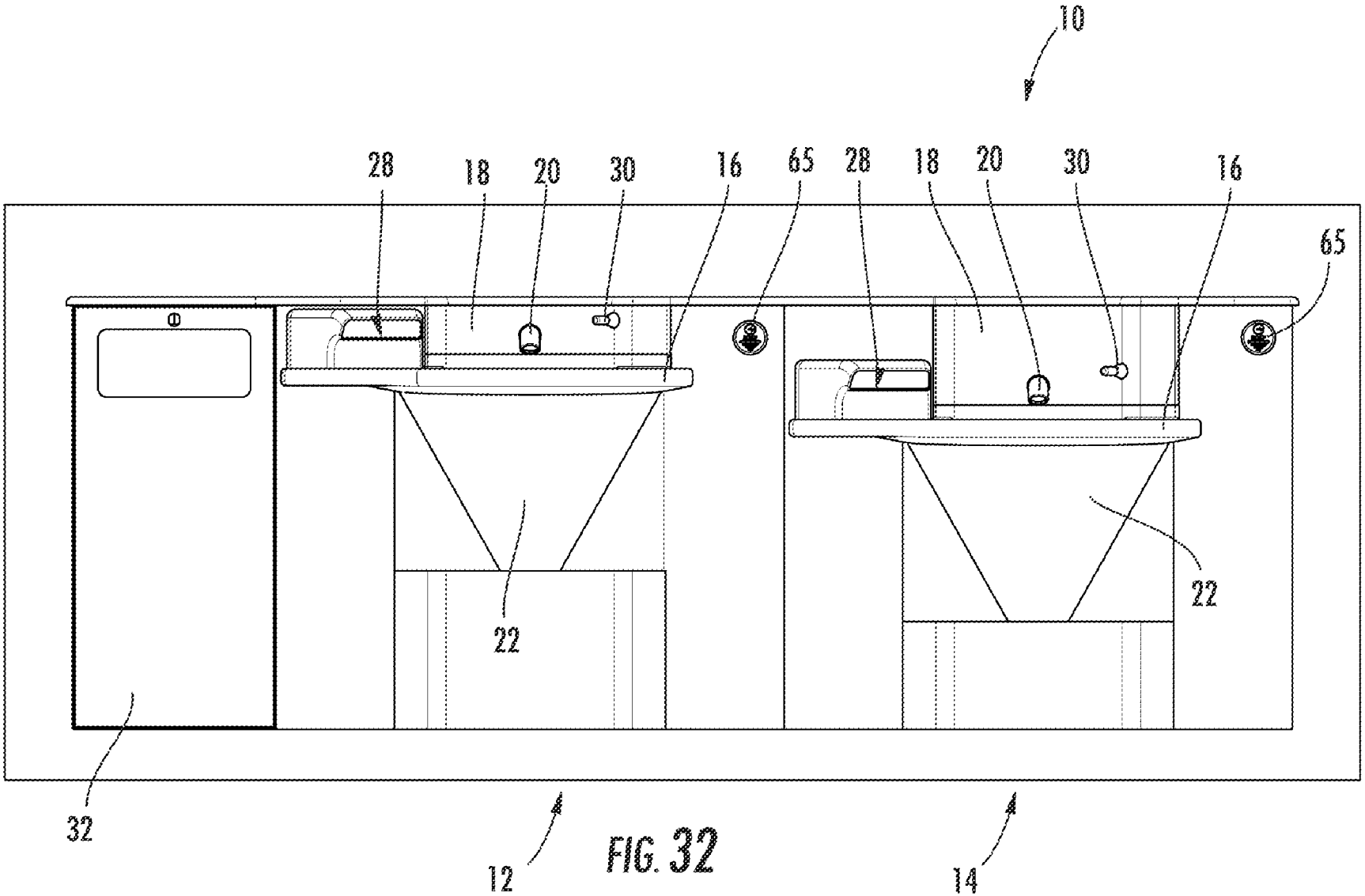
FIG. 32 is a front side view of the lavatory system of FIG. 31.

Similar to FIG. 14, FIGS. 29 and 30 illustrate modular lavatory systems 10 having a generally planer countertop 41. Countertop 41 has one or more openings (holes, apertures, etc., which may be circular, oval, rectangular, or other shapes) to receive one of a variety of basins 16. Basins 16 are configured to provide a variety of heights and comprise a mounting portion 61 and a receptacle (bowl) portion 63. Mounting portion 61 engages countertop 41 at one of the openings. The height presented by the washing station is defined by the size or amount of bowl portion 63 extending from the mounting portion 61. A single countertop 41 may therefore be used to provide a lavatory system 10 having a variety of configurations. For example, for the two wash station heights shown in FIGS. 29 and 30, countertop 41 with two openings is installed with basins 16 having two different heights. Each station 12, 14 includes a spray head 20 (instead of a faucet), a soap dispenser 30, and an electric hand dryer 28. FIG. 29 shows the spray head 20 and soap dispenser 30 are mounted to the countertop 41 and the outlet for the hand dryer integrated with the basin 16. FIG. 30 shows the spray head 20 and soap dispenser 30 and the outlet for the hand dryer 28 integrated with the backsplash 18. At least the faucet (e.g., valve, sensor, etc.) and soap dispenser (e.g., valve, sensor, etc.) are powered by a photovoltaic cell and power management system such as disclosed in U.S. patent application Ser. No. 11/041,882 titled "Lavatory System" filed Jan. 21, 2005 is hereby incorporated herein by reference in its entirety. In FIG. 29, photovoltaic cells 34 are mounted in countertop 41. In FIG. 30, photovoltaic cells 34 are mounted in a panel 36 (e.g., for personal items). The lavatory systems of FIGS. 29 and 30 also include a waste receptacle 32 integrated with trap cover 22. Items may be placed in the waste receptacle through a small opening between the countertop and a panel (e.g., small items such as a tissue), or by pulling the panel outward (e.g., for larger items).

Referring to FIGS. 31 through 35, a lavatory system 10 is shown according to another exemplary embodiment. Similar to the exemplary embodiments detailed above, the embodiment illustrated in FIGS. 31 through 35 may be configured to be supported by an adjacent wall 11 (as shown) or may be a freestanding structure configured to be supported by a base (e.g., legs, pedestal, vanity, etc.).

According to the embodiment illustrated, lavatory system 10 includes two hand washing stations, shown as a first or upper station 12 and a second or lower station 14. Alternatively, the lavatory system may include any number of washing stations (e.g., one, three, four, or more) arranged in any of a variety of configurations (e.g., all upper stations, all lower stations, mixed upper/lower stations, etc. set at a variety of upper/lower patters or sequences). Each hand washing station 12, 14 generally includes a basin 16 (e.g., bowl, sink, receptacle, etc.), a countertop 41 or surface (e.g., rim, ledge, etc.) at least partially surrounding the basin, washing fixtures (e.g., faucet 20, soap dispenser 30, etc.) associated with each basin 16, a cover 22 supported under each basin 16 for at least partially concealing plumbing (e.g., water supply, drain, etc.) associated with the station, a hand drying fixture (e.g., electric hand dryer, towel dispenser, etc.), shown as hand dryer 28, and an interface 65 for filling or refilling a reservoir (e.g., chamber, receptacle, etc.) that is configured to retain a liquid soap for soap dispenser 30.

The embodiment illustrated is further shown as including a waste receptacle 32 adjacent to the upper station 12 and a plurality of photovoltaic cells 34 mounted on a shelf or platform 36 located above the other components of the washing stations 12, 14. Waste receptacle 32 may be at any of a variety of locations on the lavatory system 10 (e.g., between each wash station, on the outer ends of the wash stations, etc.). According to the embodiment illustrated, faucet 20 and soap dispenser 30 are powered by the photovoltaic cells 34 and a power management system, such as disclosed in U.S. patent application Ser. No. 11/041,882 titled "Lavatory System" filed Jan. 21, 2005, referenced above, the entire contents of which is hereby incorporated herein by reference in its entirety. Further, if hand dryer 28 is an electric hand dryer, hand dryer 28 may be powered by the same photovoltaic cells 34 and power management system.

Figure 33:
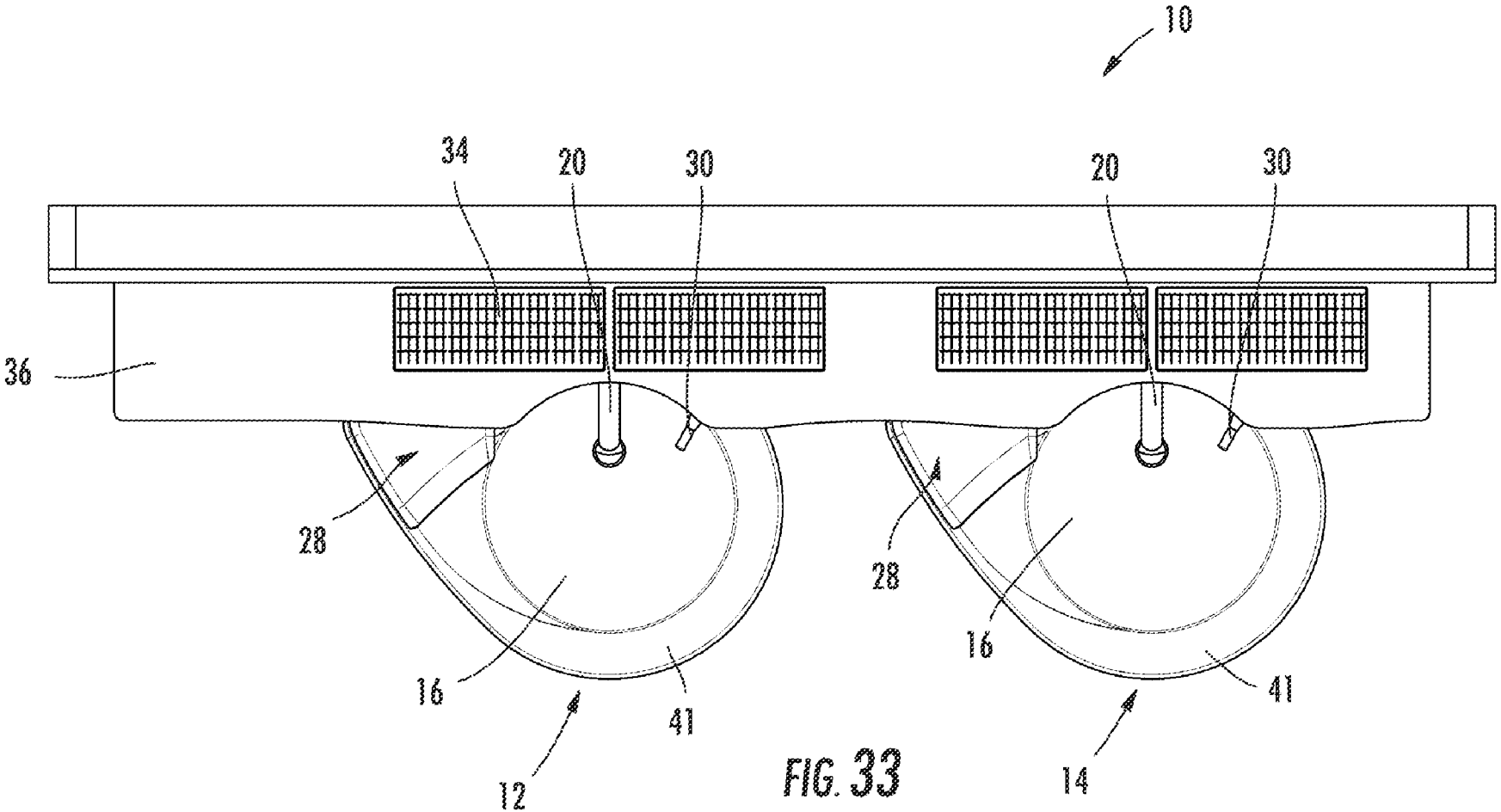
FIG. 33 is a top view of the lavatory system of FIG. 31.
Figure 34:
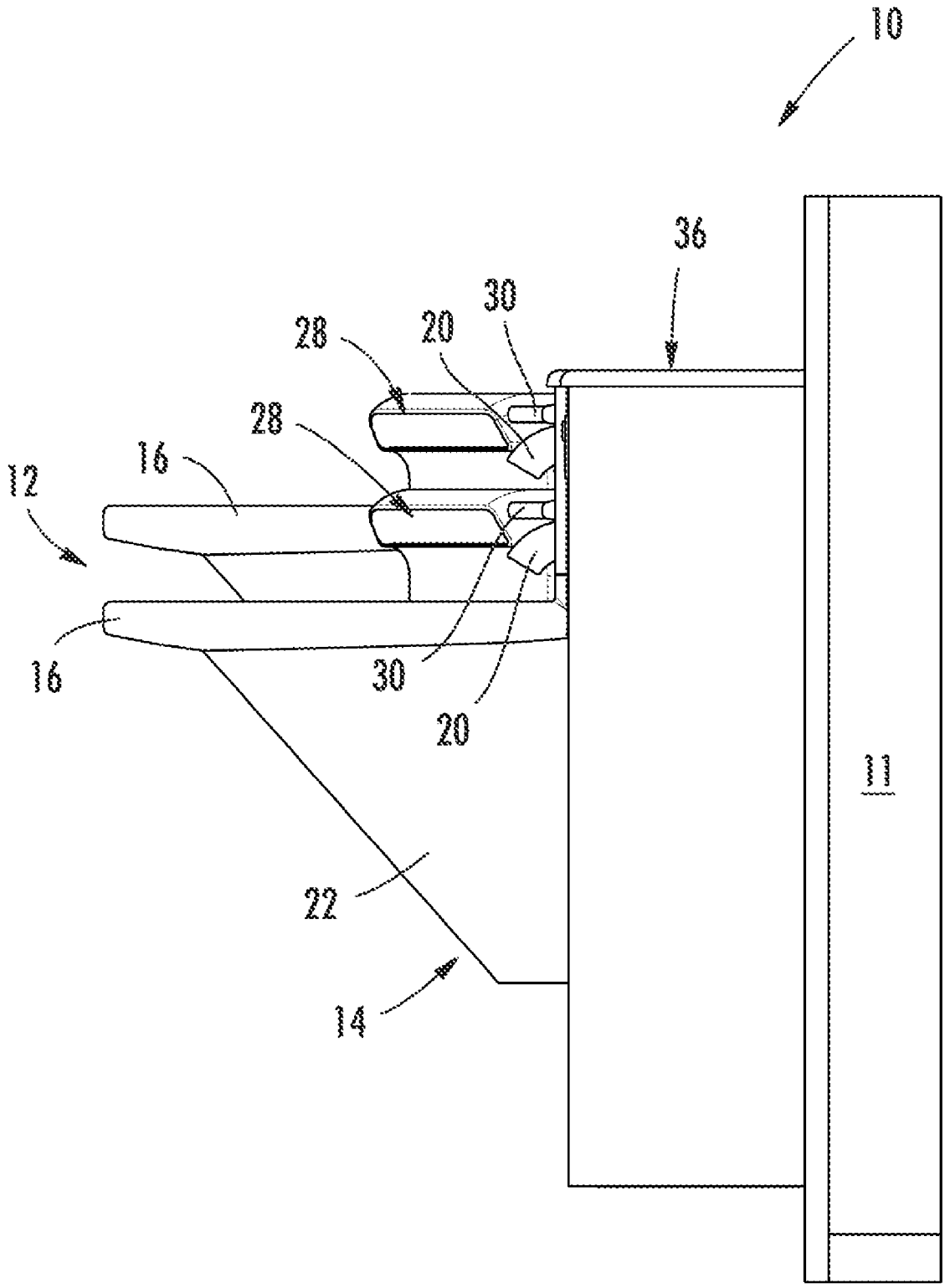
FIG. 34 is a right side view of the lavatory system of FIG. 31.

A hand dryer 28 is provided at each washing station 12, 14 so that a user does not have to move away from the washing station before drying his or her hands. Having access to a hand dryer 28 at the washing station, as opposed to a distance away from the washing station, is intended to reduce the likelihood that water from a user's hands will collect on the floor of the facility in which the lavatory system is located. According to the embodiment illustrated, hand dryer 28 is integrated with a backsplash area 18 of the washing station and is supported by the countertop 41. As shown in FIG. 33, countertop 41 is configured to be larger on one side to accommodate hand dryer 28. As further shown in FIG. 33, the contour of the countertop substantially corresponds to the contour of hand dryer 28 to provide a continuous appearance between hand dryer 28 and countertop 41.

According to an exemplary embodiment, hand dryer 28 is an electric hand dryer configured to provide forced air in the direction of the user. The output opening of the hand dryer is configured so that as water is blown off the hands of a user, the water will be directed towards the basin. To facilitate this, the output opening of hand dryer 28 is directed downward and inward towards basin 16. To further facilitate the collection of the water in the basin rather than the floor, the top surface of countertop 41 may have a contour that is angled (e.g., slanted, sloped, etc.) downward and/or inward towards basin 16 as shown in FIG. 33.

Referring back to FIG. 31, an interface 65 is provided at each washing station 12, 14 that can be used to fill and/or refill a reservoir (not shown) that retains soap that is supplied to soap dispenser 30. Interface 65 is intended to simplify the task of filling and/or refilling the reservoir. According to the embodiment illustrated, interface 65 includes a face plate 67 (e.g., cover member, etc.) and a base member 69. Face plate 67 is coupled to a first end of the base member 69 while a second end of base member 69 is movably coupled a support structure, shown as front portion 33 of housing 31, of lavatory system 10. Base member 69 is configured to be selectively moved between a stowed position (shown in FIG. 31) and an extended or fill position (shown in FIG. 35). According to the embodiment illustrated, base member 69 is configured to slide between the stowed position and the fill position. One or more mechanisms (e.g., bearing surfaces, rollers, glides, etc.) may be provided between base member 69 and the support structure of lavatory system 10 to assist in the movement of base member 69.

Figure 35:
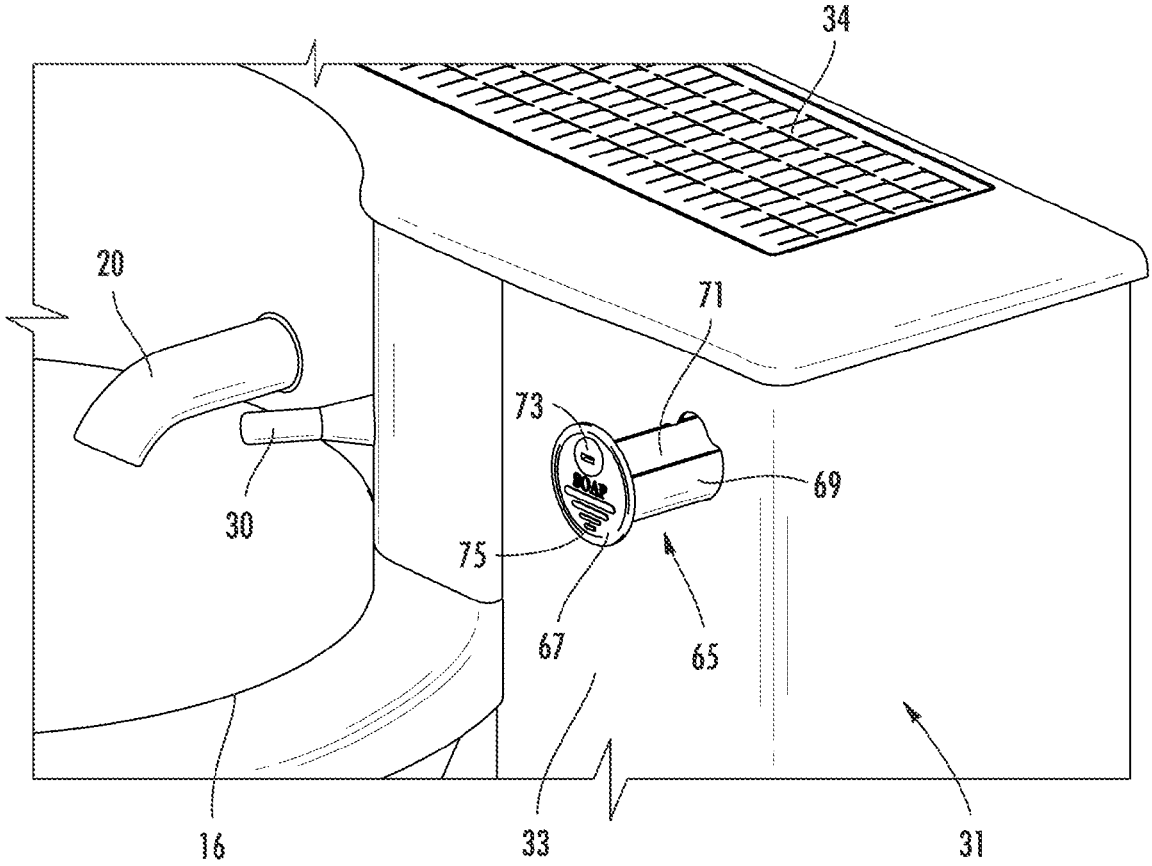
FIG. 35 is a front perspective view of the lavatory system of FIG. 31 showing a soap dispenser interface in the extended position.
Figure 36:
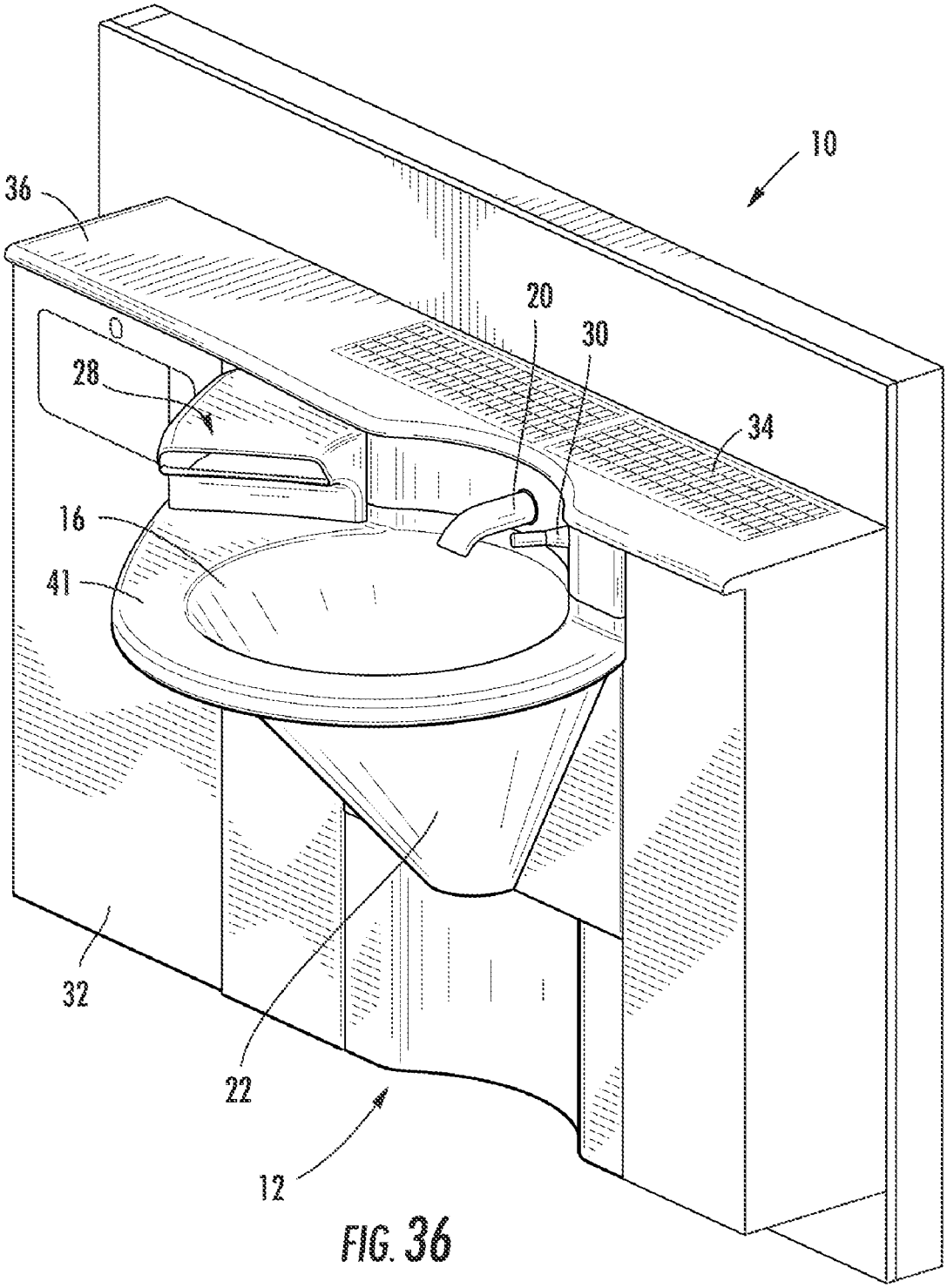
FIG. 36 is a front perspective view of a lavatory system according to an exemplary embodiment.
Figure 37:
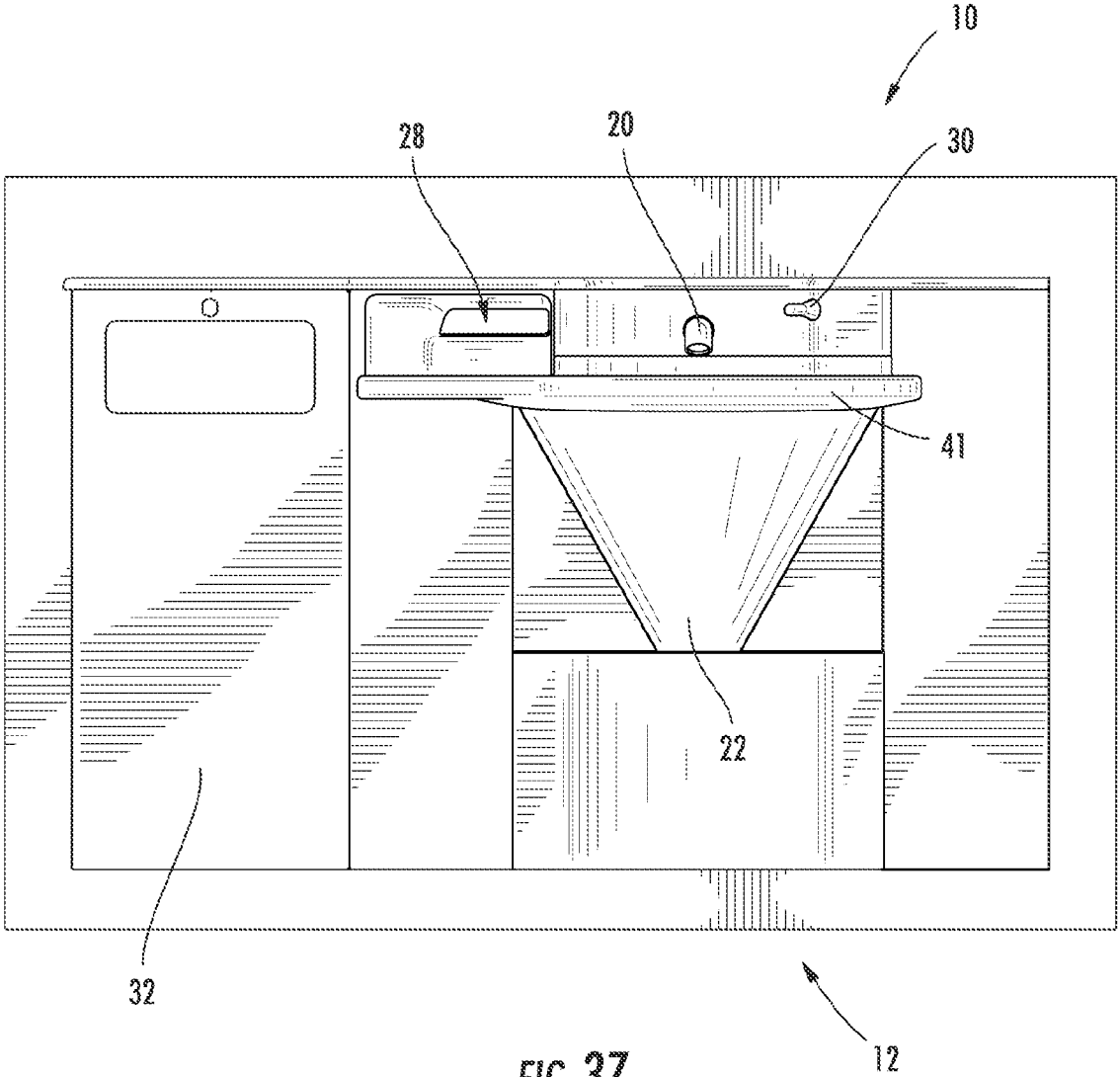
FIG. 37 is a front side view of the lavatory system of FIG. 36.
Figure 38:
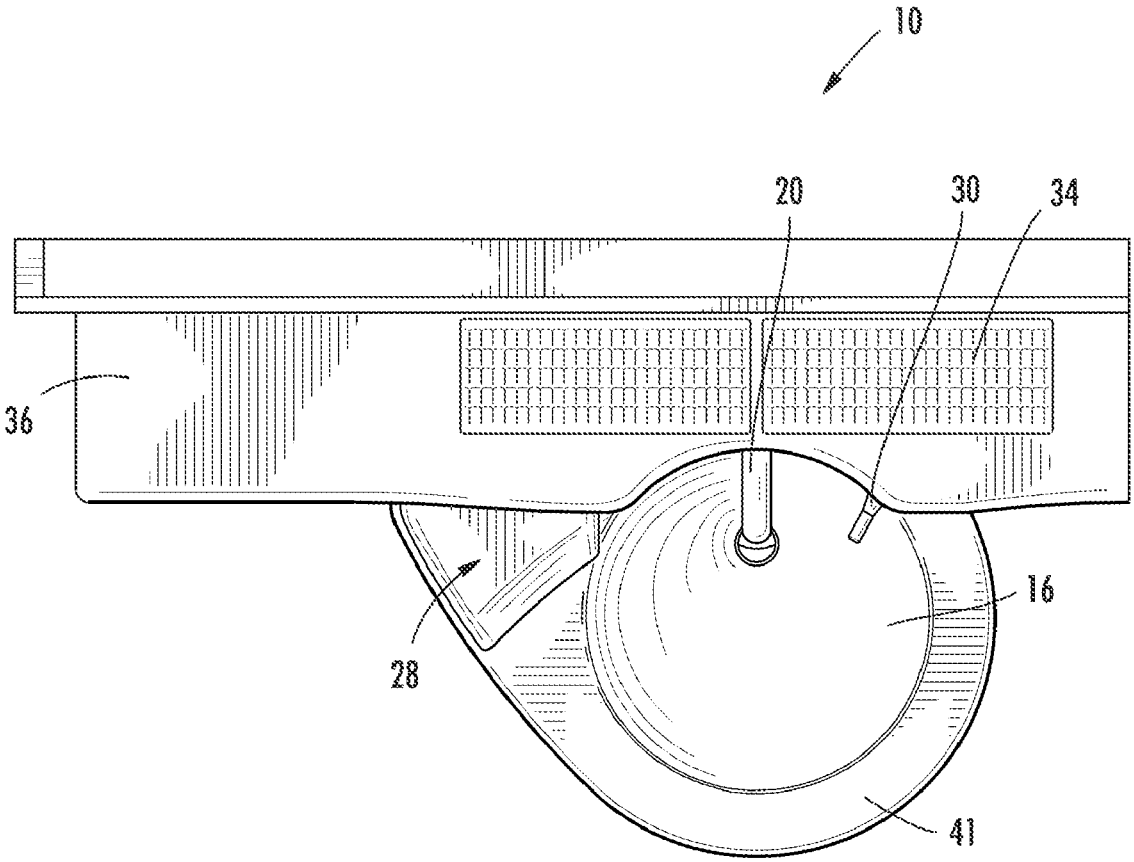
FIG. 38 is a top view of the lavatory system of FIG. 36.

Referring to FIG. 35, base member 69 includes a channel 71 (e.g., trough, cavity, funnel, etc.) extending in a longitudinal direction of base member 69. Channel 71 is configured to be in fluid communication with the reservoir and serves as a conduit between a person filling the reservoir and the reservoir. In use, a person would selectively slide base member 69 out from the stowed position to the fill position. Once in the fill position, the person would add (e.g., pour, dispense, etc.) soap into channel 71. The soap added to channel 71 would then pass to the reservoir where it would be retained until it is dispensed from soap dispenser 30. To facilitate the transfer of the soap from channel 71 to the reservoir, channel 71 may be inclined or angled to bias the soap towards the reservoir. Alternatively, the soap refill may be provided by a cartridge (e.g., removable, replaceable, reusable, disposable, etc.) that is coupled to soap dispenser 30 at/through the interface 65 (e.g., supported by channel).

To prevent unauthorized persons from accessing interface 65, interface 65 is shown as including a lock or latching device 73. According to the embodiment illustrated, latching device 73 is provided on face plate 67 and is configured to be moved between a locked position and an unlocked position by using a key. According to the various alternative embodiments, any of a number of locks or latching devices may be used to secure interface 65 and base member 69 in the stowed position.

Still referring to FIG. 35, face plate 67 is further shown as including a display 75 (e.g., indicator, gauge, etc.) that is configured to provide a user and/or a worker with an indication of the amount of soap within the reservoir and/or notice of when the reservoir is in need of refilling. According to the embodiment illustrated, display 75 includes a plurality of light bars that provide a visual indicator of the amount of soap within the reservoir. For example, if the reservoir is substantially full, all of the light bars may be illuminated. As the reservoir is depleted of soap, the number of light bars may decrease accordingly. The light bars may be illuminated using one or more light emitting diodes (LED) or any other suitable light source. The light bars extend in a substantially horizontal direction, but alternatively, may be provided at any orientation.

Such a system is intended to provide an accurate indication of the level of soap within the reservoir rather than simply providing an indication that the reservoir is either full or empty. Once all of the light bars are off, a user would know that it is time to refill the reservoir. For such an embodiment, a sensor and/or switch may be provided in the reservoir the provides an output signal representative of the soap level in the reservoir.

According to the various alternative embodiments, the illumination of the light bars may be reversed so that the light bars become illuminated as the reservoir becomes depleted of soap. Such a configuration may conserve power because the light bars would not have to be illuminated until the reservoir was close to being empty. According to further alternative embodiments, display 75 may be any type of device capable of providing an indication of the level of soap within the reservoir. For example, display 75 may be gauge having a pointer that moves between an area on the gauge marked "E" for empty and an area on the gauge marked "F" for full. Such a display may be an electronic and/or mechanical gauge. According to still further alternative embodiments, an audio indicator may be provided in addition to or in place of the visual indicator.

The exemplary embodiment illustrated in FIGS. 31 through 35 may be configured as a single unit or may be configured as separate modules that are configured to be reconfigured, arranged, rearranged or the like to provide any of a variety of arrangements depending on the particular application. According to the embodiment illustrated, the two washing stations 12, 14 are separate modular units that have been coupled together to provide a two station lavatory system 10. Likewise, waste receptacle 32 is another module that has been selectively added to the lavatory system.

Referring to FIGS. 36 through 40, a lavatory system 10 is shown according to another exemplary embodiment. The lavatory system illustrated in FIGS. 36 through 40 is substantially the same as the lavatory system illustrated in FIGS. 31 through 35 except that only one washing station module 12 has been used in combination with a waste receptacle module 32.

Referring to FIGS. 41 through 45, a lavatory system 10 is shown according to another exemplary embodiment. The lavatory system illustrated in FIGS. 41 through 45 is substantially the same as the lavatory system illustrated in FIGS. 36 through 40 except that hand dryer 28 and the waste receptacle 32 are provided on the opposite side of basin 16 (i.e., a right-hand side). Locations and orientations of hand dryer 28 and waste receptacle 32 may be altered, reconfigured, rearranged to provide any of a variety of use and design applications.

Referring to FIGS. 46 through 50, a lavatory system 10 is shown according to another exemplary embodiment. The lavatory system illustrated in FIGS. 46 through 50 is substantially the same as the lavatory system illustrated in FIGS. 31 through 35 except that three washing station modules 12, 14, 15 have been used in combination with two waste receptacle modules 32. According to the embodiment illustrated, the two outer washing stations 12, 15, are upper washing stations, while the middle station 14 is a lower washing station. Such an embodiment was illustrated to show the number of different configurations that can be obtained to meet the demands of a particular application. According to the various alternative embodiments, any number of washing station modules and/or waste receptacle modules may be provided in any arrangement to meet the demands of the particular application.

It is to be understood that the invention is not limited to the details of construction and the arrangement of the components set forth in the description or illustrated in the drawings. The invention is capable of other embodiments or being practiced or carried out in various ways. It is also to be understood that the phraseology and terminology employed herein is for the purpose of description and should not be regarded as limiting.

Also, the particular materials used to construct the exemplary embodiments are also illustrative. For example, the countertop may be made from any of a variety of solid surface materials, stainless steel, laminates, fiberglass, and the like. According to an exemplary embodiment, the countertop is made from a densified solid surface material composed of an acrylic modified polyester resin that complies with ANSI Z124.3 and Z124.6 as well as ANSI SS-1-2001, and/or other applicable regulations or standards. According to a particularly preferred embodiment, the surface material is of a type commercially available under the trade name TERREON® from Bradley Corporation of Menomonee Falls, Wis. The countertop is intended to be resistant to chemicals, stains, burns, and impact such that surface damage can easily be repaired with everyday cleaners or fine grit abrasives. According to a preferred embodiment, the countertop or deck is molded from a mixture of resin, filler, pigment, and initiator (catalyst), which forms a liquid when combined. Also, other molding operations may be used to form these components.

Also, the terms are intended to be broad terms and not terms of limitation. These components may be used with any of a variety of hand washing locations and are not intended to be limited to use with washroom or restroom applications. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the multi height lavatory system as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the disclosed embodiments. For example, various embodiments are shown as two or three wash stations, but it should be understood that these are shown as examples and the invention is applicable to any of a variety of wash station configurations (e.g., one, two, three, four, etc. stations). Also, "ADA" standards for height of hand washing stations is provided by way of example, and is not intended to be limiting—any of a variety of heights may be used, (e.g., dictated by accessibility regulations or otherwise desired). Accordingly, all such modifications are intended to be included within the scope of the present invention as defined in the disclosed embodiments. The order or sequence of any process or method steps may be varied or re-sequenced according to alternative embodiments. In the disclosed embodiments, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention.

What is claimed is:

1. A lavatory system comprising:

a first integrated hand washing station including a first basin, a first faucet, a first solenoid valve configured to control water flow to the first faucet, and a first electric hand dryer located adjacent the first basin and the first faucet so that a user of the first washing station may use the first faucet and the first electric hand dryer without leaving the first washing station;

a control system configured to control activation of the first solenoid valve and the first electric hand dryer a first sensor in communication with the control system and configured to sense the presence of the user near the first faucet;

a second sensor in communication with the control system and configured to sense the presence of the user near the first electric hand dryer;

a base configured to at least partially enclose plumbing;

a panel configured to articulate coupled to the base and movable between a closed position and an opened position, wherein the panel prevents access to the interior portion of the base in the closed position and permits access to the interior portion of the base in the opened position; and a hinge coupling the panel to the base, wherein the hinge includes a release mechanism accessible from a bottom portion of the base.

2. The lavatory system of claim 1, wherein the control system is configured to inhibit simultaneous activation of the first solenoid valve and the first hand dryer when a single user is sensed by the first and second sensors.

3. The lavatory system of claim 1, wherein the control system is configured to allow simultaneous activation of the first solenoid valve and the first hand dryer when a plurality of users are sensed by the first sensor within a first detection zone and second sensor within a second detection zone and the first and second detection zones do not overlap.

4. The lavatory system of claim 1, wherein the control system activates the first solenoid valve and the first electric hand dryer according to a predetermined timing and sequence according to an algorithm and sensed conditions.

5. The lavatory system of claim 1, wherein the control system:

prevents activation of the first electric hand dryer when the first solenoid valve has been activated; and prevents activation of the first solenoid valve when the first electric hand dryer has been activated.

6. A lavatory system comprising:

a first integrated hand washing station including a first basin, a first faucet, a first solenoid valve configured to control water flow to the first faucet, a first soap dispenser, and a first electric hand dryer located adjacent the first basin and the first faucet so that a user of the first washing station may use the first faucet, first soap dispenser, and the first electric hand dryer without leaving the first washing station;

a control system configured to control activation of the first solenoid valve first soap dispenser and the first electric hand dryer;

a first sensor to detect the presence of a user proximate the first faucet;

a second sensor to detect the presence of the user proximate the first electric hand dryer;

a third sensor to detect the presence of the user proximate the first soap dispenser;

a base configured to at least partially enclose plumbing;

a panel configured to articulate coupled to the base and movable between a closed position and an opened position, wherein the panel prevents access to the interior portion of the base in the closed position and permits access to the interior portion of the base in the opened position; and a hinge coupling the panel to the base, wherein the hinge includes a release mechanism accessible from a bottom portion of the base.

7. The lavatory system of claim 6, further comprising a single sensor configured to sense the presence of the user-near the first hand washing station, and a second single sensor configured to sense the presence of the user near a second hand washing station, wherein the control system activates the associated first or second solenoid valve and associated first or second hand dryer according to a predetermined timing and sequence.

8. The lavatory system of claim 6, wherein the control system activates the first solenoid valve, the first hand dryer, and the first soap dispenser based on signals received from the first sensor, second sensor, and third sensor.

9. The lavatory system of claim 6, further comprising a second integrated hand washing station including a second basin, a second faucet, a second solenoid valve configured to control water flow to the second faucet, a second soap dispenser, and a second electric hand dryer located adjacent the second basin and the second faucet so that the user of the second hand washing station may use the second faucet, second soap dispenser, and the second electric hand dryer without leaving the second washing station.

10. The lavatory system of claim 9, further comprising the control system includes a separate electronic controller for each one of the first solenoid valve, second solenoid valve, first soap dispenser, second soap dispenser, first electric hand dryer, and second electric hand dryer.

11. The lavatory system of claim 6, wherein the control system:

is programmable to prevents activation of the first electric hand dryer when the first solenoid valve has been activated; and is programmable to prevents activation of the first solenoid valve when the first electric hand dryer has been activated.

12. The lavatory system of claim 9, wherein the first electric hand dryer includes an outlet to direct air across the first basin so that any water that drips from the user's hands will fall within the first basin, and wherein the second electric hand dryer includes an outlet to direct air across the second basin so that any water that drips from the user's hands will fall within the second basin.

13. The lavatory system of claim 6, wherein the control system activates the first solenoid valve and the first electric hand dryer according to a predetermined timing and sequence.

14. The lavatory system of claim 6, wherein the control system is programmable to prevent activation of the first electric hand dryer when the first solenoid valve has been activated.

15. The lavatory system of claim 6, wherein the control system is programmable to prevent activation of the first solenoid valve when the first electric hand dryer has been activated.

16. The lavatory system of claim 9, further comprising a fourth sensor to detect the presence of the user proximate a second electric hand dryer;

wherein each one of the first, second, third, and fourth sensors is programmed to each have a zone;

wherein the zone of each one of the first, second, third, and fourth sensors does not overlap so that a hand of the user is in only one zone at a time;

wherein the first solenoid valve is activated when a user's hand is in the first zone, the first electric hand dryer is activated when a user's hand is in the second zone, the second solenoid valve is activated when a user's hand is in the third zone, and the second electric hand dryer is activated when a user's hand is in the fourth zone.

17. The lavatory system of claim 16 wherein the first and second integrated hand washing stations are located at a same height.

18. A lavatory system comprising:

a first integrated hand washing station including a first basin, a first faucet, a first soap dispenser, a first solenoid valve configured to control water flow to the first faucet, and a first electric hand dryer located adjacent the first basin and the first faucet so that a user of the first washing station may use the first faucet, the first soap dispenser, and the first electric hand dryer without leaving the first washing station;

a control system configured to control activation of the first solenoid valve and the first electric hand dryer;

a first sensor proximate the first faucet for sensing the user proximate the first faucet and activating the first solenoid valve and a second sensor proximate the first electric hand dryer for sensing the user proximate the first electric hand dryer and activating the hand dryer;

a first zone of detection for the first sensor and a second zone of detection for the second sensor wherein the first zone of detection does not overlap the second zone of detection;

wherein the control system is configured to activate the first solenoid valve when an object is placed into the first zone of detection and to activate the first electric hand dryer when an object is placed in the second zone of detection;

a base configured to at least partially enclose plumbing;

a panel configured to articulate coupled to the base and movable between a closed position and an opened position, wherein the panel prevents access to the interior portion of the base in the closed position and permits access to the interior portion of the base in the opened position;

a hinge coupling the panel to the base, wherein the hinge includes a release mechanism accessible from a bottom portion of the base;

the release mechanism extending downwards toward a floor creating a space between the flow and the release mechanism; and the space between the floor and the release mechanism providing manual access to the release mechanism.

19. The lavatory system of claim 18, wherein the first electric hand dryer includes an outlet to direct air across the first basin so that any water that drips from the user's hands will fall within the first basin.

20. The lavatory system of claim 18, further comprising a control system configured to control activation of the first solenoid valve and the first electric hand dryer, wherein the control system is configured to inhibit simultaneous activation of the first solenoid valve, and the first hand dryer.

21. The lavatory system of claim 18
wherein the release mechanism comprises a cylindrical rod.

22. The lavatory system of claim 18, further comprising a towel dispenser having a housing with a generally upwardly facing top surface, wherein a roll of paper towel located within the housing has an end that projects upward out of an opening in the upwardly facing top surface of the dispenser to be accessed by the user.

23. The lavatory system of claim 18, wherein the control system activates the first solenoid valve and the first electric hand dryer according to a predetermined timing and sequence.

24. The lavatory system of claim 22, wherein the towel dispenser is located between the first hand washing station and the second hand washing station.

25. The lavatory system of claim 22, wherein the housing of the towel dispenser includes a front panel that is angled such that the top portion of the front panel extends further away from the base and a bottom portion of the front panel to accommodate users in a wheelchair.

26. The lavatory system of claim 18, wherein the panel is substantially horizontal in the closed position and is substantially vertical in the open position.

27. The lavatory system of claim 22, wherein the generally upwardly facing top surface forms a recess configured to collect water that may drip from the user's hand when accessing the end of the paper towel.

28. The lavatory system of claim 18, wherein the first solenoid valve and the first sensor are powered by a photovoltaic system.

29. A lavatory system capable of providing simultaneous hand washing functionality to a plurality of users, the lavatory system comprising:

(a) a base at least partially enclosing plumbing and configured to be coupled to a wall when installed;

(b) a first integrated hand washing station coupled to the base, the first integrated hand washing station comprising:

(i) a first basin having a front top edge located at a first height above the floor;

(ii) a first faucet configured to direct water into the first basin;

(iii) a first soap dispenser;

(iv) a first electric hand dryer, wherein the first faucet, the first soap dispenser, and the first electric hand dryer are located adjacent the first basin so that a user of the first washing station may use the first faucet, the first soap dispenser, and/or the first electric hand dryer without leaving the first washing station;

(c) a second integrated hand washing station coupled to the base and spaced apart from the first integrated hand washing station, the second integrated hand washing station comprising:

(i) a second basin having a front top edge located at a second height above the floor, the second height of the second basin being different from the first height of the first basin;

(ii) a second faucet configured to direct water into the second basin;

(iii) a second soap dispenser;

(iv) a second electric hand dryer, wherein the second faucet, the second soap dispenser, and the second electric hand dryer are located adjacent the second basin so that a user of the second washing station may use the second faucet, the second soap dispenser, and/or the second electric hand dryer without leaving the second washing station; and (d) a control system configured to control operation of the first integrated hand washing station and second integrated hand washing station, the control system including a first sensor to control the first faucet, a second sensor to control the first electric hand dryer, a third sensor to control the second faucet, a fourth sensor to control the second electric hand dryer;

wherein the control system is configured to inhibit simultaneous activation of the first faucet and the first hand dryer when a single user is sensed by the first and second sensors;

the control system is configured to allow simultaneous activation of the first faucet and the first hand dryer when a plurality of users is sensed by the first and second sensors;

the control system is configured to inhibit simultaneous activation of the second faucet and the second hand dryer when a single user is sensed by the third and fourth sensors;

the control system is configured to allow simultaneous activation of the second faucet and the second hand dryer when a plurality of users is sensed by the third and fourth sensors;

(e) the base configured to at least partially enclose plumbing;

a panel configured to articulate coupled to the base and movable between a closed position and an opened position, wherein the panel prevents access to the interior portion of the base in the closed position and permits access to the interior portion of the base in the opened position; and a hinge coupling the panel to the base, wherein the hinge includes a release mechanism accessible from a bottom portion of the base.

30. The lavatory system of claim 29, wherein the first height is about 34 inches above the floor and the second height is about 31 inches above the floor.

31. The lavatory system of claim 29, further comprising;

a third basin having a front top edge located at a third height above the floor, the third height of the third basin is approximately the same as either the first height or the second height.

32. The lavatory system of claim 31, wherein the first height is about 34 inches above the floor, the second height is about 31 inches above the floor, and the third height is about less than 30 inches above the floor.

* * * * *